US009923323B2

(12) United States Patent
Kim et al.

(10) Patent No.: US 9,923,323 B2
(45) Date of Patent: Mar. 20, 2018

(54) CABLE ASSEMBLIES, SYSTEMS, AND METHODS FOR MAKING THE SAME

(71) Applicant: Apple Inc., Cupertino, CA (US)

(72) Inventors: Min Chul Kim, San Jose, CA (US); Unhyi Yang, Cupertino, CA (US); Robert V. Weber, Redwood City, CA (US); Sean Thomas McIntosh, Cupertino, CA (US); Colin J. Abraham, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/333,980

(22) Filed: Oct. 25, 2016

(65) Prior Publication Data

US 2017/0125958 A1 May 4, 2017

Related U.S. Application Data

(60) Provisional application No. 62/249,061, filed on Oct. 30, 2015.

(51) Int. Cl.

| | |
|---|---|
| ***H01R 11/00*** | (2006.01) |
| ***H01R 31/06*** | (2006.01) |
| ***H01R 24/28*** | (2011.01) |
| ***H01R 24/20*** | (2011.01) |
| ***H01R 13/627*** | (2006.01) |
| *H01R 103/00* | (2006.01) |

(52) U.S. Cl.

CPC ..... *H01R 31/06* (2013.01); *H01R 13/6273* (2013.01); *H01R 24/20* (2013.01); *H01R 24/28* (2013.01); *H01R 2103/00* (2013.01)

(58) Field of Classification Search

CPC ..... H01R 13/58; H01R 13/5812; H01R 13/5837; H01R 23/025; H01R 2103/00; H01R 27/02; H01R 29/00; H01R 31/02; H01R 31/06; H01R 2201/06

USPC ..... 439/369, 502, 460; 174/36

See application file for complete search history.

(56) References Cited

U.S. PATENT DOCUMENTS 2,721,313 A * 10/1955 English ..... H01R 13/6392 439/369
3,611,257 A * 10/1971 Carkhuff ..... H01R 43/24 439/587
4,330,167 A * 5/1982 Chien-Tung ..... H01R 13/68 337/198
5,059,138 A * 10/1991 Olsson ..... H01R 12/675 439/351
5,099,572 A * 3/1992 Lazaro, Jr. ..... H01R 13/5208 29/859
5,224,874 A * 7/1993 Sell ..... H01R 13/18 29/883
5,260,678 A * 11/1993 Van Wagener ..... H01F 38/10 174/DIG. 2

(Continued)

FOREIGN PATENT DOCUMENTS

CN 201845908 U 5/2011
CN 103238254 B 8/2013

(Continued)

*Primary Examiner* — Abdullah Riyami
*Assistant Examiner* — Vladimir Imas
(74) *Attorney, Agent, or Firm* — Van Court & Aldridge LLP

(57) ABSTRACT

Cable assemblies, systems, and methods for making the same are provided.

22 Claims, 34 Drawing Sheets

(56) References Cited

U.S. PATENT DOCUMENTS 5,413,502 A * 5/1995 Wang ..... H01R 24/46 439/314
5,601,446 A * 2/1997 Wright ..... H01R 13/627 439/357
5,641,310 A * 6/1997 Tiberio, Jr. ..... H01R 13/625 439/680
5,647,751 A * 7/1997 Shulman ..... H01R 13/504 439/106
5,960,540 A * 10/1999 Pentz ..... H01R 13/025 29/33 M
5,971,733 A * 10/1999 Huang ..... B29C 45/14639 264/272.15
6,004,150 A * 12/1999 Chapman ..... H01R 29/00 439/189
6,089,921 A * 7/2000 Chou ..... H01R 31/06 439/27
6,162,085 A * 12/2000 Chugh ..... H01R 13/5825 439/275
6,179,646 B1 * 1/2001 Horchler ..... H01R 13/5837 439/460
6,227,883 B1 * 5/2001 Lee ..... H01R 13/652 439/106
6,315,600 B1 * 11/2001 Droesbeke ..... H01R 13/5825 439/368
6,402,546 B1 * 6/2002 Groves ..... H01R 13/72 439/172
6,497,589 B1 * 12/2002 Hutchinson ..... H01R 43/20 439/460
6,524,132 B1 * 2/2003 Nagai ..... H01F 27/2828 439/460
6,537,104 B1 * 3/2003 Hagmann ..... H02G 3/0666 439/460
6,547,600 B2 * 4/2003 Yen ..... H01R 13/68 439/460
6,599,148 B1 * 7/2003 Jensen ..... H01R 13/5808 439/460
6,739,900 B2 * 5/2004 Mortun ..... H01R 13/5837 439/460
7,029,332 B2 * 4/2006 Chien ..... H01R 13/684 439/106
7,033,209 B2 * 4/2006 Swiatek ..... B62J 99/00 439/502
7,059,892 B1 * 6/2006 Trout ..... H01R 13/5812 439/460
7,070,460 B1 * 7/2006 Nagano ..... H01R 43/24 439/736
7,140,897 B2 * 11/2006 Axenbock ..... H01R 13/2421 439/271
7,217,147 B2 * 5/2007 Yoshida ..... H01R 13/53 439/181
7,338,306 B1 * 3/2008 Chen ..... H01R 13/5812 439/320
7,479,028 B1 * 1/2009 Pottorff ..... H01R 13/5812 439/472
7,578,695 B2 * 8/2009 Boeck ..... H01R 13/5804 439/460
7,609,502 B2 * 10/2009 Kauffman ..... H01P 1/045 361/119
7,654,856 B2 * 2/2010 Wu ..... H01R 4/023 439/460
7,665,863 B2 * 2/2010 Tseng ..... F21V 15/01 362/249.02
7,771,214 B2 * 8/2010 Wang ..... H01R 13/4223 439/106
7,775,825 B2 * 8/2010 Wu ..... H01R 13/5812 439/460
7,845,971 B1 * 12/2010 Lee ..... H01R 9/032 439/459
7,862,369 B2 * 1/2011 Gimenes ..... H01R 13/5812 439/446
7,955,096 B2 * 6/2011 Arenas ..... H01R 9/2491 439/107
8,038,481 B1 * 10/2011 Creighton ..... H01R 33/9456 439/660
8,398,435 B2 * 3/2013 Aurongzeb ..... H01R 13/625 439/607.41
8,622,775 B2 * 1/2014 Takashima ..... H01R 4/024 439/886
8,900,010 B2 * 12/2014 Aoki ..... H01R 4/185 439/587
9,039,434 B2 * 5/2015 Winningham ..... H01R 13/521 439/271
9,077,112 B2 * 7/2015 Mitchell ..... H01R 13/625
9,142,911 B1 * 9/2015 Kao ..... H01R 24/28
9,257,784 B2 * 2/2016 Kawamoto ..... H01R 13/424
9,330,815 B2 5/2016 Ng et al.
9,431,755 B2 * 8/2016 Lux ..... H01R 13/5216
9,466,898 B2 * 10/2016 Ahn ..... H01R 11/12
9,627,793 B2 * 4/2017 Kao ..... H01R 13/504
2002/0119692 A1 * 8/2002 Burton ..... H01R 4/489 439/346
2005/0191883 A1 * 9/2005 Woodward ..... H01R 43/16 439/115
2010/0210151 A1 * 8/2010 Niles ..... H01R 13/052 439/851
2013/0040483 A1 * 2/2013 Ngo ..... H01R 12/7023 439/328
2013/0040500 A1 * 2/2013 Ngo ..... H01R 12/75 439/660

FOREIGN PATENT DOCUMENTS

CN 203166226 U 8/2013
CN 103794958 A 5/2014
CN 103855524 A 6/2014
WO 2015/085166 A1 6/2015

* cited by examiner

CABLE ASSEMBLIES, SYSTEMS, AND METHODS FOR MAKING THE SAME

CROSS-REFERENCE TO RELATED APPLICATION(S)

This application claims the benefit of prior filed U.S. Provisional Patent Application No. 62/249,061, filed Oct. 30, 2015, which is hereby incorporated by reference herein in its entirety.

TECHNICAL FIELD

This disclosure relates to cable assemblies, systems, and methods for making the same.

BACKGROUND OF THE DISCLOSURE

Conventional cables used for data and/or power signal transmission typically have large cross-sections due to insulation and circular conductor groupings and/or typically have connectors that are able to be selectively coupled to a remote device by an end user. Accordingly, alternative cables are needed.

SUMMARY OF THE DISCLOSURE

Cable assemblies, systems, and methods for making the same are provided.

For example, in some embodiments, a cable may include a first conductor subassembly including a first plurality of conductors that extends along a length of the cable and a second conductor subassembly including a second plurality of conductors that extends along the length of the cable, wherein each conductor of the first plurality of conductors is twisted about a twist axis of the first conductor subassembly along at least a portion of a length of the first conductor subassembly, each conductor of the second plurality of conductors is twisted about a twist axis of the second conductor subassembly along at least a portion of a length of the second conductor subassembly, the first conductor subassembly and the second conductor subassembly are together twisted about a twist axis of the cable along at least a portion of the length of the cable, at a cross-section of the cable that is perpendicular to the twist axis of the cable, the first conductor subassembly defines a first shape comprising a first arc, at the cross-section, the second conductor subassembly defines a second shape comprising a second arc, and, at the cross-section, the first arc and the second arc define different parts of a circumference of a circle.

As another example, in some embodiments, a cable may include a first conductor subassembly including a first plurality of conductors that extends along a length of the cable, a second conductor subassembly including a second plurality of conductors that extends along the length of the cable, and a third conductor subassembly including a third plurality of conductors that extends along the length of the cable, wherein, at a cross-section of the cable that is perpendicular to the length of the cable, an outer periphery of the first conductor subassembly defines a first shape comprising a first arc, at the cross-section, an outer periphery of the second conductor subassembly defines a second shape comprising a second arc, at the cross-section, an outer periphery of the third conductor subassembly defines a third shape comprising a third arc, and, at the cross-section, the first arc, the second arc, and the third arc define different parts of a circumference of a circle.

As yet another example, in some embodiments, a method of forming a cable may include twisting each conductor of a first plurality of conductors about a first twist axis, forming a first conductor subassembly that includes at least a portion of the first plurality of twisted conductors, providing a first insulation subassembly of an insulation assembly about the first conductor subassembly along a length of the first conductor subassembly, twisting each conductor of a second plurality of conductors about a second twist axis, forming a second conductor subassembly that includes at least a portion of the second plurality of twisted conductors, providing a second insulation subassembly of the insulation assembly about the second conductor subassembly along a length of the second conductor subassembly, twisting at least a portion of the length of the first conductor subassembly and at least a portion of the length of the second conductor subassembly about a third twist axis, and disposing a jacket about the insulation assembly for keeping the portion of the length of the first conductor subassembly and the portion of the length of the second conductor subassembly twisted about the third twist axis.

As yet another example, in some embodiments, an assembly for being electrically coupled to an electronic device including a first electrical contact and a second electrical contact, may include a cable subassembly including a first conductor subassembly and a second conductor subassembly, and a cable connector subassembly including a first conductor contact including a first conductor coupling portion electrically coupled to the first conductor subassembly and a first conductor contact extension portion extending from the first conductor coupling portion, a second conductor contact including a second conductor coupling portion electrically coupled to the second conductor subassembly and a second conductor contact extension portion extending from the second conductor coupling portion, a body component encompassing the first conductor coupling portion and the second conductor coupling portion, a first device contact including a first device coupling portion operative to be electrically coupled to the first electrical contact of the electronic device, and a first device contact extension portion extending from the first device coupling portion and electrically coupled to the first conductor contact extension portion, and a second device contact including a second device coupling portion operative to be electrically coupled to the second electrical contact of the electronic device, and a second device contact extension portion extending from the second device coupling portion and electrically coupled to the second conductor contact extension portion.

As yet another example, in some embodiments, an assembly for being electrically coupled to an electronic device comprising a retention mechanism and an electrical contact that is at least partially positioned within a device receptacle space defined by the electronic device, may include a conductor subassembly including a conductor and a cable connector subassembly including a retainable feature that is operative to interact with the retention mechanism for retaining a portion of the cable connector subassembly within the device receptacle space when the retainable feature is inserted into the device receptacle space beyond a portion of the retention mechanism, and a device coupling portion electrically coupled to the conductor and operative to be electrically coupled to the electrical contact when the portion of the cable connector subassembly is retained within the device receptacle space.

As yet another example, in some embodiments, a method of forming a cable assembly may include electrically coupling a first conductor subassembly to a first conductor contact, electrically coupling a second conductor subassembly to a second conductor contact, provisioning a body component that electrically insulates the first conductor contact from the second conductor contact, after the provisioning, electrically coupling a first device contact to the first conductor contact, and, after the provisioning, electrically coupling a second device contact to the second conductor contact.

As yet another example, in some embodiments, an electronic device operative to be electrically coupled to a cable assembly including a cable contact and a retainable feature, the electronic device may include a receptacle defining a receptacle space, a retention mechanism that is positioned within the receptacle space and that is operative to interact with the retainable feature for retaining a portion of the cable assembly within the receptacle space when the retainable feature is inserted in an insertion direction into the receptacle space beyond a portion of the retention mechanism, and a device contact that is operative to be electrically coupled to the cable contact when the portion of the cable assembly is retained within the receptacle space.

As yet another example, in some embodiments, an electronic device operative to be electrically coupled to a cable assembly including a cable contact and a retainable feature, where the electronic device may include a receptacle defining a receptacle space, a retention mechanism that is positioned within the receptacle space and that is operative to interact with the retainable feature for retaining a portion of the cable assembly within the receptacle space when the retainable feature is inserted into the receptacle space, and a device contact that is operative to be electrically coupled to the cable contact when the portion of the cable assembly is retained within the receptacle space, wherein, when the portion of the cable assembly is retained within the receptacle space, the retention mechanism is operative to interact with the retainable feature for preventing the portion of the cable assembly from being removed from the receptacle space without a removal tool being introduced into the receptacle space.

An electronic device operative to be electrically coupled to a cable assembly including a cable contact and a retainable feature, where the electronic device may include a receptacle defining a receptacle space, an annular structure that extends about a structure axis and that is held within the receptacle space and that is operative to retain a portion of the cable assembly within the receptacle space when the portion of the cable assembly is inserted into the receptacle space, and a device contact that is operative to be electrically coupled to the cable contact when the portion of the cable assembly is retained within the receptacle space.

This Summary is provided only to summarize some example embodiments, so as to provide a basic understanding of some aspects of the subject matter described in this document. Accordingly, it will be appreciated that the features described in this Summary are only examples and should not be construed to narrow the scope or spirit of the subject matter described herein in any way. Unless otherwise stated, features described in the context of one example may be combined or used with features described in the context of one or more other examples. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters may refer to like parts throughout, and in which.

DETAILED DESCRIPTION OF THE DISCLOSURE

Cable assemblies, systems, and methods for making the same are provided and described with reference to FIGS. 1-45.

Figure 1:
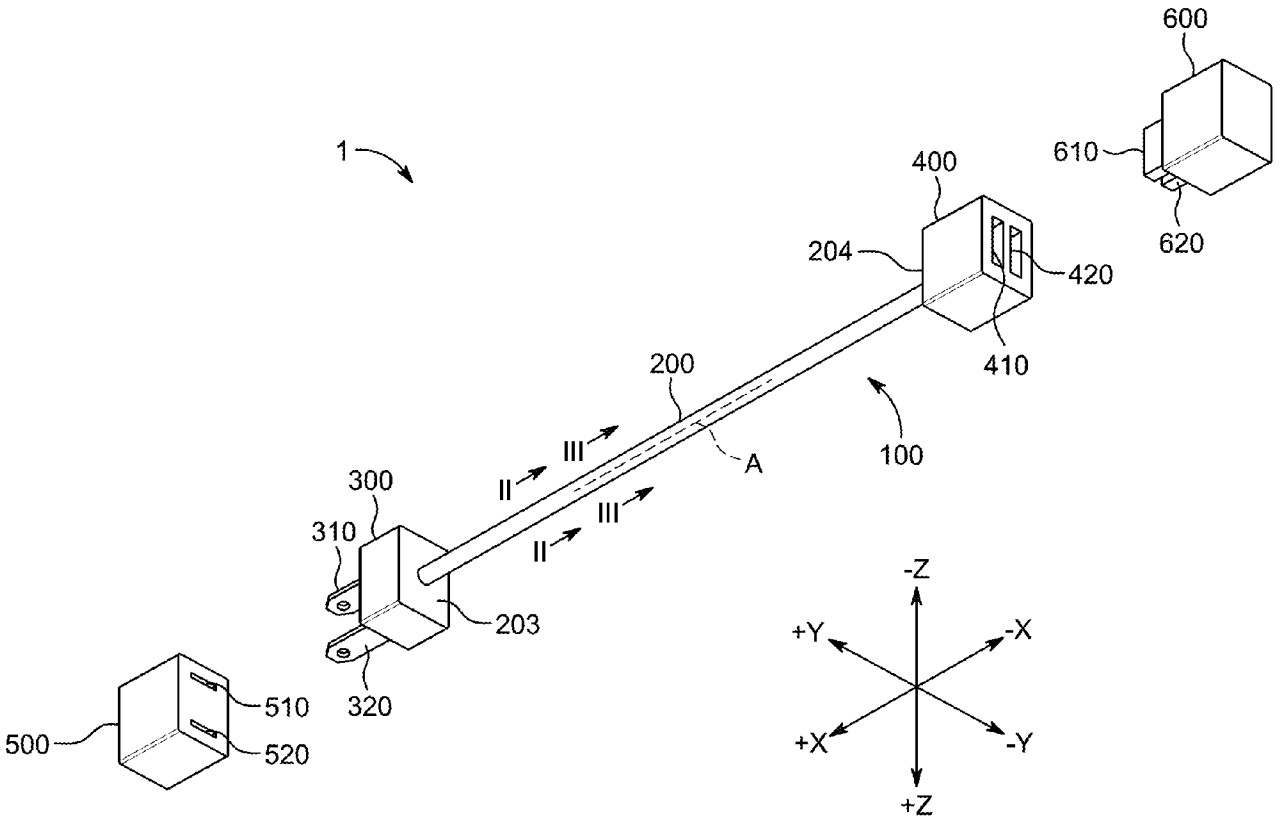
FIG. 1 is a perspective view of an illustrative system that includes a cable assembly and two device subsystems.

As shown in FIG. 1, a system 1 may include a cable assembly 100 that may be operative to electrically couple a first device subsystem 500 and a second device subsystem 600. Cable assembly 100 may include a cable subassembly 200 extending between a first cable connector subassembly 300 and a second cable connector subassembly 400. Cable subassembly 200 may include at least one electrical conductor that may electrically couple at least one contact of first cable connector subassembly 300 with at least one respective contact of second cable connector subassembly 400, while first cable connector subassembly 300 may be operative to interface with first device subsystem 500 such that the least one contact of first cable connector subassembly 300 may be electrically coupled with at least one contact of first device subsystem 500, and while second cable connector subassembly 400 may be operative to interface with second device subsystem 600 such that the at least one contact of second cable connector subassembly 400 may be electrically coupled with at least one contact of second device subsystem 600, such that cable assembly 100 may electrically couple the at least one contact of first device subsystem 500 with the at least one contact of second device subsystem 600.

As shown in FIG. 1, first cable connector subassembly 300 may include at least two contacts, such as contact 310 and contact 320, while first device subsystem 500 may include at least two contacts, such as contact 510 and contact 520. As shown, contacts 310 and 320 may be male-type contacts that may be operative to be received and at least partially held by respective female-type contacts 510 and 520, although it is to be understood that one or both of contacts 310 and 320 may be female-type and a respective one or both of contacts 510 and 520 may be male-type in other embodiments. Alternatively, any one or more of the contacts may be genderless or of a mixed gender type. Moreover, as shown in FIG. 1, second cable connector subassembly 400 may include at least two contacts, such as contact 410 and contact 420, while second device subsystem 600 may include at least two contacts, such as contact 610 and contact 620. As shown, contacts 610 and 620 may be male-type contacts that may be operative to be received and at least partially held by respective female-type contacts 410 and 420, although it is to be understood that one or both of contacts 610 and 620 may be female-type and a respective one or both of contacts 410 and 420 may be male-type in other embodiments. Alternatively, any one or more of the contacts may be genderless or of a mixed gender type.

First device subsystem 500 and second device subsystem 600 may be any suitable subsystems that may be electrically coupled to one another via cable assembly 100. For example, in some particular embodiments, first device subsystem 500 may be a mains power subsystem (e.g., an electrical grid) where contacts 510 and 520 may be provided by an alternating current (AC) power socket of the electrical grid, while second device subsystem 600 may be any suitable electronic device (e.g., a computer or loud speaker or appliance) where contacts 610 and 620 may be provided by any suitable contacts of that device, such that AC power may be conducted along cable assembly 100 between first device subsystem 500 and second device subsystem 600 (e.g., along line and neutral connections). Alternatively, in some other embodiments, first device subsystem 500 may be a media electronic device (e.g., a portable media player) where at least one of contacts 510 and 520 may be provided as an audio jack socket, while second device subsystem 600 may be any suitable accessory device (e.g., a loud speaker) where at least one of contacts 610 and 620 may be provided as an audio jack plug, such that audio signal data may be conducted along cable assembly 100 between first device subsystem 500 and second device subsystem 600. Although only two contacts are shown to be provided by each one of first cable connector subassembly 300, second cable connector subassembly 400, first device subsystem 500, and second device subsystem 600, it is to be understood that one, some, or all of those entities may include only one contact or any suitable number of contacts greater than two (e.g., a set of three contacts may be provided by each entity such that three connections may be provided by cable assembly 100 between first device subsystem 500 and second device subsystem 600 (e.g., along line, neutral, and earth/ground connections for AC power)).

Continuing with the exemplary embodiment, where each one of first cable connector subassembly 300, second cable connector subassembly 400, first device subsystem 500, and second device subsystem 600 may include at least two contacts (e.g., as shown in FIG. 1), cable subassembly 200 may include at least two electrically isolated or insulated conductors or at least two electrically isolated or insulated groups of conductors, each of which may be operative to conduct any suitable data signals and/or any suitable power signals between a contact of first cable connector subassembly 300 and a respective contact of second cable connector subassembly 400. For example, as shown in FIG. 1, cable subassembly 200 may be arranged to extend along a central longitudinal axis A from a first cable end 203 to an opposite second cable end 204 (e.g., along the X-axis), although it is to be understood that cable subassembly 200 may be flexible along at least a portion of the length of cable subassembly 200 such that it may be arranged in any other suitable shape other than a linear shape along a particular axis in space (e.g., cable subassembly 200 may be bent or coiled or otherwise manipulated into any suitable shape during use or otherwise). Cable subassembly 200 may include a first group of conductors 210 (e.g., a first conductor subassembly or first conductor group), a second group of conductors 220 (e.g., a second conductor subassembly or first conductor group), an insulation subassembly 250 that may be operative to electrically isolate or insulate first conductor group 210 from second conductor group 220 along at least a portion of the length of cable subassembly 200, a jacket 260, and/or a cover 270. First conductor group 210 may extend between a first conductor group first end 213 at first cable end 203 and a first conductor group second end 214 at second cable end 204, while second conductor group 220 may extend between a second conductor group first end 223 at first cable end 203 and a second conductor group second end 224 at second cable end 204. Insulation subassembly 250 may include a first insulation 230 that may be disposed about and along at least a portion of first conductor group 210 and/or a second insulation 240 that may be disposed about and along at least a portion of second conductor group 220. Jacket 260 may be disposed about and along at least a portion of insulation subassembly 250, while cover 270 may be disposed about and along at least a portion of jacket 260.

Figure 2:
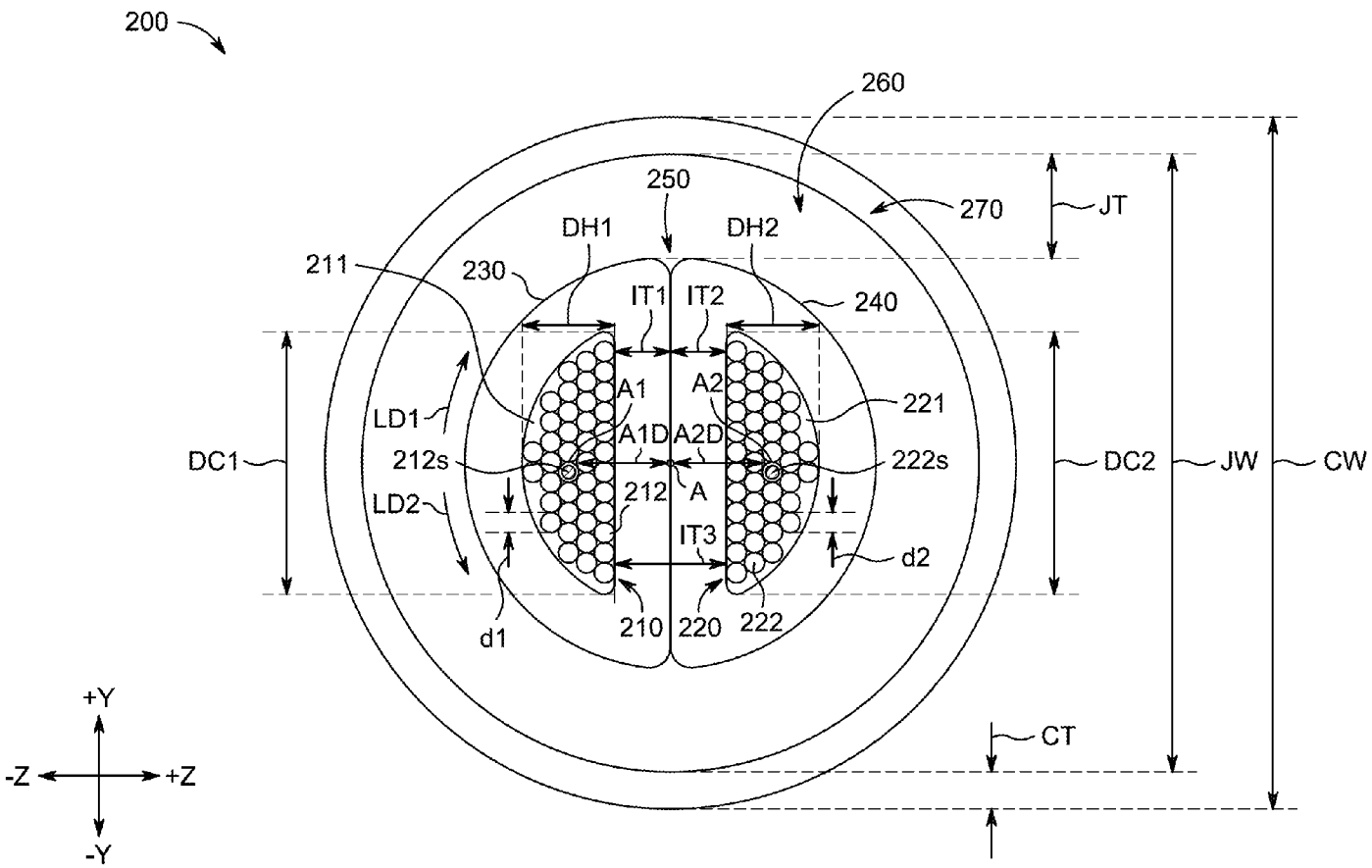
FIG. 2 is a cross-sectional view of a cable subassembly of FIG. 1, taken from line II-II of FIG. 1.

First conductor group 210 may extend along a length of cable subassembly 200 (e.g., along a first conductor group central axis A1 that may be adjacent to central longitudinal axis A) from first end 213 proximate first cable end 203 to opposite second end 214 proximate second cable end 204. At a cross-section of cable subassembly 200 taken perpendicularly to axis A (e.g., the cross-section of FIG. 2), central axis A1 of first conductor group 210 may extend through the centroid or geometric center of first conductor group 210 in that cross-section, which may be distanced from central longitudinal axis A by a distance A1D, where central longitudinal axis A of cable subassembly 200 may extend through the centroid or geometric center of cable subassembly 200 in that cross-section. For example, in some embodiments, distance A1D may be about 0.78 millimeters or may be in any suitable range, such as between about 0.73 millimeters and 0.83 millimeters. First conductor group 210 may include one or more conductors 212 that may be configured to electrically transmit signals between ends 213 and 214 of first conductor group 210. Each conductor 212 may be any suitable electrically conductive conductor that may be composed of any suitable material including, but not limited to, copper (e.g., a soft copper (e.g., annealed soft bare copper wire), a tin-plated soft copper, a silver-plated copper alloy, etc.), aluminum, steel, and any combination thereof. Although FIGS. 2 and 3 may only show forty-one (41) conductors 212 in first conductor group 210, it is to be understood that first conductor group 210 may include any suitable number of conductors 212, such as thirty-five (35) to forty-nine (49) conductors, or even just one (1) conductor, in some embodiments. Each conductor 212 may be of any suitable geometry and, as shown in FIG. 2, may have a diameter d1 or any other suitable cross-sectional width. For example, in some embodiments, diameter d1 of conductor 212 may be about 0.16 millimeters. Each conductor 212 may be any suitable American Wire Gauge (AWG), such as number 34 AWG, while first conductor group 210 may have an effective size with any suitable AWG, such as number 18 AWG, and while second conductor group 220 may have an effective size with any suitable AWG, such as number 18 AWG.

Figure 3:
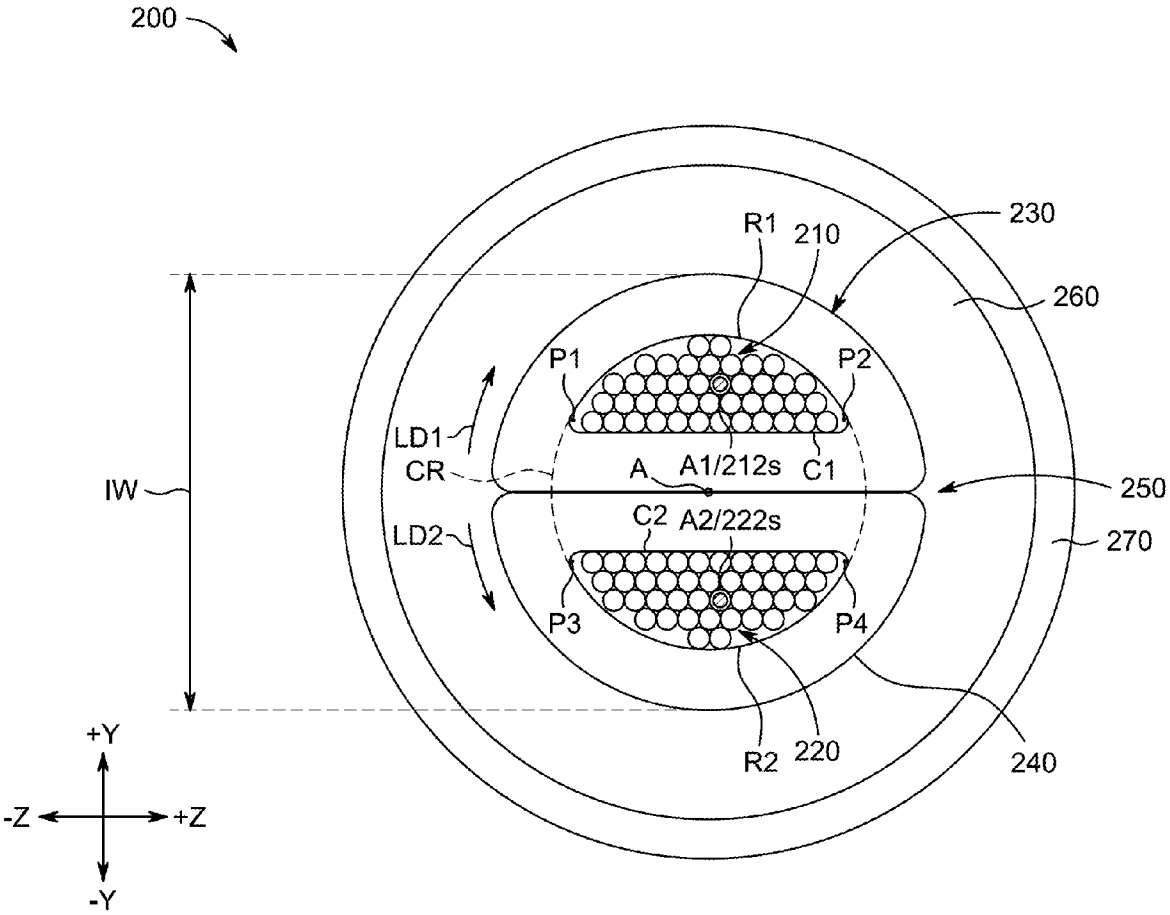
FIG. 3 is a cross-sectional view of the cable subassembly of FIGS. 1 and 2, taken from line III-III of FIG. 1.

First conductor group 210 (e.g., the collection of conductors 212) may be of any suitable shape (e.g., as may be defined by the geometry of a first interior region 211 within an interior surface of first insulation 230), such as "D-shaped" or semi-circular or less than semi-circular (e.g., a circular segment (e.g., a shape with an arc less than half the circumference of a circle)) or the like in cross-section and, as shown in FIG. 2, may include a chord with a chord length DC1 extending between end points of an arc with an arc height DH1. For example, in some embodiments, chord length DC1 of first conductor group 210 may be about 1.92 millimeters and/or arc height DH1 of first conductor group 210 may be about 0.80 millimeters. Moreover, in some embodiments, as shown in FIGS. 2 and 3, amidst the one or more conductors 212 of first conductor group 210 (e.g., within the space that may be defined by an interior surface of first insulation 230), cable subassembly 200 may include at least one first support member 212*s* (e.g., proximate central axis A1 of first conductor group 210) that may be provided to extend along at least a portion of the length of cable subassembly 200 for providing structural reinforcement or filler material, where each first support member may be composed of any suitable material, such as a para-aramid synthetic fiber (e.g., 1500 Denier Kevlar™ fiber). While first conductor group 210 may extend along first conductor group axis A1 (e.g., parallel to central longitudinal axis A of cable subassembly 200), one, some, or all conductors 212 of first conductor group 210 may be twisted in a lay direction about a twist axis of first conductor group 210 (e.g., first conductor group axis A1 or any other axis that may extend through first conductor group 210) along at least a portion of the length of first conductor group 210 (e.g., in a first lay direction of arrow LD1 about the twist axis of first conductor group 210 or in a second lay direction of arrow LD2 about the twist axis of first conductor group 210). Regardless of the lay direction in which conductor(s) 212 of first conductor group 210 may be twisted about the twist axis of first conductor group 210, the lay length of each twisted conductor (i.e., the distance required for a single conductor 212 to be turned 360° about the twist axis of first conductor group 210) may be any suitable length, such as in a range between 15 millimeters and 25 millimeters, or a maximum length of 20 millimeters.

Second conductor group 220 may extend along a length of cable subassembly 200 (e.g., along a second conductor group central axis A2 that may adjacent to central longitudinal axis A) from first end 223 proximate first cable end 203 to opposite second end 224 proximate second cable end 204. At a cross-section of cable subassembly 200 taken perpendicularly to axis A (e.g., the cross-section of FIG. 2), central axis A2 of second conductor group 220 may extend through the centroid or geometric center of second conductor group 220 in that cross-section, which may be distanced from central longitudinal axis A by a distance A2D, where central longitudinal axis A of cable subassembly 200 may extend through the centroid or geometric center of cable subassembly 200 in that cross-section. For example, in some embodiments, distance A2D may be about 0.78 millimeters or may be in any suitable range, such as between about 0.73 millimeters and 0.83 millimeters. Second conductor group 220 may include one or more conductors 222 that may be configured to electrically transmit signals between ends 223 and 224 of second conductor group 220. Each conductor 222 may be any suitable electrically conductive conductor that may be composed of any suitable material including, but not limited to, copper (e.g., a soft copper (e.g., annealed soft bare copper wire), a tin-plated soft copper, a silver-plated copper alloy, etc.), aluminum, steel, and any combination thereof. Although FIGS. 2 and 3 may only show forty-one (41) conductors 222 in second conductor group 220, it is to be understood that second conductor group 220 may include any suitable number of conductors 222, such as thirty-five (35) to forty-nine (49) conductors, or even just one (1) conductor, in some embodiments. Each conductor 222 may be of any suitable geometry and, as shown in FIG. 2, may have a diameter d2 or any other suitable cross-sectional width. For example, in some embodiments, diameter d2 of conductor 222 may be about 0.16 millimeters. Each conductor 222 may be any suitable American Wire Gauge (AWG), such as number 34 AWG, while second conductor group 220 may have an effective size with any suitable AWG, such as number 18 AWG, and while first conductor group 210 may have an effective size with any suitable AWG, such as number 18 AWG.

Second conductor group 220 (e.g., the collection of conductors 222) may be of any suitable shape (e.g., as may be defined by the geometry of a second interior region 221 within an interior surface of second insulation 240), such as "D-shaped" or semi-circular or less than semi-circular (e.g., a circular segment (e.g., a shape with an arc less than half the circumference of a circle)) or the like in cross-section and, as shown in FIG. 2, may include a chord with a chord length DC2 extending between end points of an arc with an arc height DH2. For example, in some embodiments, chord length DC2 of second conductor group 220 may be about 1.92 millimeters and/or arc height DH2 of second conductor group 220 may be about 0.80 millimeters. Moreover, in some embodiments, as shown in FIGS. 2 and 3, amidst the one or more conductors 222 of second conductor group 220 (e.g., within the space that may be defined by an interior surface of second insulation 240), cable subassembly 200 may include at least one second support member 222*s* (e.g., proximate central axis A2 of second conductor group 220) that may be provided to extend along at least a portion of the length of cable subassembly 200 for providing structural reinforcement or filler material, where each second support member may be composed of any suitable material, such as a para-aramid synthetic fiber (e.g., 1500 Denier Kevlar™ fiber). While second conductor group 220 may extend along second conductor group axis A2 (e.g., parallel to central longitudinal axis A of cable subassembly 200), one, some, or all conductors 222 of second conductor group 220 may be twisted in a lay direction about a twist axis of second conductor group 220 (e.g., second conductor group axis A2 or any other axis that may extend through second conductor group 220) along at least a portion of the length of second conductor group 220 (e.g., in a first lay direction of arrow LD1 about the twist axis of second conductor group 220 or in a second lay direction of arrow LD2 about the twist axis of second conductor group 220). Regardless of the lay direction in which conductor(s) 222 of second conductor group 220 may be twisted about the twist axis of second conductor group 220, the lay length of each twisted conductor (i.e., the distance required for a single conductor 222 to be turned 360° about the twist axis of second conductor group 220) may be any suitable length, such as in a range between 15 millimeters and 25 millimeters, or a maximum length of 20 millimeters. While FIGS. 2 and 3 may show interior region 221 of second conductor group 220 to be shaped similarly to interior region 211 of first conductor group 210 and while FIGS. 2 and 3 may show each conductor 212 to be shaped similarly to each conductor 222, it is to be understood that first conductor group 210 and second conductor group 220 may each be shaped differently and may each include different numbers of conductors of different sizes and/or shapes.

Insulation subassembly 250 may include first insulation 230, which may be disposed about and along at least a portion of first conductor group 210, and/or second insulation 240, which may be disposed about and along at least a portion of second conductor group 220, such that insulation subassembly 250 may be operative to electrically isolate or insulate first conductor group 210 from second conductor group 220 along at least a portion of the length of cable subassembly 200. Insulation 230 and/or insulation 240 may be any suitable insulating material or materials of any suitable structure that may be formed by any suitable technique or techniques. For example, one or each of insulation 230 and insulation 240 may be any suitable polymeric tape that may include a polymeric sheet that may optionally include an adhesive portion on one or both surfaces. Such a polymeric sheet may be constructed from any suitable plastic, such as polyethylene terephthalate (e.g., PET, such as Mylar™), Kapton™ tape, and the like. Such a sheet may be wrapped around a particular conductor group or both conductor groups in any suitable manner and may be wrapped in any suitable lay direction with respect to any suitable axis (e.g., axis A, A1D, A2D, etc.). Alternatively or additionally, one or each of insulation 230 and insulation 240 may be extruded about a particular conductor group or both conductor groups in any suitable manner. One or each of insulation 230 and insulation 240 may be any suitable material or combination of materials, including, but not limited to, plastics, rubbers, fluoropolymers, which may be foamed. The geometry of insulation 230 and insulation 240 may be formed as a single component or as two or more distinct components.

Insulation subassembly 250 may have any suitable geometry for providing appropriate insulation based on the materials of cable subassembly 200 and/or the intended use of cable subassembly 200. In some embodiments, as shown, first insulation 230 may have a thickness IT1, which may be any suitable thickness, such as a thickness in a range between 0.33 millimeters and 0.43 millimeters, or an average thickness of about 0.38 millimeters. The magnitude of thickness IT1 may be substantially consistent about the entirety of first interior region 211 (e.g., in a cross-section, such as in the cross-section of FIG. 2 and/or in the cross-section of FIG. 3), for example, such that the minimum magnitude of thickness IT1 may be 0.33 millimeters and/or such that the minimum average magnitude of thickness IT about first interior region 211 may be 0.38 millimeters. Additionally or alternatively, as shown, second insulation 240 may have a thickness IT2, which may be any suitable thickness, such as a thickness in a range between 0.33 millimeters and 0.43 millimeters, or an average thickness of about 0.38 millimeters. The magnitude of thickness IT2 may be substantially consistent about the entirety of second interior region 221 (e.g., in a cross-section, such as in the cross-section of FIG. 2 and/or in the cross-section of FIG. 3), for example, such that the minimum magnitude of thickness IT2 may be 0.33 millimeters and/or such that the minimum average magnitude of thickness IT2 about second interior region 221 may be 0.38 millimeters. Therefore, in some embodiments, a particular portion of insulation subassembly 250 may provide a thickness IT3 between first interior region 211 and second interior region 221 (e.g., between first conductor group 210 and second conductor group 220) for electrically isolating or insulating conductor(s) 212 from conductor(s) 222, where thickness IT3 may be any suitable thickness, such as a thickness in a range between 0.66 millimeters and 0.86 millimeters, or an average thickness of about 0.76 millimeters. The magnitude of thickness IT3 may be substantially consistent along the entirety of the space between the chord of first interior region 211 and the chord of second interior region 221 (e.g., in a cross-section, such as in the cross-section of FIG. 2 and/or in the cross-section of FIG. 3), for example, such that the minimum magnitude of thickness IT3 may be 0.66 millimeters and/or such that the minimum average magnitude of thickness IT3 may be 0.76 millimeters.

While first conductor group 210 and second conductor group 220 may, respectively, extend along first conductor group axis A1 and second conductor group axis A2 (e.g., parallel to central longitudinal axis A of cable subassembly 200), each of which may include conductors that are twisted about a twist axis of the particular conductor group, first conductor group 210 and second conductor group 220 may together be twisted (e.g., along with insulation subassembly 250) in a first lay direction about central longitudinal axis A or any other suitable twist axis of subassembly 200 along the length of at least a portion of cable subassembly 200. For example, as shown in the differences between FIG. 2 and FIG. 3, first conductor group 210 and second conductor group 220 may be twisted in a lay direction about central longitudinal axis A along at least a portion of the length of cable subassembly 200 (e.g., in a first lay direction of arrow LD1 about the twist axis of subassembly 200 or in a second lay direction of arrow LD2 about the twist axis of subassembly 200). Regardless of the lay direction in which each one of first conductor group 210 and second conductor group 220 may be twisted about axis A or any other suitable twist axis of subassembly 200, the lay length of one, some, or all conductors of first conductor group 210 and/or of second conductor group 220 (i.e., the distance required for a single conductor to be turned 360° about the twist axis of subassembly 200) may be any suitable length, such as in a range between 30 millimeters and 40 millimeters, or a maximum length of 35 millimeters. With respect to FIG. 2, for example, regardless of whether the lay direction in which first conductor group 210 and second conductor group 220 may together be twisted about axis A or any other suitable twist axis of subassembly 200 is the direction of arrow LD1 or LD2, the lay direction in which conductors 212 of group 210 may be twisted about a twist axis of group 210 may be either the direction of arrow LD1 or LD2, and the lay direction in which conductors 222 of group 220 may be twisted about a twist axis of group 220 may be either the direction of arrow LD1 or LD2. In some embodiments, as shown, first conductor group 210 and second conductor group 220 may extend parallel to one another and along longitudinal axis A (e.g., center axis A1 of first conductor group 210 and center axis A2 of second conductor group 220 may always be separated from one another by a distance (e.g., the sum of distances A1D and A2D), which may be substantially the same along at least a portion of the length of subassembly 200). Therefore, a central axis of each one of first conductor group 210 and second conductor group 220 may be removed from longitudinal axis A of cable subassembly 200 at any cross-section along the length of cable subassembly 200 (e.g., as shown in FIG. 2 and FIG. 3). For example, the distance between central axis A1 and longitudinal axis A in the cross-section of FIG. 2 may be the same or substantially the same as the distance between central axis A1 and longitudinal axis A in the cross-section of FIG. 3, where in each cross-section, central axis A1 of first conductor group 210 may extend through the centroid or geometric center of first conductor group 210 in that cross-section, and where central longitudinal axis A of cable subassembly 200 may extend through the centroid or geometric center of cable subassembly 200 in that cross-section. Additionally or alternatively, the distance between central axis A2 and longitudinal axis A in the cross-section of FIG. 2 may be the same or substantially the same as the distance between central axis A2 and longitudinal axis A in the cross-section of FIG. 3, where in each cross-section, central axis A2 of second conductor group 220 may extend through the centroid or geometric center of second conductor group 220 in that cross-section, and where central longitudinal axis A of cable subassembly 200 may extend through the centroid or geometric center of cable subassembly 200 in that cross-section. Additionally or alternatively, the distance between central axis A1 and central axis A2 in the cross-section of FIG. 2 may be the same or substantially the same as the distance between central axis A1 and central axis A2 in the cross-section of FIG. 3, where in each cross-section, central axis A1 of first conductor group 210 may extend through the centroid or geometric center of first conductor group 210 in that cross-section, and where in each cross-section, central axis A2 of second conductor group 220 may extend through the centroid or geometric center of second conductor group 220 in that cross-section. In some embodiments, the distance between longitudinal axis A and central axis A1 may be the same or substantially the same as the distance between longitudinal axis A and central axis A2, either in one cross-section, some cross-sections, or all cross-sections.

Cable subassembly 200 may be assembled using any suitable procedure(s). In some embodiments, any suitable number of conductors 212 may be twisted in a particular lay direction (e.g., about the twist axis of first conductor group 210) to form a twisted collection of conductors that may be in any suitable geometry (e.g., a circular cross-sectional geometry). Then that collection of conductors 212 may be formed into a desired shape (e.g., a D-shape) by putting at least a portion of that twisted collection of conductors 212 through a die or roller(s) of the shape (e.g., in any suitable extrusion process). Then, that shaped and twisted collection may be provided as group 210 and may have insulation 230 provided about that group 210. A similar process may be done to provide insulation 240 about group 220. Then, each one of insulated group 210 and insulated group 220 may be put through a respective aligning die (e.g., such that an arc of each shaped and twisted collection of conductors defines a particular part of a circumference of a circle (e.g., a circle CR of FIG. 3 (e.g., a circle with a center that may be a point along the twist axis of subassembly 200))) and then they may be twisted together about any suitable twist axis of subassembly 200, such as longitudinal axis A or any other suitable axis that may extend through a space within which the aligning dies are twisted, where adhesive may or may not be provided between insulated group 210 and insulated group 220 prior, during, or after the twisting of the insulated groups. Jacket 260 may then be provided to fix the twisted relationship of insulated group 210 and insulated group 220.

Jacket 260 may be disposed around insulation subassembly 250 along a length of cable subassembly 200. Jacket 260 may be any suitable insulating and/or conductive material that may be provided (e.g., extruded) about insulation subassembly 250 for protecting the internal structure of cable subassembly 200 from environmental threats (e.g., impact damage, debris, heat, fluids, and/or the like). For example, jacket 260 may be a thermoplastic copolyester ("TPC") (e.g., Arnitel™ XG5857) that can be extruded around the outer periphery of insulation subassembly 250. Jacket 260 may be provided around the outer periphery of insulation subassembly 250 with any suitable thickness JT and may provide an overall jacket diameter (or any other suitable cross-sectional width) JW. For example, in some embodiments, thickness JT of jacket 260 may have any suitable magnitude, such as a thickness in a range between 0.61 millimeters and 0.91 millimeters, or an average thickness of about 0.76 millimeters. The magnitude of thickness JT may be substantially consistent about the entirety of insulation subassembly 250 (e.g., in a cross-section, such as in the cross-section of FIG. 2 and/or in the cross-section of FIG. 3), for example, such that the minimum magnitude of thickness JT may be 0.61 millimeters and/or such that the minimum average magnitude of thickness JT about insulation subassembly 250 may be 0.76 millimeters. Additionally or alternatively, maximum cross-sectional width JW of jacket 260 may have any suitable magnitude, such as a width in a range between 4.75 millimeters and 4.95 millimeters, or about 4.85 millimeters. Jacket 260 may be operative to provide the outermost layer for at least a portion of cable subassembly 200 and may include any suitable surface finish (e.g., SPI Finish-D2).

Alternatively, in some embodiments, a cover 270 may be disposed around jacket 260 along a length of cable subassembly 200, such that cover 270 may be operative to provide the outer most layer for at least a portion of cable subassembly 200. Cover 270 may be any suitable insulating and/or conductive material that may be provided (e.g., braided) about jacket 260 for protecting the internal structure of cable subassembly 200 from environmental threats (e.g., impact damage, debris, heat, fluids, and/or the like). For example, cover 270 may be a nylon and/or polyester that may be braided about the outer periphery of jacket 260. Cover 270 may be provided around the outer periphery of jacket 260 with any suitable thickness CT and may provide an overall cover diameter (or any other suitable cross-sectional width) CW. For example, in some embodiments, thickness CT of cover 270 may have any suitable magnitude, such as a thickness in a range between 0.72 millimeters and 0.92 millimeters, or an average thickness of about 0.82 millimeters. The magnitude of thickness CT may be substantially consistent about the entirety of jacket 260 (e.g., in a cross-section, such as in the cross-section of FIG. 2 and/or in the cross-section of FIG. 3), for example, such that the average magnitude of thickness CT about jacket 260 may be 0.82 millimeters. Additionally or alternatively, maximum cross-sectional width CW of cover 270 may have any suitable magnitude, such as a width in a range between 6.3 millimeters and 6.7 millimeters, or about 6.5 millimeters.

Insulation subassembly 250 may at least partially define and retain the cross-sectional shape of each one of first conductor group 210 and second conductor group 220 as similar shapes, complimentary shapes, or different shapes. In some embodiments, as shown in FIGS. 2 and 3, for example, first interior region 211 of first insulation 230 about first conductor group 210 may have a cross-sectional area with a first D-shape (e.g., an outer periphery of first conductor group 210 in the cross-section of FIG. 3 may define a shape of a first circular segment that may be defined by a chord C1 extending between points P1 and P2 of an arc R1 also extending between points P1 and P2), while second interior region 221 of second insulation 240 about second conductor group 220 may have a cross-sectional area with a second D-shape (e.g., an outer periphery of first conductor group 210 in the cross-section of FIG. 3 may define a shape of a second circular segment that may be defined by a chord C2 extending between points P3 and P4 of an arc R2 also extending between points P3 and P4). The shape of first interior region 211 about first conductor group 210 may be defined by at least a first portion of a surface of insulation subassembly 250 (e.g., insulation 230), whereas the shape of first interior region 221 about second conductor group 220 may be defined by at least a second portion of a surface of insulation subassembly 250 (e.g., insulation 240). In some embodiments, as shown, insulation subassembly 250 may be configured to position first interior region 211 with respect to second interior region 221 such that significant portions of the cross-sectional shapes of interior regions 211 and 221 may combine to form a significant portion of a circular shape, thereby reducing the cross-sectional area inhabited by interior regions 211 and 221. For example, as shown in FIG. 3, each one of arc R1 of interior region 211 and arc R2 of interior region 221 may define a particular portion of a circumference of a circle CR (e.g., the entirety or substantially the entirety of arc R1 may define a portion of a circle's circumference that may also be partially defined by the entirety or substantially the entirety of arc R2). This may allow insulation subassembly 250 to have a circular cross-section with a reduced cross-sectional diameter IW while also packing as many conductors (e.g., conductors 212 and 222) as possible within the interior of insulation subassembly 250 (e.g., as compared to a cable subassembly in which each one of interior regions 211 and 221 may be circular yet also separated by a particular distance IT3, which results in a larger cross-sectional diameter IW). Various other shapes and geometries may be provided to enable such reduction in the overall size of cable subassembly 200. For example, rather than being defined by an arc and an associated chord, each interior region may be defined by a curve similar to an arc but, rather than also being defined by a straight chord extending between the end points of that curve, each interior region may also be defined by a non-straight portion extending between the end points of that curve. For example, rather than each being straight, one or both of chords C1 and C2 may be non-linear (e.g., any other suitable geometry), for example, such that the combined cross-sectional shape of interior regions 211 and 221 may resemble the tajitsu symbol (e.g., the yin and yang symbol).

Therefore, cable subassembly 200 may be configured to provide a cable that may be safely used with cable assembly 100 as an AC power cordset that may have any suitable electrical rating, such as an electrical rating of 10 amperes (A), 125 volts alternating current (VAC). In some embodiments, such a cable subassembly 200 may be operative to meet the requirements of UL Standard 62 (e.g., each one of IT1 and IT2 may include about 0.33 millimeter minimum thickness and 0.38 millimeter minimum average thickness with a 35 millimeter lay length max (right), JT may include about 0.61 millimeter minimum thickness and 0.76 millimeter minimum average thickness, group 210 may include about 41 conductors 212 with diameter d1 of about 0.16 millimeters and 20 millimeter lay length max (right) and filler 212*s* of about 1500D aramid fiber, and/or group 220 may include about 41 conductors 222 with diameter d2 of about 0.16 millimeters and 20 millimeter lay length max (right) and filler 222*s* of about 1500D aramid fiber, which may enable a JW of about 4.85 millimeters+/−0.10 millimeters). Additionally or alternatively, in some embodiments, such a cable subassembly 200 may be operative to meet the requirements of any other suitable standard. For example, cable subassembly 200 may be operative to meet the requirements of EN50525/IEC62821 (e.g., each one of IT1 and IT2 may include about 0.35 millimeter minimum thickness and 0.50 millimeter minimum average thickness with a 70 millimeter lay length max (right), JT may include about 0.41 millimeter minimum thickness and 0.60 or 0.65 millimeter minimum average thickness, group 210 may include about 67 conductors 212 with diameter d1 of about 0.12 millimeters and 20 millimeter+/−5 millimeter lay length max (right) and filler 212*s* of about 1000D aramid fiber, and/or group 220 may include about 67 conductors 222 with diameter d2 of about 0.12 millimeters and 20 millimeter+/−5 millimeter lay length max (right) and filler 222*s* of about 1000D aramid fiber, which may enable a JW of about 4.91 millimeters+/−0.10 millimeters). As another example, cable subassembly 200 may be operative to meet the requirements of JCS 4509 (e.g., each one of IT1 and IT2 may include about 0.48 millimeter minimum thickness and 0.54 millimeter minimum average thickness with a 46 millimeter lay length max (right), JT may include about 0.70 millimeter minimum thickness and 0.90 millimeter minimum average thickness, group 210 may include about 67 conductors 212 with diameter d1 of about 0.12 millimeters and 20 millimeter lay length max (right) and filler 212*s* of about 200D or 1000D aramid fiber, and/or group 220 may include about 67 conductors 222 with diameter d2 of about 0.12 millimeters and 20 millimeter lay length max (right) and filler 222*s* of about 200D or 1000D aramid fiber, which may enable a JW of about 5.32 millimeters+/−0.10 millimeters). As another example, cable subassembly 200 may be operative to meet the requirements of IS 694 (e.g., each one of IT1 and IT2 may include about 0.44 millimeter minimum thickness and 0.60 millimeter minimum average thickness with a 70 millimeter lay length max (right), JT may include about 0.52 millimeter minimum thickness and 0.90 millimeter minimum average thickness, group 210 may include about 24 conductors 212 with diameter d1 of about 0.20 millimeters and 20 millimeter lay length max (right) and filler 212*s* of about 200D or 1000D aramid fiber, and/or group 220 may include about 24 conductors 222 with diameter d2 of about 0.20 millimeters and 20 millimeter lay length max (right) and filler 222*s* of about 200D or 1000D aramid fiber, which may enable a JW of about 5.82 millimeters+/−0.10 millimeters).

Figure 4:
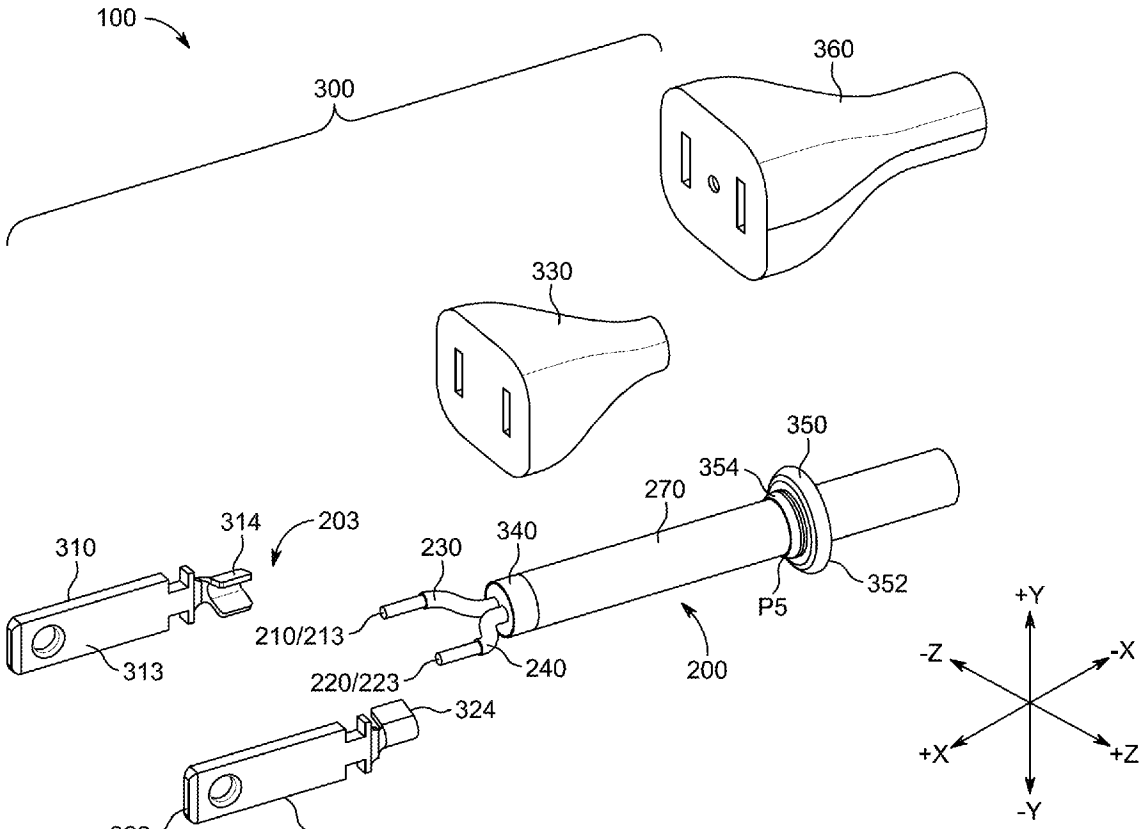
FIG. 4 is an exploded perspective view of a portion of the cable assembly of FIGS. 1-3 including a first cable connector subassembly.
Figure 5:
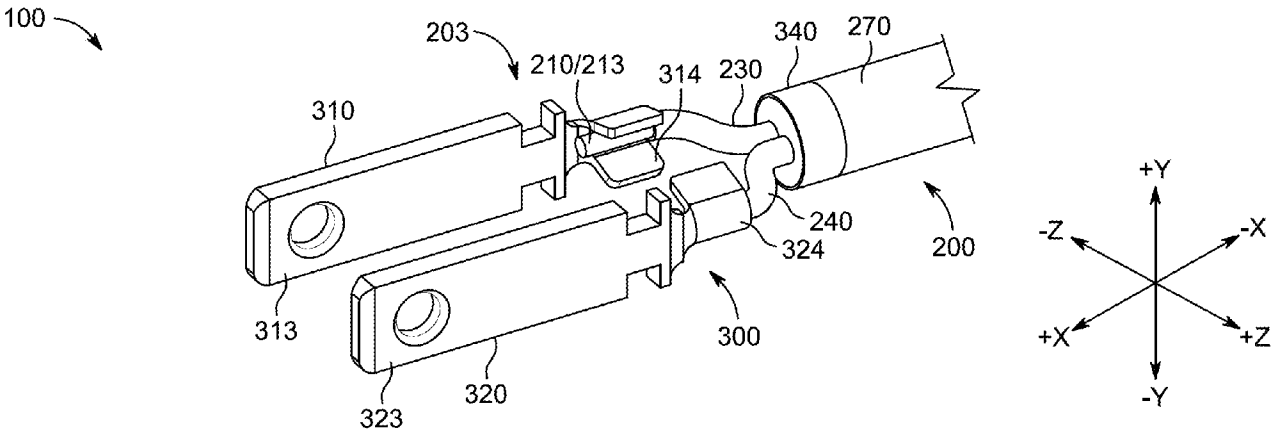
FIG. 5 is a perspective view of the portion of the cable assembly of FIG. 4 in a first stage of assembly.

As shown in FIGS. 4-11, first cable connector subassembly 300 may include at least two contacts, such as contact 310 and contact 320. Contact 310 may be electrically coupled to first conductor group 210 of subassembly 200 (e.g., to one, some, or each conductor 212 of first conductor group 210) and may be operative to be electrically coupled to a remote subsystem (e.g., subsystem 500), while contact 320 may be electrically coupled to second conductor group 220 of subassembly 200 (e.g., to one, some, or each conductor 222 of second conductor group 220) and may be operative to be electrically coupled to the remote subsystem (e.g., subsystem 500). In other embodiments, it is to be understood that first cable connector subassembly 300 may include at least three contacts, each of which may be electrically coupled to a respective one of conductor groups 210', 220', and 280' of subassembly 200'. Contact 310 may include a blade portion 313 and a coupling or receiving portion 314. Receiving portion 314 may be operative to interact with a cable conductor. For example, receiving portion 314 may be operative to receive a portion of first conductor group 210 at or near first end 213 proximate first cable end 203 (e.g., a portion of at least one conductor 212 or the entirety of first conductor group 210 adjacent first end 213 that may be exposed and not surrounded by insulation subassembly 250) and then receiving portion 314 may be mechanically deformed or compressed (e.g., crimped) about that received conductor portion for electrically coupling contact 310 to first conductor group 210 (e.g., as shown in FIG. 5). Blade portion 313 may be operative to interact with a remote subsystem (e.g., blade portion 313 may be operative to be received and at least partially held by respective female-type contact 510 of first device subsystem 500) for electrically coupling blade portion 313 with the remote subsystem and, thus, for electrically coupling the remote subsystem with first conductor group 210 via contact 310. Similarly, contact 320 may include a coupling or receiving portion 324 for receiving and being electrically coupled to at least a portion of second conductor group 220 (e.g., through crimping) as well as a blade portion 323 that may be operative to interact with a remote subsystem (e.g., blade portion 323 may be operative to be received and at least partially held by respective female-type contact 520 of first device subsystem 500) for electrically coupling blade portion 323 with the remote subsystem and, thus, for electrically coupling the remote subsystem with second conductor group 220 via contact 320. Each one of contacts 310 and 320 may be made of any suitable conductive material or combination of conductive materials for enabling communication of electrical signals between first device subsystem 500 and at least one conductor of cable subassembly 200.

Figure 6:
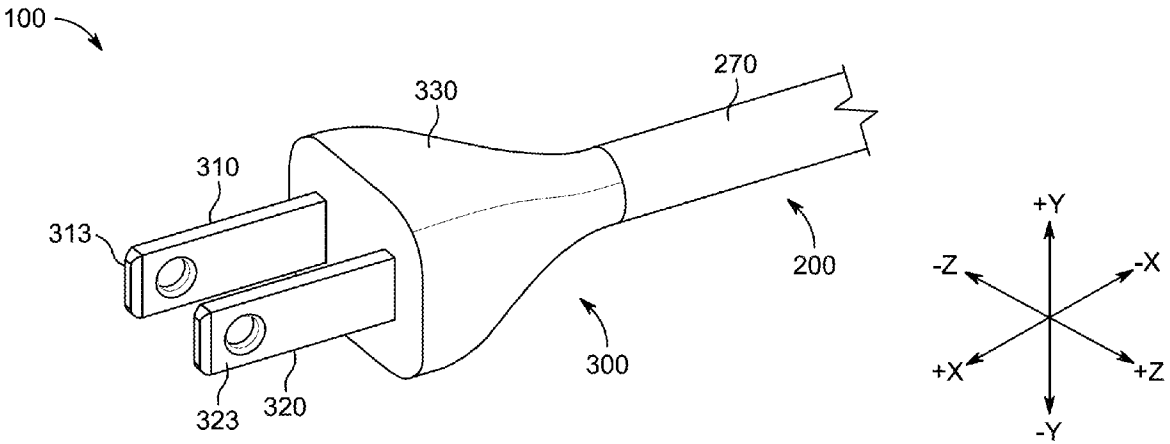
FIG. 6 is a perspective view of the portion of the cable assembly of FIGS. 4 and 5 in a second stage of assembly.

Once contact 310 has been electrically coupled (e.g., crimped) to first conductor group 210 and once contact 320 has been electrically coupled (e.g., crimped) to second conductor group 220, a body component 330 of first cable connector subassembly 300 may be provided for additional structure. For example, as shown in FIG. 6, body component 330 may be provided to encompass a portion of contact 310 (e.g., receiving portion 314), a portion of contact 320 (e.g., receiving portion 324), and a portion of cable subassembly 200 (e.g., any portion of first conductor group 210 and/or second conductor group 220 and/or insulation subassembly 250 that may not be surrounded by jacket 260 and/or cover 270 at first cable end 203). Such provisioning of body component 330 may be operative to protect and/or reinforce the electrical and mechanical coupling of contact 310 and first conductor group 210 (e.g., at receiving portion 314) and to protect and/or reinforce the electrical and mechanical coupling of contact 320 and second conductor group 220 (e.g., at receiving portion 324), while still enabling blade portions 313 and 323 to be exposed for potential interaction with a remote subsystem. As shown in FIG. 5, tape 340 or any other suitable component may be provided about a portion of cable subassembly 200, such as around an end of cover 270 (e.g., to hold any loose ends of a braided cover tightly against cable subassembly 200). Moreover, as shown in FIG. 6, whether or not such tape 340 may be provided about such an end of cover 270, a portion of body component 330 may be operative to cover a portion of cable subassembly 200 that may include an end of insulation 230 and/or an end of insulation 240 and/or an end of jacket 260 and/or an end of cover 270. Such provisioning of body component 330 about one or more portions of cable subassembly 200 (e.g., an end portion of first conductor group 210 and/or of second conductor group 220 and/or of insulation subassembly 250 and/or of cover 270 and/or of jacket 260 at first cable end 203) may be operative to protect and/or further insulate conductors 212 and 222 of cable subassembly 200.

Additional insulation of cable subassembly 200 that may be provided by body component 330 may enable one or more portions of cable subassembly 200 to have a different geometry at its portion protected by body component 330 than at another portion that is not protected by body component 330. For example, while each one of first conductor group 210 and second conductor group 220 may be configured to have a D-shaped cross-section along a majority of the length of cable subassembly 200 (e.g., as shown in FIGS. 2 and 3), the cross-sectional shape of each one of first conductor group 210 and the cross-sectional shape of second conductor group 220 may transition from such a D-shape to a circular shape (e.g., as shown in FIGS. 4 and 5) near first cable end 203 that may be covered by a portion of cable connector subassembly 300 (e.g., by body component 330). This transition in geometry of each conductor group to a circular cross-sectional shape may be enabled while maintaining a substantially constant outer width CW of cable subassembly 200 by varying (e.g., reducing) the thickness of insulation subassembly 250 about the conductor groups (e.g., reducing at least a portion of the cross-sectional thickness of thickness IT1 and/or thickness IT2), where any loss of outer insulation provided by such variation in insulation subassembly 250 may be made up for by insulation that may be provided by cable connector subassembly 300 (e.g., by body component 330). Such a circular cross-sectional shape of first conductor group 210 and/or of second conductor group 220 at first cable end 203 may be operative to enable a more robust and/or easier coupling with a receiving portion 314/324 of a respective contact 310/320. Alternatively, the cross-sectional shape of first conductor group 210 and/or second conductor group 220 may be the same at first cable end 203 as it is at another portion of cable subassembly 200 (e.g., D-shaped, as shown in FIGS. 2 and 3).

Figure 8:
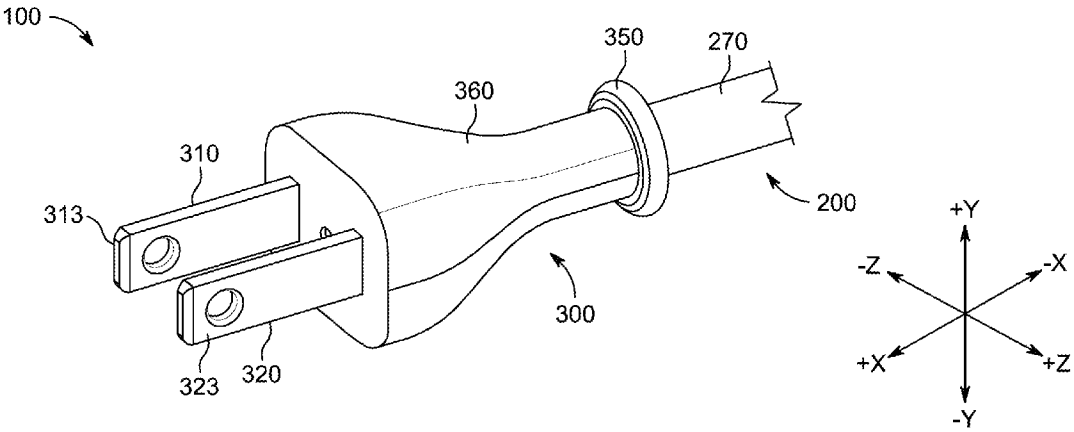
FIG. 8 is a perspective view of the portion of the cable assembly of FIGS. 4-7 in a fourth stage of assembly.
Figure 9:
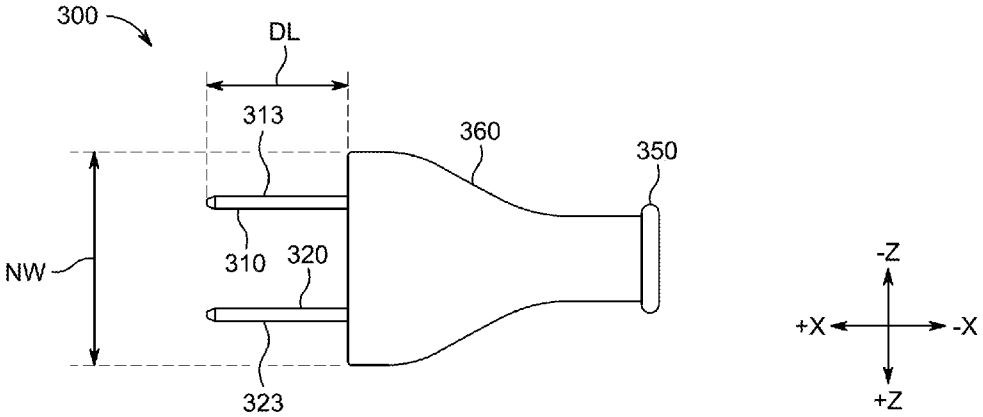
FIG. 9 is a top view of the portion of the cable assembly of FIGS. 4-8 in the fourth stage of assembly.

In some embodiments, as shown in FIG. 8, once body component 330 has been provided, an outer component 360 of first cable connector subassembly 300 may be provided for additional structure. For example, as shown, outer component 360 may be operative to surround the entirety of body component 330 but not blade portions 313 and 323, such that blade portions 313 and 323 may remain exposed for potential interaction with a remote subsystem (e.g., with contacts 510 and 520 of subsystem 500). For example, as shown in FIG. 9, each one of blade portions 313 and 323 may extend (e.g., in the +X-direction) a length DL from an end of connector subassembly 300, where length DL may have any suitable magnitude, such as in a range between 16.50 millimeters and 17.50 millimeters or may be about 17.00 millimeters. A maximum external cross-sectional width NW of connector subassembly 300 at its end from which blade portions 313 and 323 extend may be any suitable magnitude, such as in a range between 24.77 millimeters and 25.27 millimeters or may be about 25.02 millimeters. Additionally or alternatively, the length NL of connector subassembly 300 from the tips of blade portions 313 and 323 to the end of gripping component 350 may be any suitable magnitude, such as in a range between 51.80 millimeters and 53.40 millimeters or may be about 52.60 millimeters. Each one of body component 330 and/or outer component 360 of cable connector subassembly 300 may be formed using any suitable material(s) using any suitable techniques. For example, component 330 may be molded (e.g., injection molded) using any suitable material (e.g., plastic), while component 360 may be molded (e.g., over molded over component 330) using any suitable material (e.g., a thermoplastic polymer (e.g., DSM Arnitel™ XG5858 TPC-ET)). Component 360 may differ from component 330 with respect to any suitable characteristic, such as size, shape, color, flexibility, deformability, tactility, ability to repel certain fluids, and/or the like. Component 360 may be operative to provide the outer most layer of at least a portion of cable connector subassembly 300 and may, therefore, be treated so as to provide any suitable desired aesthetic properties. Additionally or alternatively, component 360 may be operative to define at least a portion of the flexibility of connector subassembly 300 about cable subassembly 200 for at least partially defining a strain relief for cable assembly 100 between connector subassembly 300 and cable subassembly 200.

Figure 7:
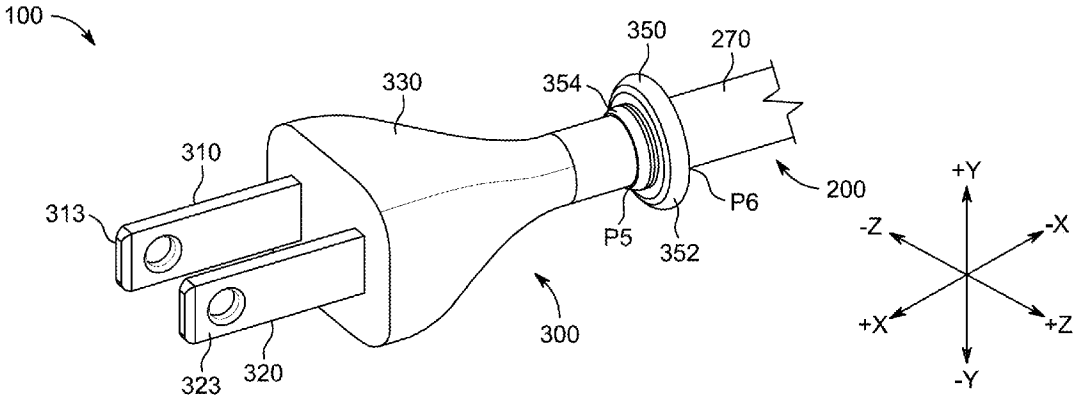
FIG. 7 is a perspective view of the portion of the cable assembly of FIGS. 4-6 in a third stage of assembly.
Figure 11:
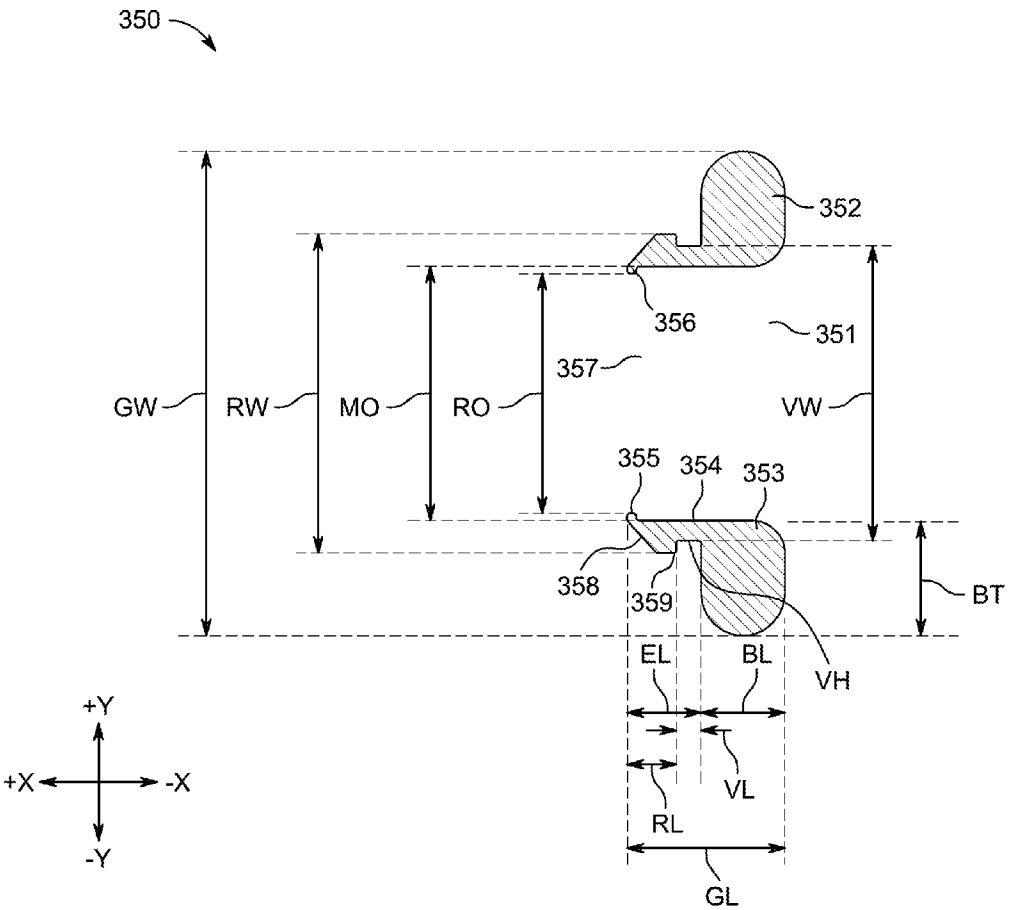
FIG. 11 is a cross-sectional view of a component of the portion of the cable assembly of FIGS. 4-10.

Connector subassembly 300 may also include a gripping component 350 that may be operative to prevent material from seeping onto a particular portion of cable subassembly 200 (e.g., a portion of cover 270) when that material is being used to provide body component 330 and/or outer component 360. For example, as shown in FIG. 7, at any suitable moment during the formation of connector subassembly 300 (e.g., before or after or during the provisioning of body component 330), gripping component 350 may be positioned about a particular portion of cable subassembly 200 along its length, such as at a position P5 along cable subassembly 200 about an outer surface of cable subassembly 200 (e.g., cover 270 or jacket 260 if no cover 270 is provided). As shown in FIG. 11, for example, gripping component 350 may include a base body 352, which may be any suitable shape (e.g., toroidal) with any suitable maximum cross-sectional outer width GW and any suitable length BL and any suitable thickness BT, and which may define a main opening 351 having any suitable maximum cross-sectional width MO that may be operative to surround and contact an outer surface of cable subassembly 200 (e.g., cover 270). For example, cross-sectional width MO may have a magnitude in a range between 6.25 millimeters and 6.35 millimeters or may be about 6.30 millimeters, such that it may be held (e.g., due to an interference fit) about width CW of jacket 260, which may be in a range between 6.3 millimeters and 6.7 millimeters, or about 6.5 millimeters. Therefore, MO may be smaller than CW, but may alternatively be bigger or the same size. Outer width GW may have any suitable magnitude, such as in a range between 11.89 millimeters and 12.09 millimeters or may be about 11.99 millimeters. Length BL may have any suitable magnitude, such as in a range between 1.90 millimeters and 2.10 millimeters or may be about 2.00 millimeters. Thickness BT may have any suitable magnitude, such as in a range between 5.54 millimeters and 5.84 millimeters or may be about 5.69 millimeters.

Figure 10:
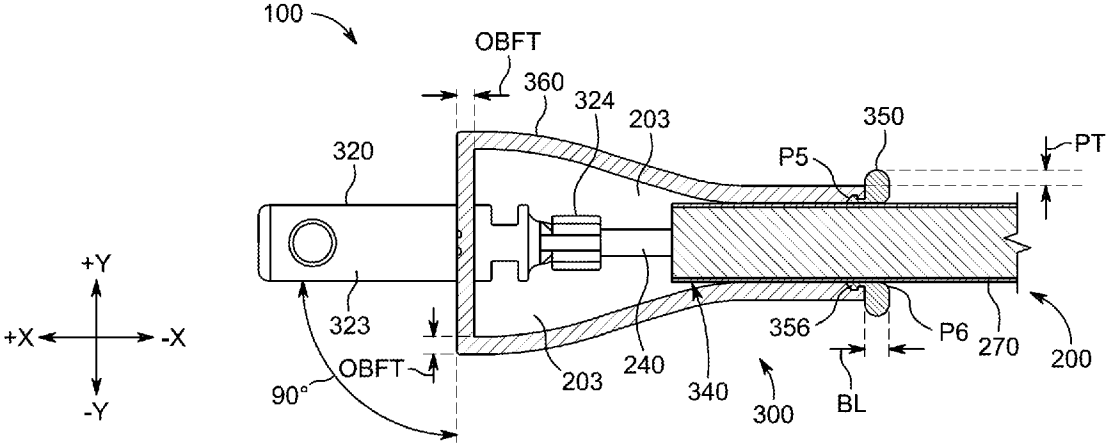
FIG. 10 is a cross-sectional view of the portion of the cable assembly of FIGS. 4-9 in the fourth stage of assembly.

As also shown in FIG. 11, for example, gripping component 350 may include an extension body 354 that may be coupled to base body 352 at one extension end 353 and that may extend away from base body 352 to another extension end 355 (e.g., generally in the +X-direction towards cable end 203 when component 350 is positioned about cable subassembly 200). Extension body 354 may be any suitable shape and may extend any suitable length EL away from base body 352. As shown, a portion (e.g., a majority) of extension body 354 may also define a portion of main opening 351 having maximum cross-sectional width MO similar to that of base body 352. However, as also shown, another portion of extension body 354 (e.g., proximal to and/or at extension end 355 may define a reduced opening 357 having a maximum cross-sectional width RO that may be operative to surround and contact an outer surface of cable subassembly 200 (e.g., cover 270). For example, cross-sectional width RO may have a magnitude in a range of between 5.85 millimeters and 5.95 millimeters or may be about 5.90 millimeters, such that extension body 354 at reduced opening 357 may be even more tightly held (e.g., due to a stronger interference fit) about width CW of jacket 260 than may base body 352 at main opening 351. For example, as shown, one or more gripping fingers 356 provided on an interior surface of extension body 354 may be operative to dig into or otherwise grip an exterior surface of cable subassembly 200 positioned within reduced opening 357 (e.g., as shown in FIG. 10), which may prevent any material (e.g., any material used to form component 330 and/or component 360) from seeping in between gripping component 350 and cable assembly 220 (e.g., in the −X-direction).

Extension body 354 may be shaped to include a ramp portion 358 that may extend from extension end 355 to an extension intermediate point 359 and that may increase the outer cross-sectional width of extension body 354 from the magnitude of width MO at extension end 355 to the magnitude of width RW at intermediate point 359, where that magnitude may gradually increase such that ramp portion 358 may be a gradual or linear ramp or where that magnitude may increase in any other suitable manner (e.g., step-wise). Width RW may have any suitable magnitude, such as in a range between 7.80 millimeters and 8.00 millimeters or may be about 7.90 millimeters. Such a ramp may enable any material (e.g., any material used to form component 330 and/or component 360) that may intend to travel along gripping component 350 (e.g., in the −X-direction) may do so along the exterior surface of that ramp and not under gripping fingers 356 between gripping component 350 and cable subassembly 200. Such a ramp may have any suitable length RL, which may have any suitable magnitude, such as in a range between 0.75 millimeters and 1.75 millimeters or may be about 1.25 millimeters. Additionally or alternatively, as shown, extension body 354 may be shaped to include a valley portion **358*v* that may extend from extension intermediate point 359 to extension end 353 and that may provide a decreased outer cross-sectional width of extension body 354 from the magnitude of width RW at intermediate point 359 to the magnitude of width VW at extension end 353, where width VW may have any suitable magnitude, such as in a range between 7.20 millimeters and 7.40 millimeters or may be about 7.30 millimeters. Such a valley may enable at least some of the material (e.g., any material used to form component 330 and/or component 360) that may travel along ramp portion 358 of gripping component 350 (e.g., in the −X-direction) to eventually reside within valley portion 358*v* between base body 352 and ramp portion 358. Valley portion 358*v* may have any suitable depth VH, which may have any suitable magnitude, such as in a range between 0.40 millimeters and 0.80 millimeters or may be about 0.60 millimeters. Valley portion 358*v* may have any suitable length VL, which may have any suitable magnitude, such as in a range between 0.45 millimeters and 0.85 millimeters or may be about 0.65 millimeters. Gripping component 350** may have any suitable length GL, which may have any suitable magnitude, such as in a range between 3.70 millimeters and 4.10 millimeters or may be about 3.90 millimeters.

In some embodiments, gripping component 350 may be positioned about cable subassembly 200 (e.g., at position P5) prior to providing (e.g., molding) body component 330, such that gripping component 350 may be operative to prevent any material used to form body component 330 and/or any material used to form outer component 360 from seeping beyond gripping component 350 (e.g., in the −X-direction) to a position P6 along cable subassembly 200 (e.g., by seeping between gripping component 350 and cable subassembly 200 and/or by flowing up and over base body 352 (e.g., in the +Y-direction or the −Y-direction)), where outer component 360 may or may not be thereafter provided or where components 330 and 360 may instead be a single component formed in a single provisioning step. In other embodiments, FIG. 10 may show outer component 360 as may be formed over body component 330 but body component 330 may not be shown in FIG. 10 for sake of clarity. In some such embodiments, some material used to form body component 360 may finally reside (e.g., solidify) in the valley defined by ramp portion 358, valley portion **358*v*, and base body 352 (e.g., as shown in FIG. 10), but with a thickness PT to spare before threat of such material passing over base body 352, where thickness PT may be any suitable magnitude such as in a range between 1.14 millimeters and 1.54 millimeters or may be about 1.34 millimeters. Outer body 360 may have a thickness OBFT along a front face of any suitable magnitude, such as in a range between 1.4 millimeters and 1.6 millimeters or may be about 1.5 millimeters. However, in other embodiments, gripping component 350 may be positioned about cable subassembly 200 (e.g., at position P5) prior to or after providing (e.g., molding) body component 330, where little to no material of body component 330 may interact with gripping component 350 (see, e.g., FIG. 7), but prior to providing (e.g., molding) outer component 360, such that gripping component 350 may be operative to prevent any material used to form outer component 360 from seeping beyond gripping component 350 (e.g., in the −X-direction) to a position P6 along cable subassembly 200 (e.g., by seeping between gripping component 350 and cable subassembly 200 and/or by flowing up and over base body 352 (e.g., in the +Y-direction or the −Y-direction). In some such embodiments, some material used to form outer component 360 may finally reside (e.g., solidify) in the valley defined by ramp portion 358, valley portion 358*v*, and base body 352 (e.g., as shown in FIG. 8). Gripping component 350 of cable connector subassembly 300 may be formed using any suitable material(s) using any suitable techniques. For example, gripping component 350** may be molded (e.g., injection molded) using any suitable material (e.g., a polycarbonate resin (e.g., Emerge™ PC 8600-10)).

Therefore, cable connector subassembly 300 may provide a cleanly defined subassembly for electrically coupling contacts 310 and 320 to respective conductor groups 210 and 220 while preventing any portion of subassembly 300 from extending beyond a certain point along cable subassembly 200 (e.g., beyond position P6).

Figure 16:
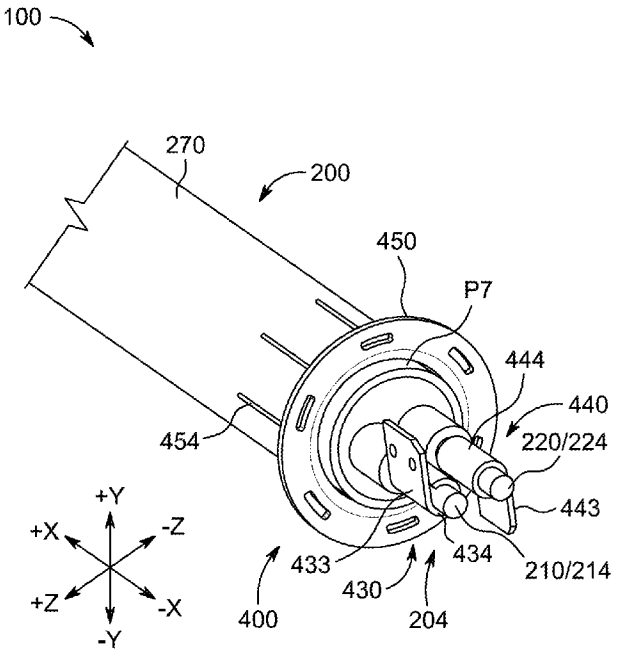
FIG. 16 is a perspective view of the portion of the cable assembly of FIGS. 12-15 in a fourth stage of assembly.
Figure 18:
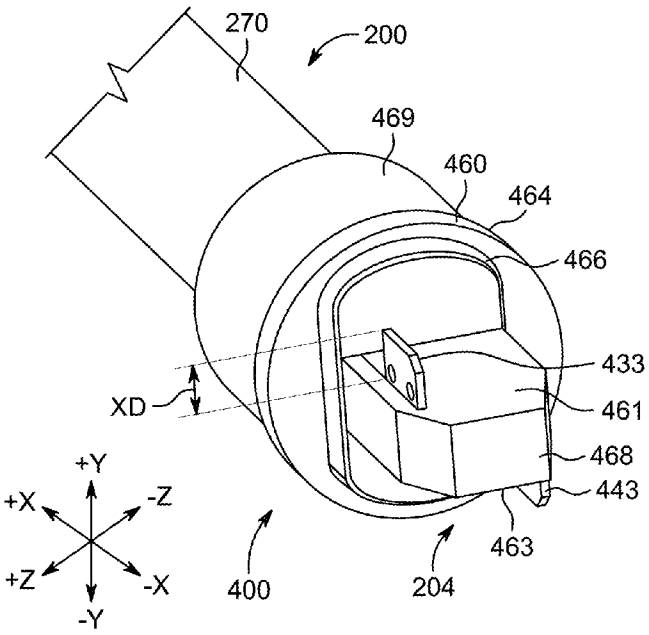
FIG. 18 is a perspective view of the portion of the cable assembly of FIGS. 12-17 in a sixth stage of assembly.
Figure 17:
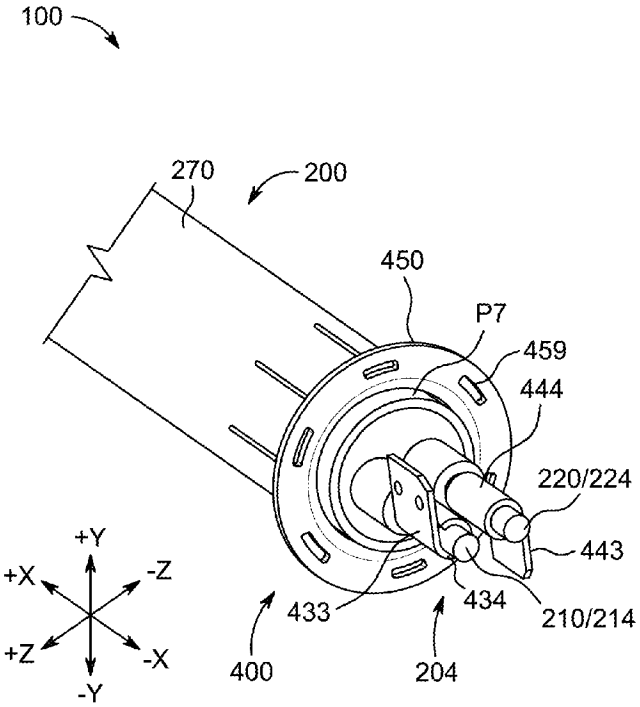
FIG. 17 is a perspective view of the portion of the cable assembly of FIGS. 12-16 in a fifth stage of assembly.
Figure 19:
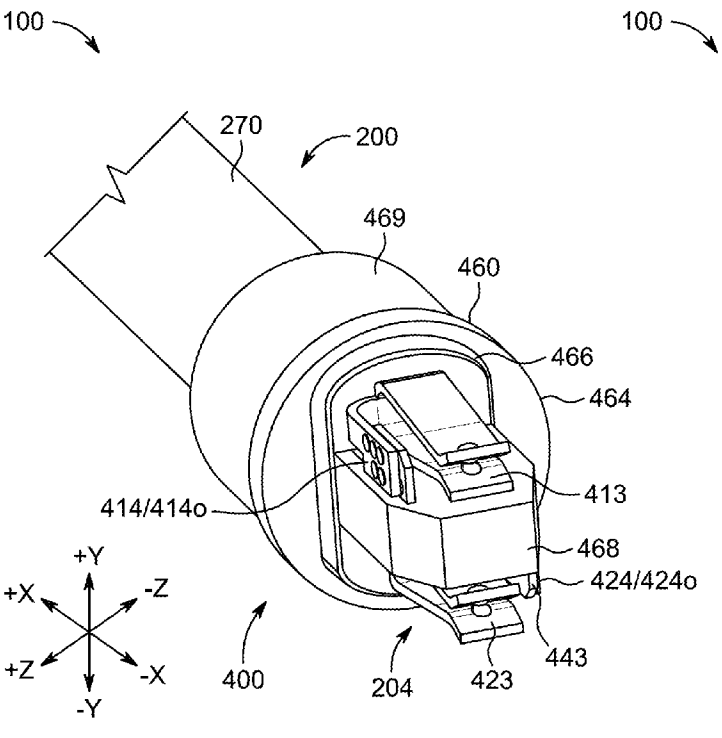
FIG. 19 is a perspective view of the portion of the cable assembly of FIGS. 12-18 in a seventh stage of assembly.

As shown in FIGS. 12-25, second cable connector subassembly 400 may include at least two device contacts, such as device contact 410 and device contact 420, and at least two conductor contacts, such as conductor contact 430 and conductor contact 440. Device contact 410 may be electrically coupled to first conductor group 210 (e.g., to one, some, or each conductor 212 of first conductor group 210 at or adjacent first conductor group second end 214 at second cable end 204) via conductor contact 430 and may be operative to be electrically coupled to a remote subsystem (e.g., subsystem 600), while contact 420 may be electrically coupled to second conductor group 220 (e.g., to one, some, or each conductor 222 of second conductor group 220 at or adjacent second conductor group second end 224 at second cable end 204) via conductor contact 440 and may be operative to be electrically coupled to the remote subsystem (e.g., subsystem 600). In other embodiments, it is to be understood that second cable connector subassembly 400 may include at least three contacts, each of which may be electrically coupled to a respective one of conductor groups 210', 220', and 280' of subassembly 200'. Device contact 410 may include a female receptacle portion 413 (e.g., a device coupling portion) and a device contact extension portion 414, while conductor contact 430 may include a receiving portion 434 and a conductor contact extension portion 433. Receiving portion 434 of conductor contact 430 may be operative to receive and be electrically coupled to at least a portion of first conductor group 210 (e.g., through crimping), as shown by FIGS. 16 and 17, while conductor contact extension portion 433 of conductor contact 430 may be operative to extend (e.g., to a free end) from receiving portion 434 and to be electrically coupled to device contact 410 (e.g., to device contact extension portion 414 (e.g., via laser welding)), as shown by FIG. 19, while female receptacle portion 413 of device contact 410 may be operative to interact with a remote subsystem (e.g., female receptacle portion 413 may be operative to receive and at least partially hold a respective male-type contact 610 of second device subsystem 600) for electrically coupling female receptacle portion 413 with remote subsystem 600 and, thus, for electrically coupling remote subsystem 600 with first conductor group 210 via device contact 410 and conductor contact 430. Similarly, device contact 420 may include a female receptacle portion 423 (e.g., a device coupling portion) and a device contact extension portion 424, while conductor contact 440 may include a receiving portion 444 and a conductor contact extension portion 443. Receiving portion 444 of conductor contact 440 may be operative to receive and be electrically coupled to at least a portion of second conductor group 220 (e.g., through crimping), as shown by FIGS. 16 and 17, while conductor contact extension portion 443 of conductor contact 440 may be operative to extend (e.g., to a free end) from receiving portion 444 and to be electrically coupled to device contact 420 (e.g., to device contact extension portion 424 (e.g., via laser welding)), as shown by FIG. 19, while female receptacle portion 423 of device contact 420 may be operative to interact with a remote subsystem (e.g., female receptacle portion 423 may be operative to receive and at least partially hold a respective male-type contact 620 of second device subsystem 600) for electrically coupling female receptacle portion 423 with remote subsystem 600 and, thus, for electrically coupling remote subsystem 600 with second conductor group 220 via device contact 420 and conductor contact 440. Each one of device contacts 410 and 420 may be made of any suitable conductive material or combination of conductive materials (e.g., phosphor bronze (e.g., C5191-H) with or without nickel plating) for enabling communication of electrical signals between device subsystem 600 and cable connector subassembly 400. Similarly, each one of conductor contacts 430 and 440 may be made of any suitable conductive material or combination of conductive materials (e.g., phosphor bronze (e.g., C5191-H) with or without nickel plating) for enabling communication of electrical signals between at least one conductor of cable subassembly 200 and a respective device contact. As shown, the geometry and size of conductor contact 430 may be the same or substantially the same as conductor contact 440, which may enable contacts 430 and 440 to be used interchangeably during assembly for ease of manufacture. Moreover, as shown, the geometry and size of device contact 410 may be the same or substantially the same as device contact 420, which may enable contacts 410 and 420 to be used interchangeably during assembly for ease of manufacture. It is to be understood that while device coupling portion 413 of device contact 410 and device coupling portion 423 of device contact 420 may be shown as female-type receptacles (e.g., for receiving and/or at least partially holding a respective male-type contact of second device subsystem 600), at least one of device coupling portion 413 of device contact 410 and device coupling portion 423 of device contact 420 may be a male-type contact (e.g., for being received by and/or at least partially held by a respective female-type contact of second device subsystem 600). As shown, device contact 410 and device contact 420 may be identical (e.g., geometrically and/or physically and/or otherwise) such that only a single type of component may be required in order to provide each device contact of subassembly 400. Additionally or alternatively, as shown, conductor contact 430 and conductor contact 440 may be identical (e.g., geometrically and/or physically and/or otherwise) such that only a single type of component may be required in order to provide each conductor contact of subassembly 400.

Figure 15:
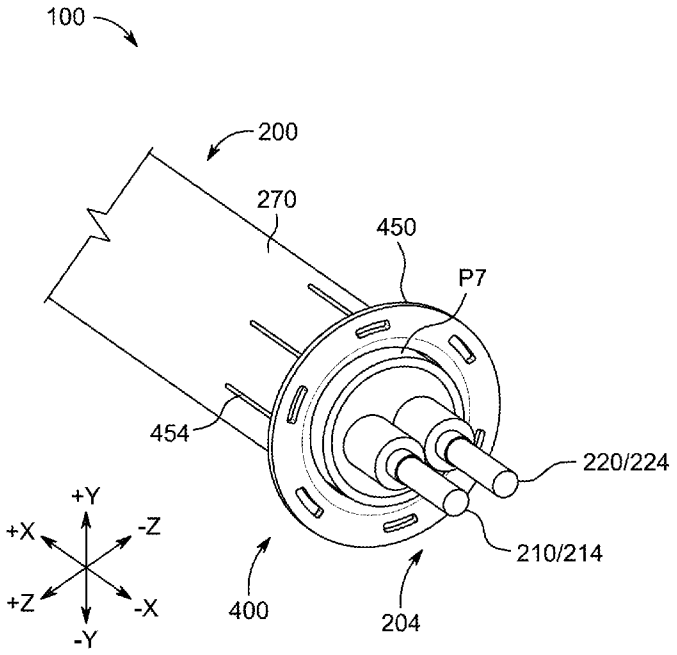
FIG. 15 is a perspective view of the portion of the cable assembly of FIGS. 12-14 in a third stage of assembly.
Figure 21:
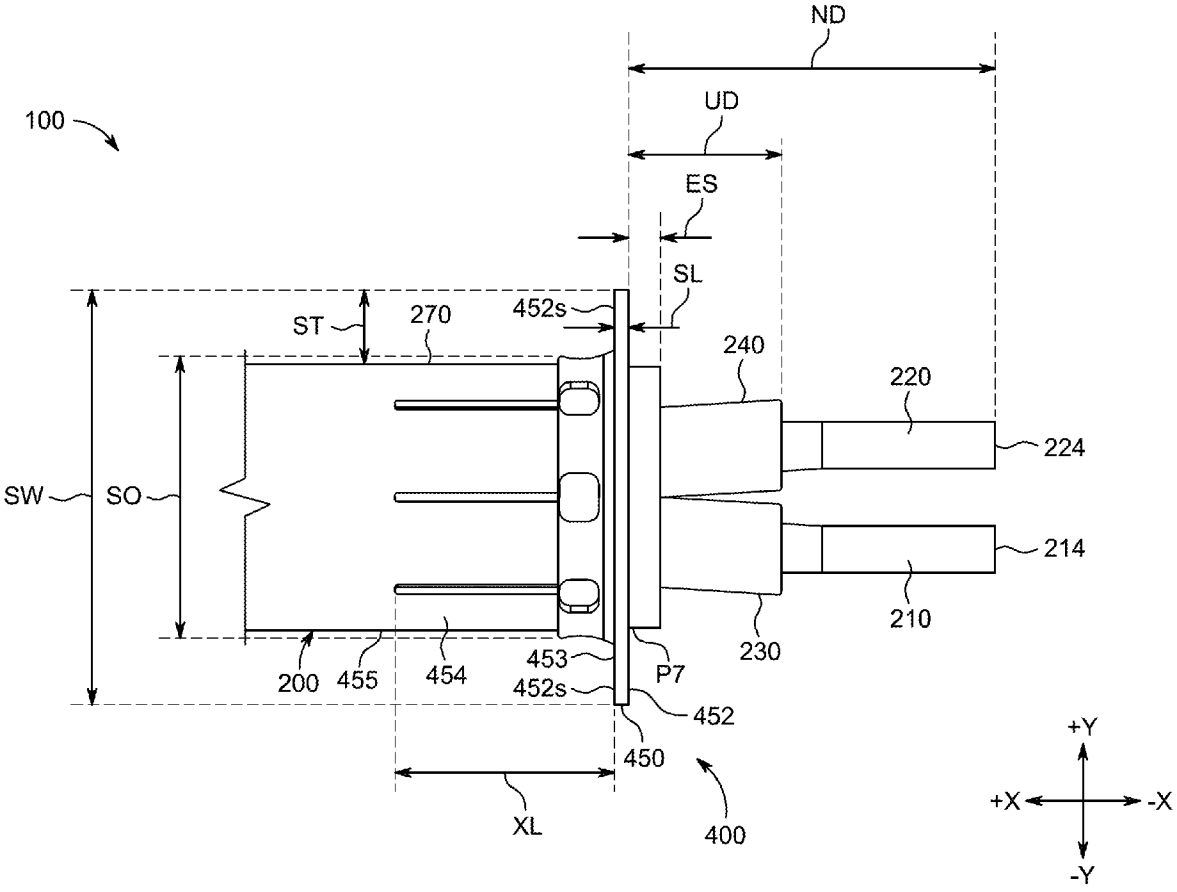
FIG. 21 is a side view of the portion of the cable assembly of FIGS. 12-20 in the fourth stage of assembly.

As shown, second cable connector subassembly 400 may also include a cable support component 450 that may be operative to be secured to cable subassembly 200 about a particular portion of cable subassembly 200 for providing a rigid surface against which a portion of a collet may exert any suitable force for retaining second cable connector subassembly 400 in a particular position with respect to remote subsystem 600 (e.g., retention mechanism 660 of FIGS. 26-30). For example, as shown in FIGS. 14-17, at any suitable moment during the formation of connector subassembly 400 (e.g., before or after or during the coupling of one or both of conductor contacts 430 and 440 to one or both of respective conductor groups 210 and 220, yet before a body component 460 may be provided as a portion of connector subassembly 400), cable support component 450 may be positioned about a particular portion of cable subassembly 200 along its length, such as at a position P7 along cable subassembly 200 about an outer surface of cable subassembly 200 (e.g., cover 270 or jacket 260 if no cover 270 is provided). As shown in FIGS. 15 and 21, for example, position P7 may be spaced a distance ES from an end of cover 270 at cable end 204 (e.g., distance ES may be any suitable magnitude in a range between 0.30 millimeters and 1.30 millimeters or may be about 0.80 millimeters), and cable support component 450 may include a base body 452, which may be any suitable shape (e.g., disk shaped) with any suitable maximum cross-sectional outer width SW and any suitable length SL and any suitable thickness ST, and which may define a main opening 451 having any suitable maximum cross-sectional width SO that may be operative to surround and contact an outer surface of cable subassembly 200 (e.g., cover 270). For example, cross-sectional width SO may have a magnitude in a range between 6.35 millimeters and 6.75 millimeters or may be about 6.55 millimeters, such that it may just fit about width CW of jacket 260, which may be in a range between 6.3 millimeters and 6.7 millimeters, or about 6.5 millimeters. Outer width SW may have any suitable magnitude, such as in a range between 10.22 millimeters and 10.38 millimeters or may be about 10.30 millimeters. Length SL may have any suitable magnitude, such as in a range between 0.28 millimeters and 0.32 millimeters or may be about 0.30 millimeters. Thickness ST may have any suitable magnitude, such as in a range between 2.92 millimeters and 3.38 millimeters or may be about 3.20 millimeters. A base body surface 452*s* of base body 452 about main opening 451 facing away from cable end 204 (e.g., facing the +X-direction and/or lying in an X-Y plane) may be operative to provide a rigid surface against which a portion of a collet may exert any suitable force for retaining second cable connector subassembly 400 in a particular position with respect to remote subsystem 600 (e.g., retention mechanism 660 of FIGS. 26-30). Base body surface 452*s* may be electrically isolated or insulated from each conductor group of cable subassembly 200 by insulation subassembly 250 and/or jacket 260 and/or cover 270 and/or body component 460.

As also shown in FIGS. 15 and 21, for example, cable support component 450 may also include an extension body 454 that may be coupled to base body 452 at one extension end 453 and that may extend away from base body 452 to another extension end 455 (e.g., generally in the +X-direction away from cable end 204 when component 450 is positioned about cable subassembly 200). Extension body 454 may be any suitable shape and may extend any suitable length XL away from base body 452 about cable subassembly 200 (e.g., length XL may be any suitable magnitude in a range between 5.40 millimeters and 6.00 millimeters or may be about 5.60 millimeters), and extension body 454 may also define a portion of main opening 451 having maximum cross-sectional width SO similar to that of base body 452. However, as also shown (e.g., by the differences between FIGS. 14 and 15), at least a portion of extension body 454 may be mechanically deformed and/or compressed or crimped about cable subassembly 200 for fixing extension body 454 and, thus, base body 452 about cable subassembly 200 at a particular position (e.g., with respect to position P7), where such crimping of extension body 454 may be operative to prevent cable support component 450 from sliding along the length of cable subassembly 200 (e.g., along the X-axis) and/or from rotating about cable subassembly 200 (e.g., about axis A or the X-axis) during future use of cable subassembly 200 and connector subassembly 400 (e.g., during retention of connector subassembly 400 in a particular position with respect to remote subsystem 600). Moreover, as shown in FIG. 21, for example, insulation 230 and insulation 240 may extend a distance UD away from base body 452 (e.g., distance UD may be any suitable magnitude in a range between 3.30 millimeters and 4.30 millimeters or may be about 3.80 millimeters), and first conductor group second end 214 and second conductor group second end 224 may extend a distance ND away from base body 452 (e.g., distance ND may be any suitable magnitude in a range between 8.60 millimeters and 9.60 millimeters or may be about 9.10 millimeters). Cable support component 450 may be made of any suitable material or combination of materials (e.g., stainless steel (e.g., SUS304 ½H)) that may provide suitable rigidity (e.g., at base body surface 452*s*) against which a portion of a collet may exert any suitable force for retaining second cable connector subassembly 400 in a particular position with respect to remote subsystem 600.

Figure 22:
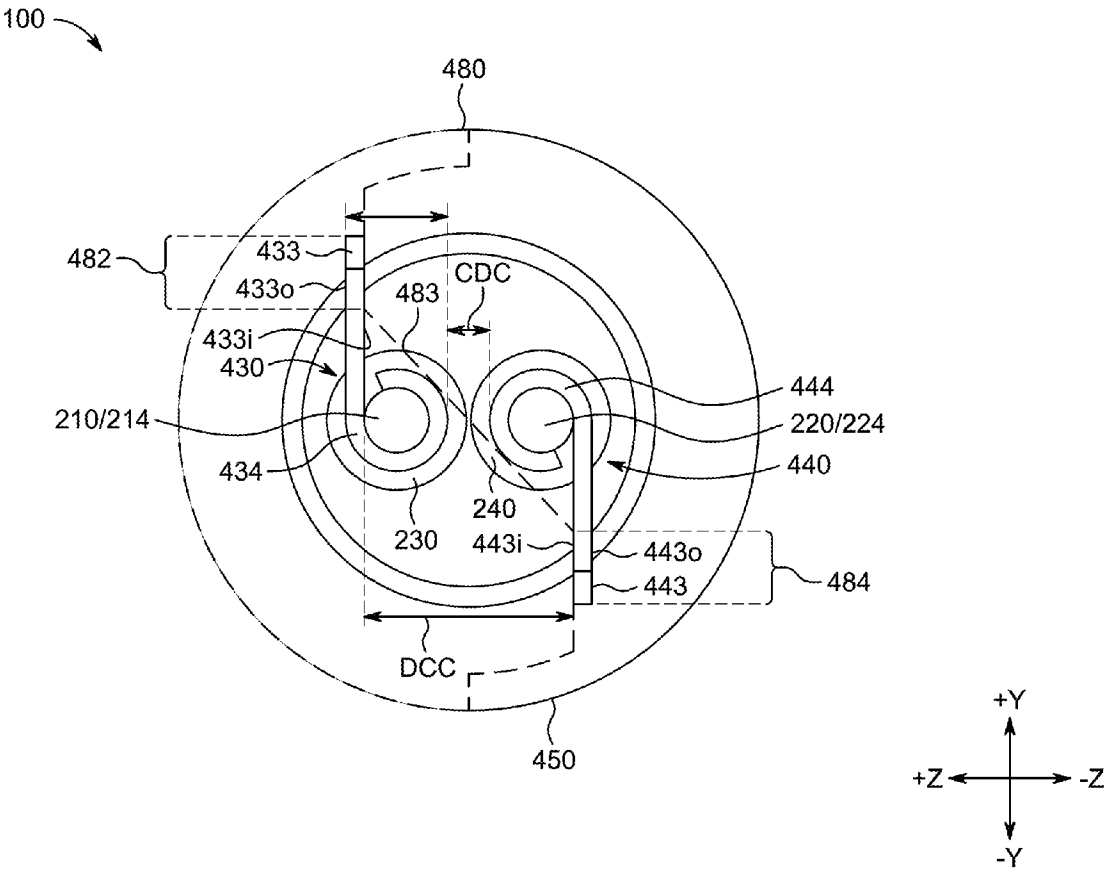
FIG. 22 is a front view of the portion of the cable assembly of FIGS. 12-21 in the fifth stage of assembly.

Once cable support component 450 has been fixed (e.g., crimped) to cable subassembly 200 and once conductor contact 430 has been electrically coupled (e.g., crimped) to first conductor group 210 and once conductor contact 440 has been electrically coupled (e.g., crimped) to second conductor group 220 (e.g., as may be shown by FIGS. 13-17), a body component 460 of second cable connector subassembly 400 may be provided for additional structure. For example, as shown in FIG. 18, body component 460 may be provided to encompass a portion of conductor contact 430 (e.g., receiving portion 434), a portion of conductor contact 440 (e.g., receiving portion 444), and a portion of cable subassembly 200 (e.g., any portion of first conductor group 210 and/or second conductor group 220 and/or insulation subassembly 250 that may not be surrounded by jacket 260 and/or cover 270 at second cable end 204). Such provisioning of body component 460 may be operative to protect and/or reinforce the electrical and mechanical coupling of conductor contact 430 and first conductor group 210 (e.g., at receiving portion 434) and to protect and/or reinforce the electrical and mechanical coupling of conductor contact 440 and second conductor group 220 (e.g., at receiving portion 444), while still enabling at least a portion of conductor contact extension portion 433 of conductor contact 430 to be exposed for electrical coupling with device contact extension portion 414, and while still enabling at least a portion of conductor contact extension portion 443 of conductor contact 440 to be exposed for electrical coupling with device contact extension portion 424. For example, as shown in FIG. 18, a portion of conductor contact extension portion 433 may extend out from body component 460 (e.g., in the +Y-direction) by a distance XD above a top shelf 461 of body component 460, where distance XD may be any suitable magnitude (e.g., in a range between 2.00 millimeters and 2.20 millimeters or about 2.00 millimeters), and a portion of conductor contact extension portion 443 may extend out from body component 460 (e.g., in the −Y-direction) by a distance that may be similar to distance XD below a bottom shelf 463 of body component 460 (e.g., an opposite surface than that of top shelf 461 of body component 460 (e.g., top shelf 461 and bottom shelf 463 face away from each other in opposite directions)). As shown in FIG. 22, for example, a maximum width WCC of conductor contact 430 (e.g., after crimping) may be any suitable magnitude, such as in a range between 1.49 millimeters and 2.09 millimeters or may be about 1.79 millimeters. Additionally or alternatively, as shown in FIG. 22, for example, a distance DCC between a first plane that may be defined by an interior surface 433*i* of conductor contact extension portion 433 (e.g., a first X-Y plane) and a second plane that may be defined by an interior surface 443*i* of conductor contact extension portion 443 (e.g., a second X-Y plane) may be any suitable magnitude, such as in a range between 3.75 millimeters and 3.85 millimeters or may be about 3.80 millimeters. Additionally or alternatively, as shown in FIG. 22, for example, a minimum distance CDC between conductor contact 430 and conductor contact 440 (e.g., between an outer surface of receiving portion 434 and an outer surface of receiving portion 444 (e.g., after crimping to respective conductor groups 210 and 220)) may be any suitable magnitude (e.g., in a range between 0.35 millimeters and 0.45 millimeters or may be about 0.40 millimeters).

Figure 23:
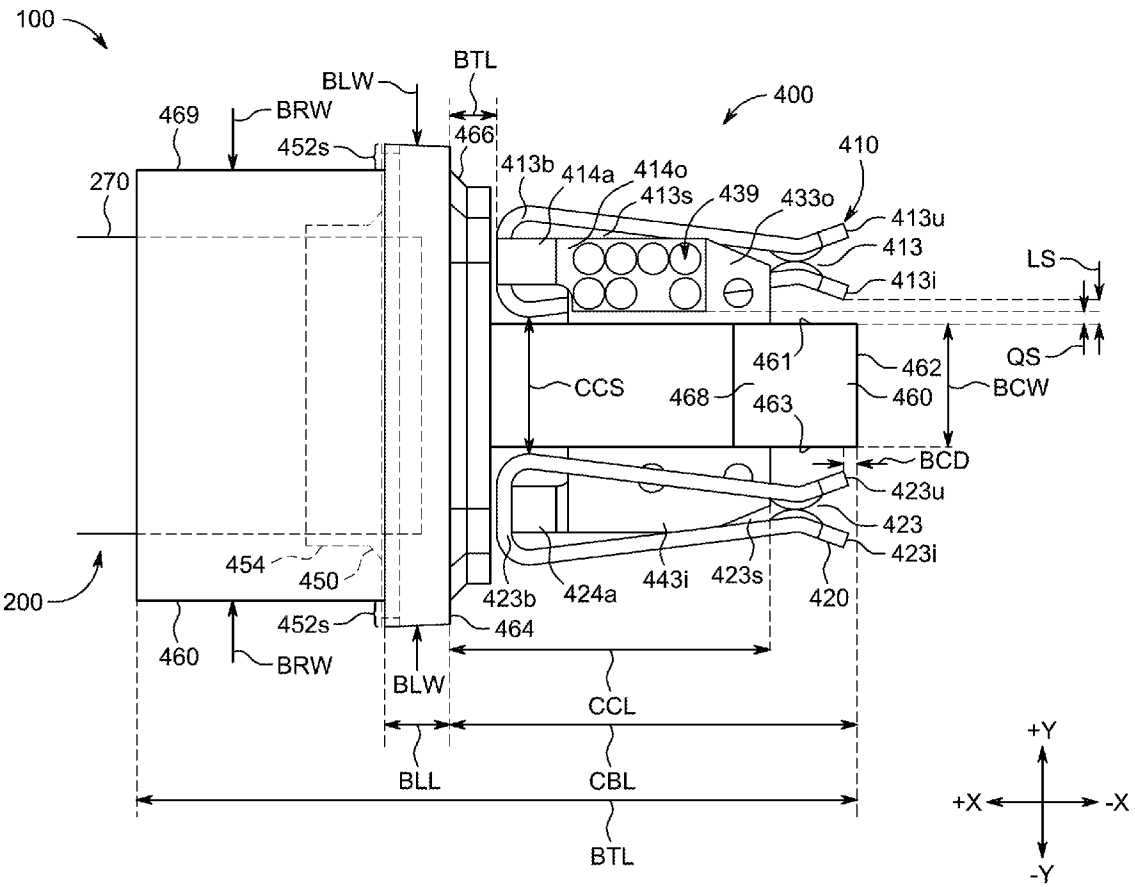
FIG. 23 is a side view of the portion of the cable assembly of FIGS. 12-22 in the seventh stage of assembly.
Figures 24, 25:
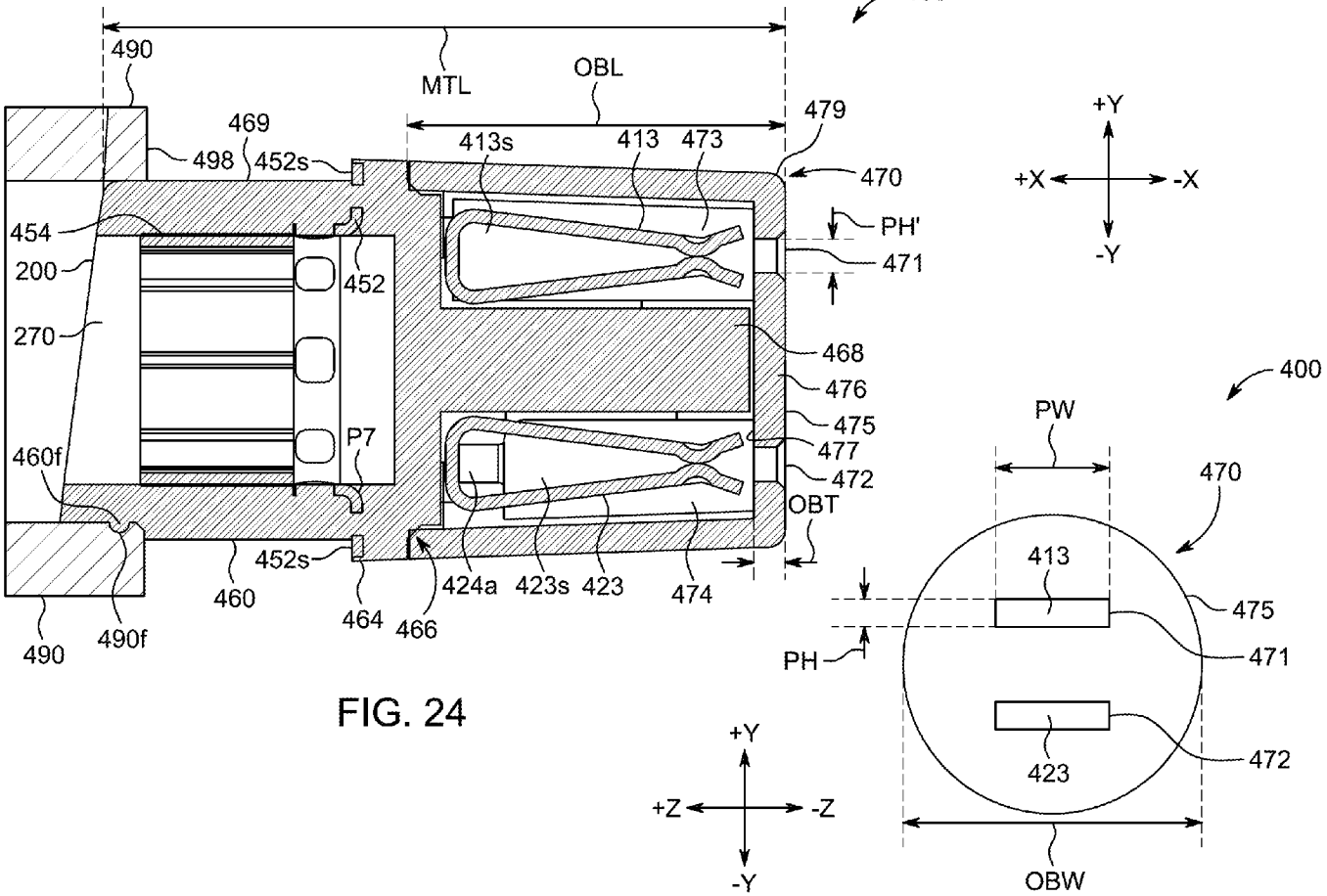
FIG. 24 is a cross-sectional view of the portion of the cable assembly of FIGS. 12-23 in the eighth stage of assembly.
FIG. 25 is a front view of the portion of the cable assembly of FIGS. 12-24 in the eighth stage of assembly.

Moreover, as shown in FIGS. 18, 23, and 24, for example, a portion of body component 460 may be operative to cover a portion of cable support component 450 about cable subassembly 200 (e.g., the entirety of extension body 454 and the majority of base body 452 except for at least a portion of base body surface 452*s*, which may be directly contacted by a collet for retaining a particular position of second cable connector subassembly 400 with respect to remote subsystem 600 (e.g., retention mechanism 660 of FIGS. 26-30)), as well as any other suitable portion of cable subassembly 200 that may not be engaged by cable support component 450 (e.g., a portion of cable subassembly 200 in the +X direction beyond another extension end 455 of extension body 454 of cable support component 450). Such provisioning of body component 460 about one or more portions of cable subassembly 200 (e.g., an end portion of first conductor group 210 and/or of second conductor group 220 and/or of insulation subassembly 250 and/or of cover 270 and/or of jacket 260 at second cable end 204) may be operative to protect and/or further insulate conductors 212 and 222 of cable subassembly 200.

Figure 34:
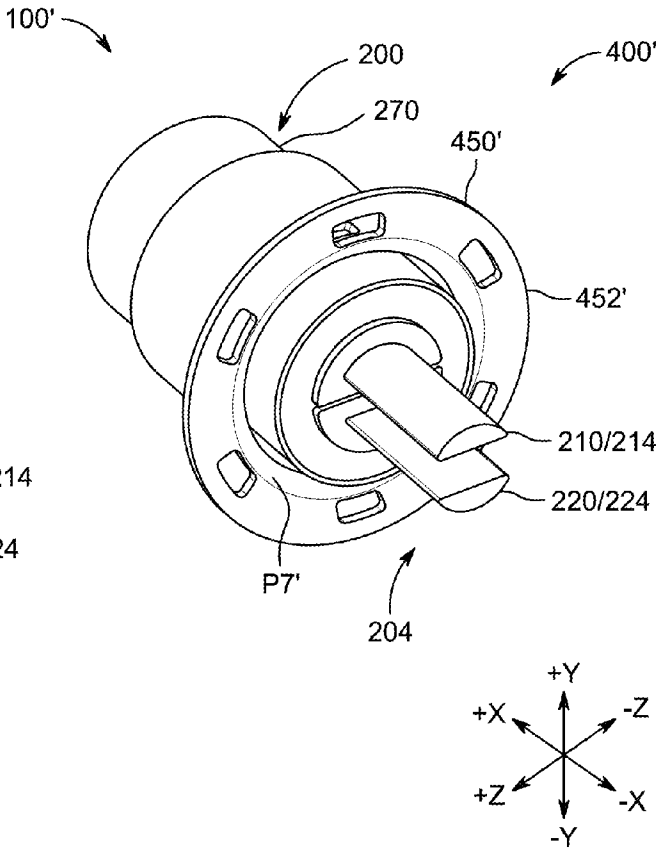
FIG. 34 is a perspective view of the portion of the cable assembly of FIGS. 32 and 33 in a second stage of assembly.
Figure 33:
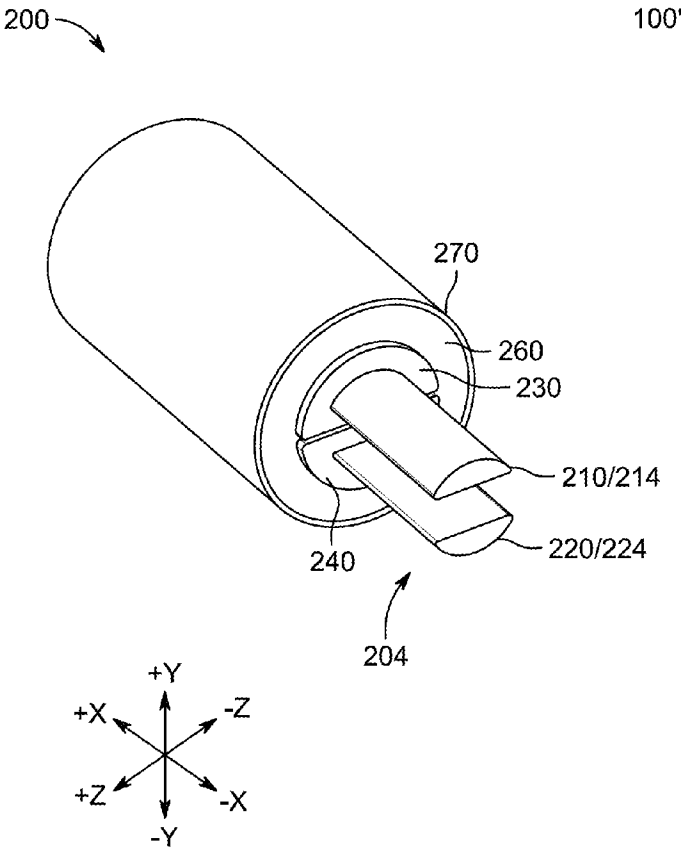
FIG. 33 is a perspective view of the portion of the cable assembly of FIG. 32 in a first stage of assembly.
Figure 35:
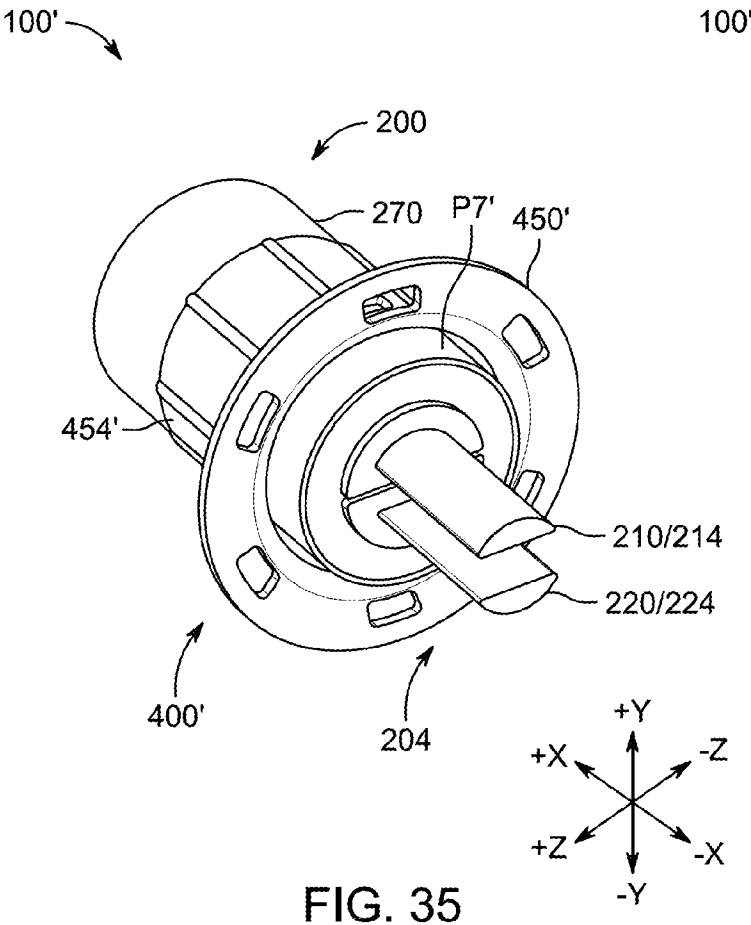
FIG. 35 is a perspective view of the portion of the cable assembly of FIGS. 32-34 in a third stage of assembly.

Additional insulation of cable subassembly 200 that may be provided by body component 460 may enable one or more portions of cable subassembly 200 to have a different geometry at its portion protected by body component 460 than at another portion that is not protected by body component 460. For example, while each one of first conductor group 210 and second conductor group 220 may be configured to have a D-shaped cross-section along a portion or even a majority of the length of cable subassembly 200 (e.g., as shown in FIGS. 2 and 3), the cross-sectional shape of first conductor group 210 and the cross-sectional shape of second conductor group 220 may transition from such a D-shape (e.g., as shown in FIGS. 2 and 3) to a circular shape near second cable end 204 (e.g., as shown in FIGS. 12-17) that may be covered by a portion of cable connector subassembly 400 (e.g., by body component 460). This transition in geometry of each conductor group to a circular cross-sectional shape may be enabled while maintaining a substantially constant outer width CW and/or constant outer width JW of cable subassembly 200 by varying (e.g., reducing) the thickness of insulation subassembly 250 about the conductor groups (e.g., reducing at least a portion of the cross-sectional thickness of thickness IT1 and/or thickness IT2, with or without reducing thickness IT3), where any loss of outer insulation provided by such variation in insulation subassembly 250 may be made up for by insulation that may be provided by cable connector subassembly 400 (e.g., by body component 460). Such a circular cross-sectional shape of first conductor group 210 and/or of second conductor group 220 at second cable end 204 may be operative to enable a more robust and/or easier coupling with a receiving portion 434/444 of a respective conductor contact 430/440. Alternatively, the cross-sectional shape of first conductor group 210 and/or the cross-sectional shape of second conductor group 220 may be the same at second cable end 204 as it is at another portion of cable subassembly 200 (e.g., D-shaped, as shown in FIGS. 2 and 3 (e.g., a cross-sectional shape of receiving portion 434 and/or of receiving portion 444 may also be at least partially D-shaped or a shape substantially similar to a respective conductor group at end 204 for facilitating a robust coupling) and/or as shown in FIGS. 33-35 (e.g., prior to manipulation for defining a flat conductor coupling portion for use with another second cable connector subassembly 400' of FIGS. 32-43)). The geometry of receiving portion 434 of conductor contact 430 may be configured to be similar to the geometry of first conductor group 210 at first conductor group second end 214 (e.g., the shared circular cross-sectional shape of FIGS. 12-17 and 22, or a D-shaped cross-section may be shared by both receiving portion 434 and conductor group second end 214 (not shown)) and the geometry of receiving portion 444 of conductor contact 440 may be configured to be similar to the geometry of second conductor group 220 at second conductor group second end 224 (e.g., the shared circular cross-sectional shape of FIGS. 12-17 and 22, or a D-shaped cross-section may be shared by both receiving portion 444 and conductor group second end 224 (not shown)).

In some embodiments, as shown in FIGS. 19 and 23, once body component 460 has been provided, a portion of conductor contact extension portion 433 of conductor contact 430 that may be extending out from body component 460 may be electrically coupled to device contact 410 (e.g., to device contact extension portion 414 (e.g., via laser welding)) and a portion of conductor contact extension portion 443 of conductor contact 440 that may be extending out from body component 460 may be electrically coupled to device contact 420 (e.g., to device contact extension portion 424 (e.g., via laser welding)). Device contact 410 may include device contact extension portion 414 of any suitable geometry, such as a regular cuboid with an outer surface 414*o* and an opposite inner surface 414*i* that may interface with and be electrically coupled to an outer surface 433*o* of conductor contact extension portion 433. Alternatively, although not shown, outer surface 414*o* of extension portion 414 may interface with and be electrically coupled to inner surface 433*i* of conductor contact extension portion 433. Device contact 410 may also include female receptacle portion 413 of any suitable geometry, such as a U-shaped component with a base contact portion 413*b*, an upper contact portion 413*u* extending from base contact portion 413*b* to a free upper end, and a lower contact portion 413*l* extending from base contact portion 413*b* to a free lower end, where a female receptacle space 413*s* may be defined by surfaces of contact portions 413*b*, 413*u*, and 413*l* (e.g., for receiving and/or holding contact 620 of subsystem 600). Moreover, device contact 410 may also include a curved or angled or bent arm 414*a* that may extend from a first arm end at extension portion 414 to a second arm end at base contact portion 413*b* (e.g., a portion of the first arm end of arm 414*a* may be in an X-Y plane of inner surface 414*i* while a portion of the second arm end of arm 414*a* may be in a Y-Z plane of base contact portion 413*b*). Device contact 420 may be the same or substantially the same as device contact 410, which may enable contacts 410 and 420 to be used interchangeably during assembly for ease of manufacture. For example, as shown, device contact 420 may include device contact extension portion 424 of any suitable geometry, such as a regular cuboid with an outer surface 424*o* and an opposite inner surface 424*i* that may interface with and be electrically coupled to an outer surface 443*o* of conductor contact extension portion 443. Alternatively, although not shown, outer surface 424*o* of extension portion 414 may interface with and be electrically coupled to inner surface 443*i* of conductor contact extension portion 443. Device contact 420 may also include female receptacle portion 423 of any suitable geometry, such as a U-shaped component with a base contact portion 423*b*, an upper contact portion 423*u* extending from base contact portion 423*b* to a free upper end, and a lower contact portion 423*l* extending from base contact portion 423*b* to a free lower end, where a female receptacle space 423*s* may be defined by surfaces of contact portions 423*b*, 423*u*, and 423*l* (e.g., for receiving and/or holding contact 620 of subsystem 600). Moreover, device contact 420 may also include a curved or angled or bent arm 424*a* that may extend from a first arm end at extension portion 424 to a second arm end at base contact portion 423*b* (e.g., a portion of the first arm end of arm 424*a* may be in an X-Y plane of inner surface 424*i* while a portion of the second arm end of arm 424*a* may be in a Y-Z plane of base contact portion 423*b*).

As shown in FIG. 23, for example, device contacts 410 and 420, in conjunction with body component 460 and conductor contacts 430 and 440, may provide a structure with geometry capable of communicating any suitable electrical signals according to various standards. Once body component 460 has been provided and device contact 410 has been electrically coupled to conductor contact 430 (e.g., via one or more laser weld instances 439 between conductor contact extension portion 433 and extension portion 414), a spacing QS may be maintained between extension portion 414 and body component 460 (e.g., between a bottom of extension portion 414 and top shelf 461 of body component 460), where spacing QS may be any suitable magnitude in a range between 0.24 millimeters and 0.34 millimeters or may be about 0.29 millimeters. A spacing LS may be maintained between female receptacle portion 413 and body component 460 (e.g., between lower contact portion 413*l* and top shelf 461 of body component 460), where spacing LS may be any suitable magnitude (e.g., about 0.10 millimeters). A front surface 462 of body component 460 that may extend between top shelf 461 and bottom shelf 463 of body component 460 may have a width BCW, where width BCW may be any suitable magnitude in a range between 2.62 millimeters and 2.72 millimeters or may be about 2.67 millimeters. A minimum spacing CCS may be maintained between female receptacle portion 413 and female receptacle portion 423 (e.g., between lower contact portion 413*l* of female receptacle portion 413 and upper contact portion 423*u* of female receptacle portion 423), where spacing CCS may be any suitable magnitude in a range between 3.00 millimeters and 4.00 millimeters or may be about 3.64 millimeters. A spacing BCD between an end of female receptacle portion 423 and a plane of front surface 462 of body component 460 may be any suitable magnitude, such as in a range between 0.30 millimeters and 0.38 millimeters or may be about 0.34 millimeters. A lip portion 464 of body component 460 may be provided about base body 452 of cable support component 450 and may include a width BLW and a length BLL, where width BLW may be any suitable magnitude in a range between 10.40 millimeters and 10.60 millimeters or may be about 10.50 millimeters, and where length BLL may be any suitable magnitude in a range between 1.30 millimeters and 1.40 millimeters or may be about 1.35 millimeters. A transition portion 466 of body component 460 may be provided to extend away from lip portion 464 (e.g., in the −X-direction) and may include a length BTL, where length BTL may be any suitable magnitude in a range between 0.90 millimeters and 1.10 millimeters or may be about 1.00 millimeter. A front portion 468 of body component 460 may be provided to extend away from transition portion 466 (e.g., in the −X-direction) and may define front surface 462, top shelf 461, and bottom shelf 463. A length CBL between the front of lip portion 464 and front surface 462 of front portion 468 may be any suitable magnitude, such as in a range between 8.79 millimeters and 8.95 millimeters or may be about 8.87 millimeters. A length CCL between the front of lip portion 464 and the front of contact extension portion 443 may be any suitable magnitude, such as in a range between 6.85 millimeters and 7.05 millimeters or may be about 6.95 millimeters. A rear portion 469 of body component 460 may be provided to extend away from lip portion 464 (e.g., in the +X-direction) and about extension body 454 of cable support component 450 and may include a width BRW, where width BRW may be any suitable magnitude less than that of width BLW of lip portion 464 such that surface 452*s* of a particular dimension may be provided (e.g., at least 0.35 millimeters or in a range between 0.30 millimeters and 0.50 millimeters or may be about 0.40 millimeters). A total length BTL of body component 460 (e.g., including portions 464, 466, 468, and 469) may be any suitable magnitude, such as in a range between 17.78 millimeters and 17.98 millimeters or may be about 17.88 millimeters.

Figure 20:
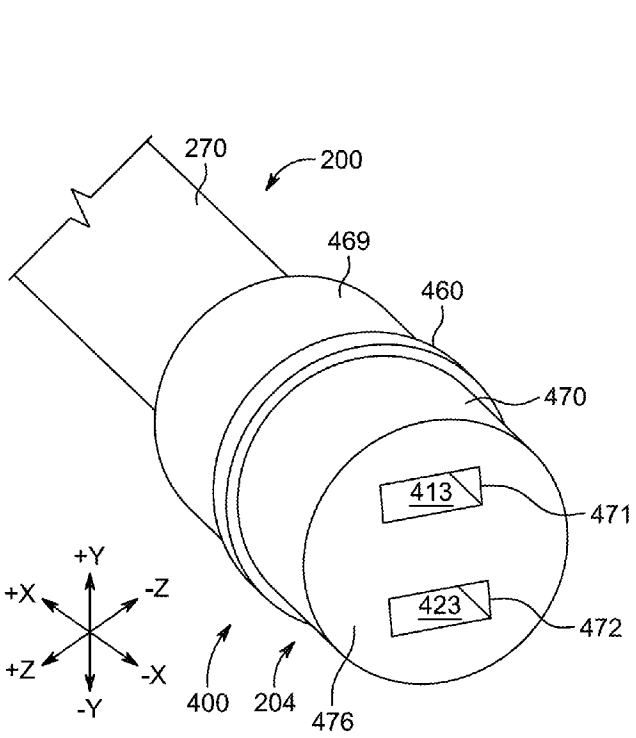
FIG. 20 is a perspective view of the portion of the cable assembly of FIGS. 12-19 in an eighth stage of assembly.

In some embodiments, as shown in FIGS. 20 and 24, once body component 460 has been provided and once conductor contacts 430 and 440 have been electrically coupled to respective device contacts 410 and 420, an outer component 470 of second cable connector subassembly 400 may be provided for additional structure. For example, as shown, outer component 470 may be operative to surround a portion of body component 460 (e.g., transition portion 466 and front portion 468 of body component 460) and may be operative to abut the front of lip portion 464. Additionally, as shown, outer component 470 may be operative to surround the entirety of device contacts 410 and 420 while still enabling device contacts 410 and 420 to be accessible for potential interaction with a remote subsystem. For example, outer component 470 may be provided to include one or more suitable passages, such as passages 471 and 472 provided through a front wall 476 of outer component 470, for enabling female receptacle portions 413 and 414 to be accessible by remote subsystem 600 for potential interaction with respective contacts 610 and 620 (e.g., introduction of contact 610 into female receptacle space 413*s* via passage 471 for electrically coupling contact 610 and contact 410 and/or introduction of contact 620 into female receptacle space 423*s* via passage 472 for electrically coupling contact 620 and contact 420). For example, as shown in FIG. 24, outer component 470 may be provided to define a first space 473 in cooperation with body component 460 such that contact 410 may be able to appropriately interact with (e.g., be expanded by for retaining) contact 610 within first space 473 and/or to define a second space 474 in cooperation with body component 460 such that contact 420 may be able to appropriately interact with (e.g., be expanded by for retaining) contact 620 within space 474. Passage 471 may be fluidly coupled with first space 473 and passage 472 may be fluidly coupled with second space 474. Each one of passage 471 and 472 may have any suitable height PH and any suitable width PW at an outer surface 475 of front wall 476. Height PH may be any suitable magnitude in a range between 1.20 millimeters and 1.40 millimeters or may be about 1.30 millimeters, while width PW may be any suitable magnitude in a range between 2.85 millimeters and 3.05 millimeters or may be about 2.95 millimeters. Each one of passage 471 and 472 may have any suitable height PH' and any suitable width PW' at an inner surface 477 of front wall 476. Height PH' may be any suitable magnitude in a range between 0.82 millimeters and 0.92 millimeters or may be about 0.87 millimeters, while width PW' (not shown) may be any suitable magnitude in a range between 2.44 millimeters and 2.54 millimeters or may be about 2.49 millimeters. Front wall 476 may have any suitable thickness OBT between outer surface 475 and inner surface 477 (e.g., thickness OBT may be any suitable magnitude in a range between 0.7 millimeters and 0.9 millimeters or may be about 0.8 millimeters). Outer component 470 may have any suitable maximum width OBW, which may be any suitable magnitude in a range between 10.4 millimeters and 10.6 millimeters or may be about 10.5 millimeters. Outer component 470 may have any suitable length OBL, which may be any suitable magnitude in a range between 9.62 millimeters and 9.72 millimeters or may be about 9.67 millimeters. Body component 460 and outer component 470 may together have any suitable total length MTL (e.g., a total length of cable connector subassembly 400), which may be any suitable magnitude in a range between 18.60 millimeters and 19.00 millimeters or may be about 18.80 millimeters.

Figure 12:
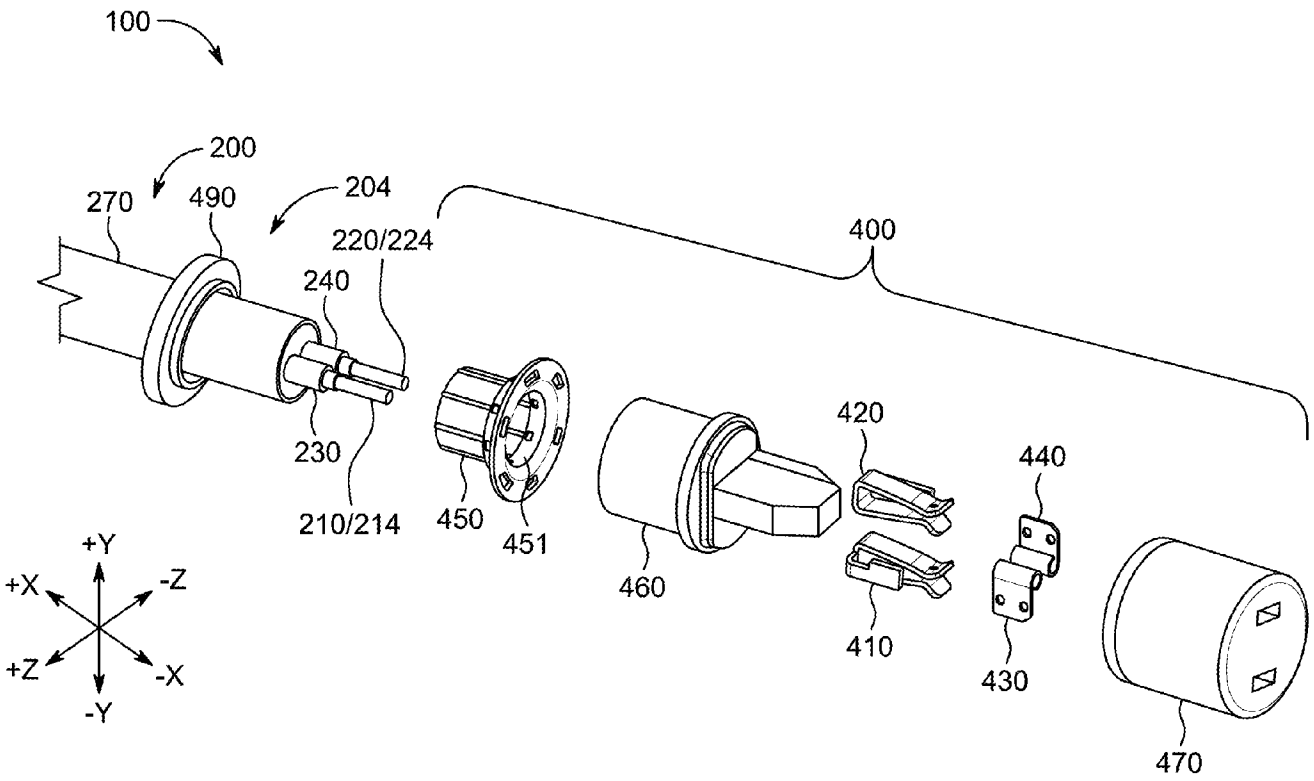
FIG. 12 is an exploded perspective view of another portion of the cable assembly of FIGS. 1-3 including a second cable connector subassembly.
Figure 14:
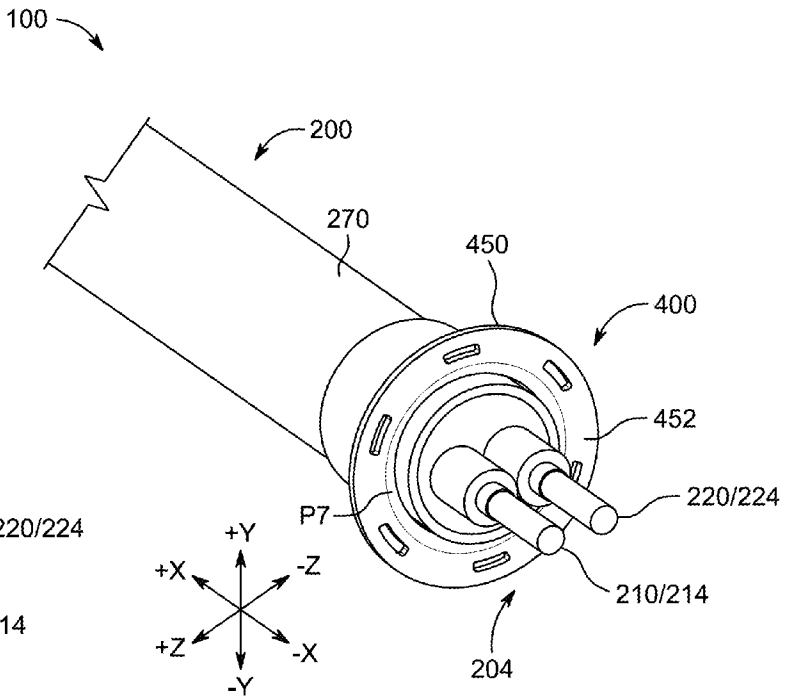
FIG. 14 is a perspective view of the portion of the cable assembly of FIGS. 12 and 13 in a second stage of assembly.
Figure 13:
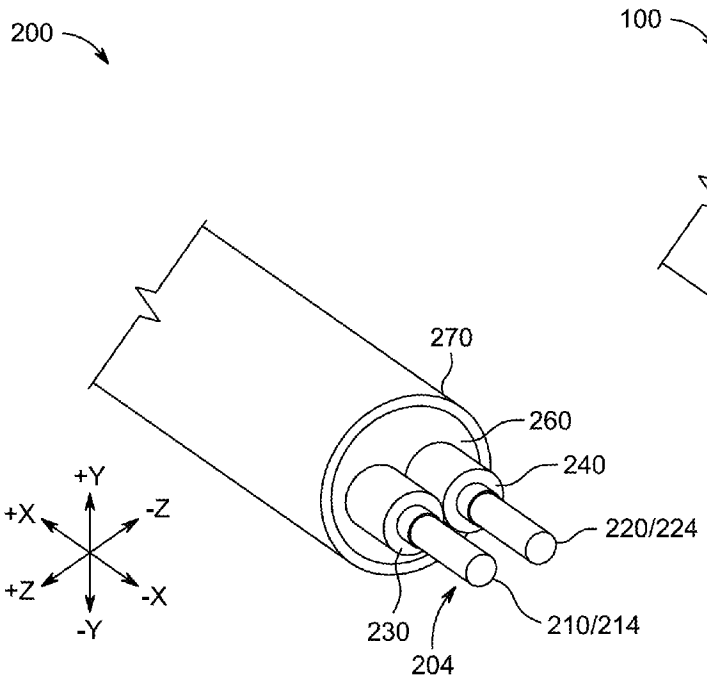
FIG. 13 is a perspective view of the portion of the cable assembly of FIG. 12 in a first stage of assembly.

In some embodiments, as shown in FIGS. 12 and 24, once body component 460 has been provided, a trim component 490 of cable connector subassembly 400 may be provided for additional structure. For example, as shown, trim component 490 may be operative to extend along and about a portion of cable subassembly 200 and/or along and about a portion of body component 460 (e.g., a mechanical feature 460*f* of body component 460 (e.g., a nub or groove) may interact with a mechanical feature 490*f* of trim component 490 (e.g., a groove or nub) for mechanically coupling trim component 490 to body component 460 about cable subassembly 200). For example, trim component 490 may be configured as a snap ring for engaging body component 460. Trim component 490 may be configured to be removed from body component 460 by an end user or by a manufacturer for any suitable purpose (e.g., to enable easier removal of cable connector subassembly 400 from remote subsystem 600). Trim component 490 may be operative to act as a strain relief that may help cable subassembly 200 to have a gradual radius (e.g., trim component 490 may be able to help the transition of the cable to curve up or down or otherwise).

Body component 460 and/or outer component 470 of cable connector subassembly 400 may be formed using any suitable material(s) using any suitable techniques. For example, component 460 may be molded (e.g., injection molded) using any suitable material (e.g., a polycarbonate resin (e.g., Emerge™ PC 8600-10)), while component 470 may be molded (e.g., molded and then coupled (e.g., ultrasonically welded) to body component 460 or over molded onto body component 460) using any suitable material (e.g., a polycarbonate resin (e.g., Emerge™ PC 8600-10)). Component 460 may differ from component 470 with respect to any suitable characteristic, such as size, shape, color, flexibility, deformability, tactility, ability to repel certain fluids, and/or the like. Alternatively, component 460 and component 470 may be formed from the same material. Additionally or alternatively, the manner(s) in which component 460 may be formed may be the same as or different than the manner(s) in which component 470 may be formed. If body component 460 is formed using a molding process, that process may use any suitable technique(s) to ensure that surface 452*s* of base body 452 of cable support component 450 may remain uncovered by the material of body component 460 (e.g., an injection mold tool may be operative to shut off against surface 452*s*). Alternatively or additionally, a portion of a provided body component 460 may be removed after formation for exposing surface 452*s*. If body component 460 is formed using a molding process, that process may use any suitable technique(s) to ensure that minimum distance CDC between conductor contact 430 and conductor contact 440 may be maintained (e.g., to ensure a suitable amount of insulation may be provided (e.g., by body component 460) between contacts 430 and 440 (e.g., for electrically isolating or insulating the electrical paths of conductor groups 210 and 220)). For example, one side of an injection molding tool may be provided with a footprint geometry indicated by broken line 480 of FIG. 22, which may include a first surface 482 that may run along a portion of inner surface 433*i* of conductor contact extension portion 433, a second surface 484 that may run along a portion of inner surface 443*i* of conductor contact extension portion 443, and a third surface 483 that may extend between an end of first surface 482 and an end of second surface 484, where surface 483 may run tangentially to an outer surface of receiving portion 434 and tangentially to an outer surface of receiving portion 444, which may thereby prevent conductor contact 430 and conductor contact 440 from being moved closer than minimum distance CDC during the provisioning of body component 460 using such a tool (e.g., whereby conductor contact 430 and at least a crimped portion of first conductor group 210 may be inserted into that side of the mold associated with line 480, and whereby another side of the mold may shut off on the conductor crimp). In some embodiments, as shown (see, e.g., FIG. 19), one or more holes 459 may be provided through base body 452 of cable support component 450 for enabling any material used to provide body component 460 (e.g., any injection mold material) to pass through hole(s) 459 such that the material may be provided on both sides of base body 452.

Therefore, cable connector subassembly 400 may provide a cleanly defined subassembly for electrically coupling contacts 410 and 420 to respective conductor groups 210 and 220 while providing a reduced size connector for use with subsystem 600.

Figure 26:
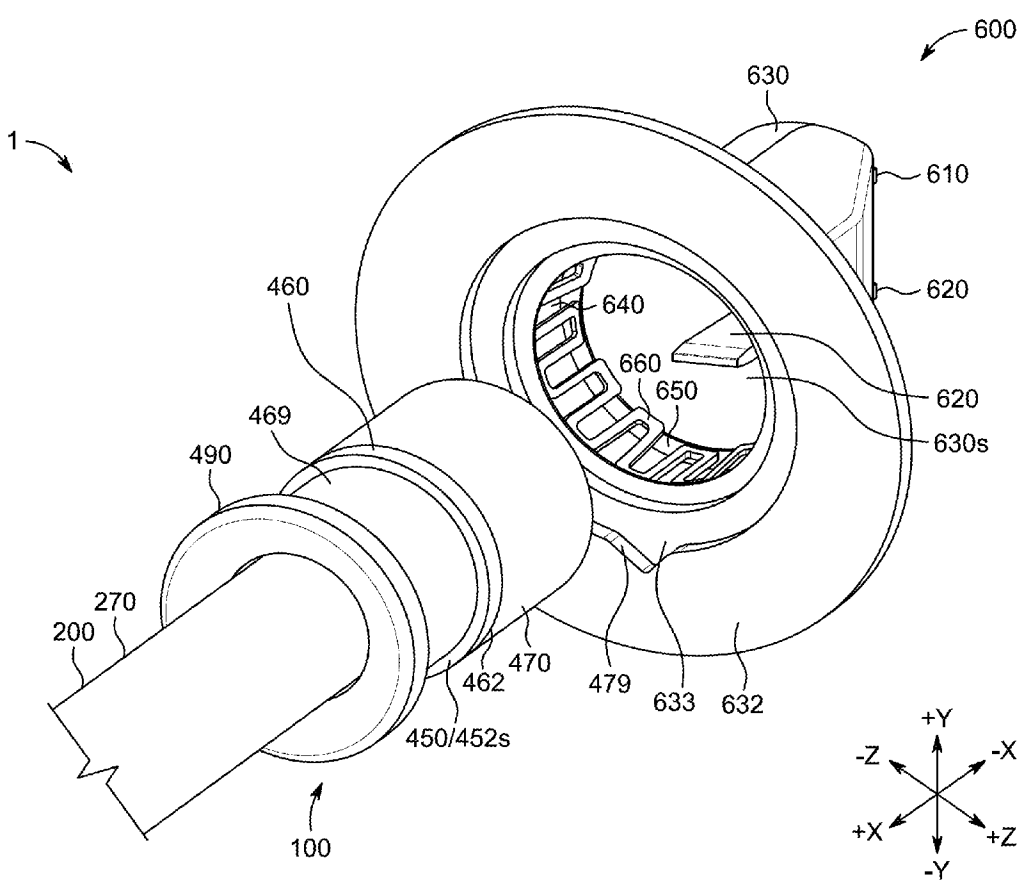
FIG. 26 is a perspective view of the portion of the cable assembly of FIGS. 12-25 prior to insertion into a device subsystem of FIG. 1.
Figure 27:
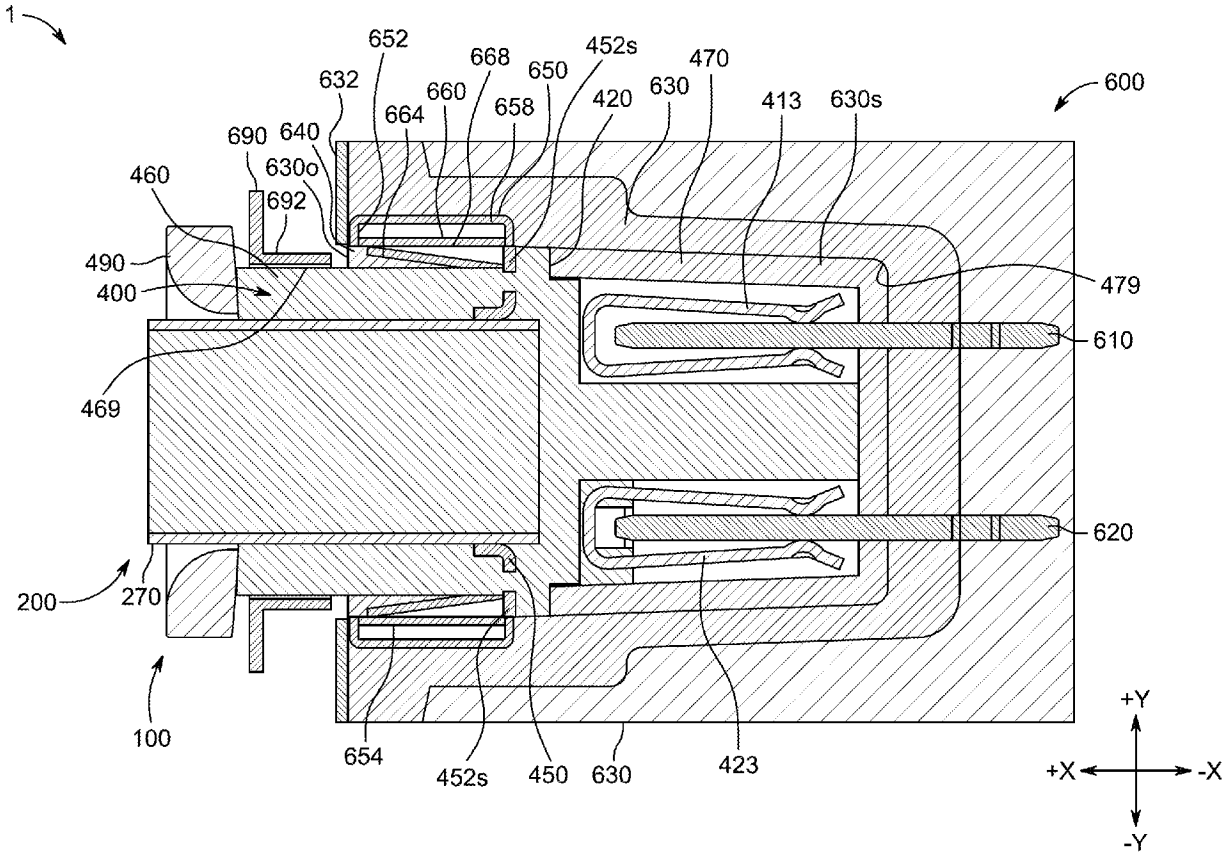
FIG. 27 is a cross-sectional view of the portion of the cable assembly of FIGS. 12-26 after insertion into the device subsystem of FIGS. 1 and 26.
Figure 28:
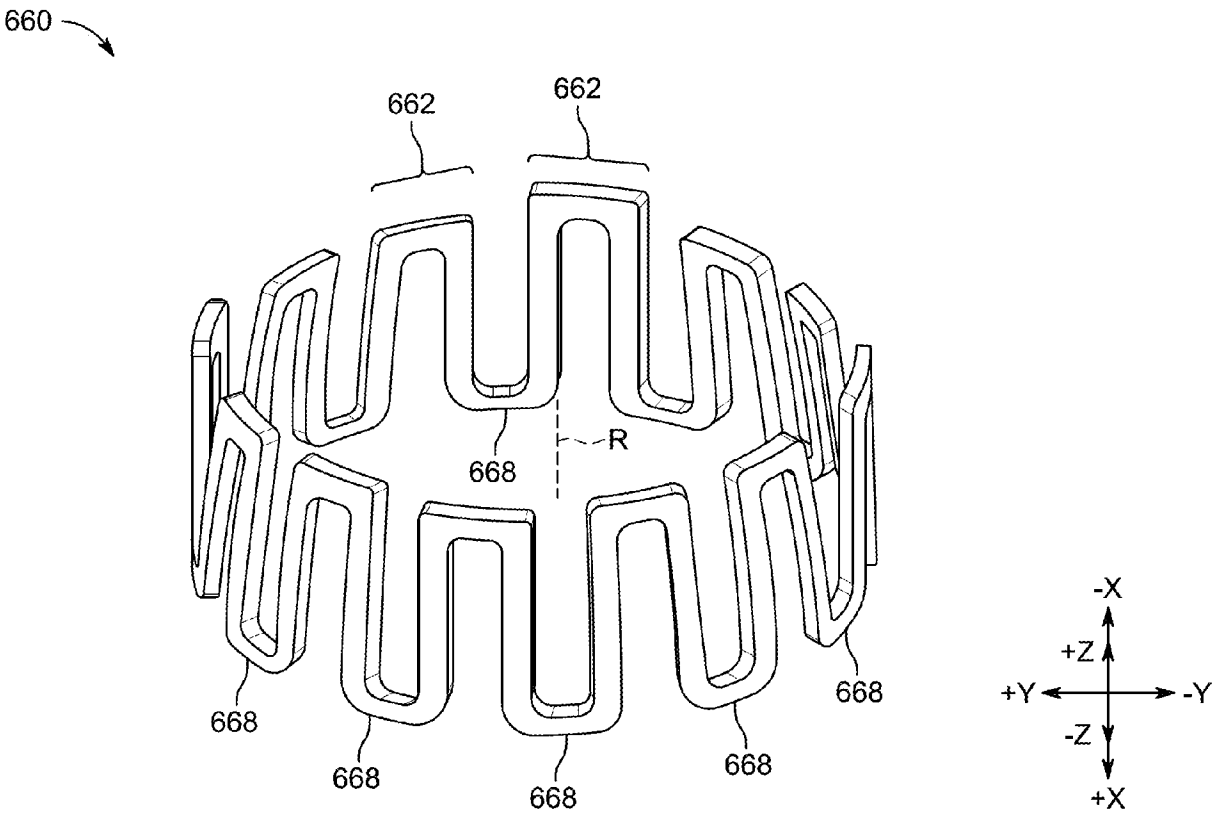
FIG. 28 is a perspective view of a component of the portion of the cable assembly of FIGS. 12-27.
Figure 29:
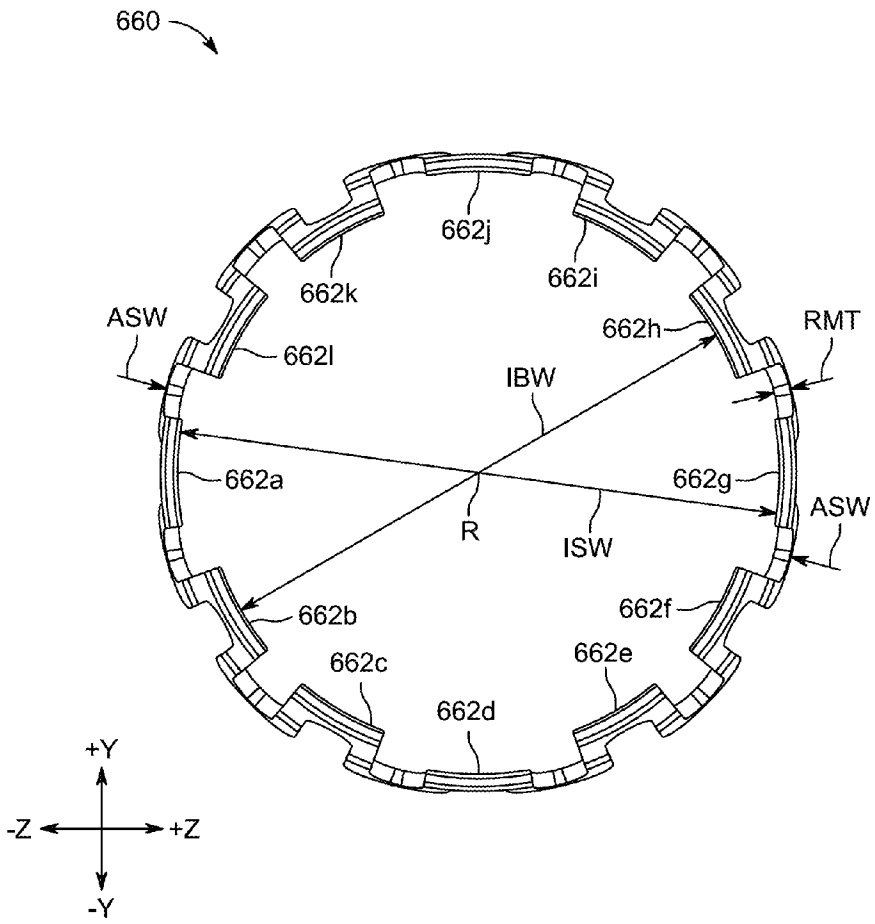
FIG. 29 is a top view of the component of FIG. 28.
Figure 30:
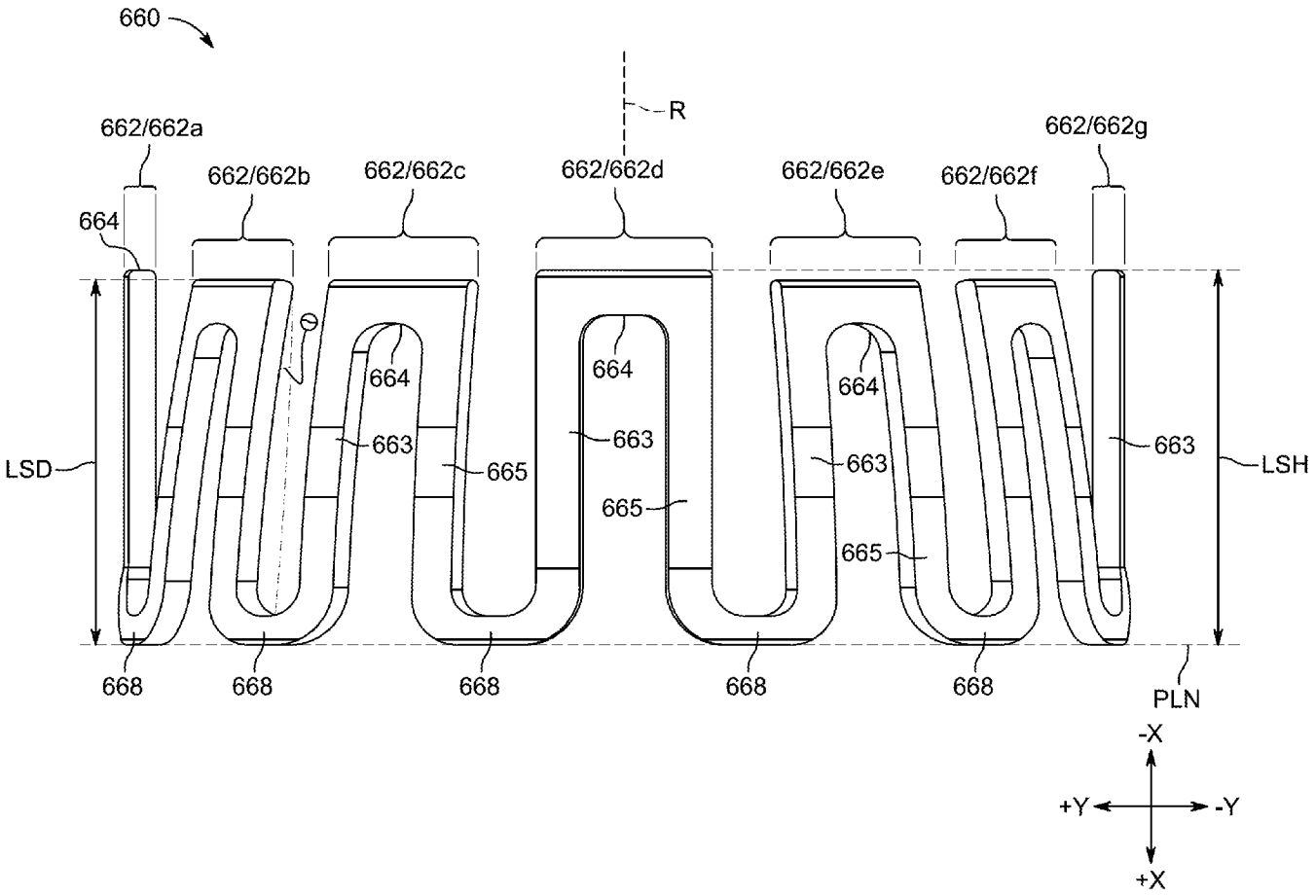
FIG. 30 is a side view of the component of FIGS. 28 and 29.

In some embodiments, as shown in FIGS. 26 and 27, a receptacle 630 of device subsystem 600 may house at least a portion of contact 610 and at least a portion of contact 620 positioned within a receptacle space 630*s* defined by receptacle 630, rather than contacts 610 and 620 extending outwardly away from any other structure of subsystem 600 (e.g., as shown in FIG. 1). Therefore, in such embodiments, second cable connector subassembly 400 may be at least partially inserted into receptacle 630 (e.g., in the −X-direction from the position of FIG. 26 through an opening of device subsystem 600 and into receptacle space 630*s* of receptacle 630 to the position of FIG. 27), such that female receptacle space 413*s* may receive contact 610 for electrically coupling female receptacle portion 413 with contact 610 and such that female receptacle space 423*s* may receive contact 620 for electrically coupling female receptacle portion 423 with contact 620. In order to retain cable assembly 100 in the position of FIG. 27 (e.g., the position in which connector subassembly 400 may be electrically coupled to device subsystem 600 within receptacle space 630*s*), a retention mechanism 660 may be provided.

Retention mechanism 660 may be any suitable mechanism that may be operative to prevent connector subassembly 400 from being withdrawn from receptacle space 630*s* (e.g., in the +X-direction) despite forces of a certain magnitude attempting to pull connector subassembly 400 out from receptacle space 630*s* (e.g., retention mechanism 660 may be operative to withstand forces of 1075 Newton that may be applied to connector subassembly 400 in the +X-direction for retaining subassembly 400 within receptacle space 630*s*). Retention mechanism 660 may be physically distinct from and/or electrically insulated from each contact of device subsystem 600 (e.g., from each one of contacts 610 and 620). In some embodiments, as shown in FIGS. 26-30, for example, retention mechanism 660 may be provided as a collet or any other suitable device. Retention mechanism 660 may be described as an annular element (e.g., annular about an axis R (e.g., along an X-axis)) that may include any suitable number of annularly spaced tabs or fingers 662 that may connect adjacent ones of a number of annularly extending and spaced anchor segments 668. In some embodiments, as shown, retention mechanism 660 may be a hollow structure that may be annularly continuous but annularly enlargeable about its axis R. Each finger 662 may include a lead segment 664, a first leg segment 663, and a second leg segment 665, where first leg segment 663 of a particular finger 662 may extend between a first end of that finger's lead segment 664 and one end of a first anchor segment 668, and where second leg segment 665 of that particular finger 662 may extend between a second end of that finger's lead segment 664 and one end of a second anchor segment 668 adjacent the first anchor segment 668. Each first leg segment 663 and each second leg segment 665 may have any suitable height LSH, which may be any suitable magnitude in a range between 4.03 millimeters and 4.43 millimeters or may be about 4.23 millimeters. As shown, in some embodiments, retention mechanism 660 may include twelve (12) fingers 662 (i.e., fingers 662*a*-662*l*) and, thus, twelve (12) anchor segments 668. However, in other embodiments, retention mechanism 660 may have more or fewer than twelve (12) fingers 662. Alternatively, the structure of retention mechanism 660 may have different configurations of fingers and geometries altogether. Retention mechanism 660 may be made of any suitable material or combination of materials (e.g., stainless steel (e.g., SUS304 ½H)) that may provide suitable rigidity (e.g., against base body surface 452*s*) for exerting any suitable force for retaining second cable connector subassembly 400 in a particular position with respect to remote subsystem 600. Retention mechanism 660 may be formed using any suitable techniques (e.g., machining, drilling, etching, etc.). Retention mechanism 660 may be configured to deform or deflect in various ways when various forces are applied thereto. However, in some embodiments, retention mechanism 660 may be configured to return to the configuration of FIGS. 28-30 when no forces are applied thereto, and may resist certain forces with any suitable amount of resistance as may be determined based on various materials and/or geometries of mechanism 660.

Some fingers 662 may include leg segments 663 and 665 that may extend perpendicularly up from their associated anchor segments 668. For example, as shown, leg segments 663 and 665 of each one of fingers 662*a*, 662*d*, 662*g*, and 662*j* may extend perpendicularly upwards (e.g., in the −X-direction) from a Y-Z plane PLN that may contain a portion of each anchor segment 668 of mechanism 660, such that the distance between that plane and the lead segment 664 of each one of fingers 662*a*, 662*d*, 662*g*, and 662*j* may be substantially the same as height LSH of each leg segment. Additionally, some fingers 662 may include leg segments 663 and 665 that may extend at an angle other than 90° up from their associated anchor segments 668. For example, as shown, leg segments 663 and 665 of each one of fingers 662*b*, 662*c*, 662*e*, 662*f*, 662*h*, 662*i*, 662*k*, and 662*l* may extend upwards at an angle θ other than 90° from plane PLN, such that the distance between that plane and the lead segment 664 of each one of fingers 662*b*, 662*c*, 662*e*, 662*f*, 662*h*, 662*i*, 662*k*, and 662*l* may be any suitable distance LSD that may be shorter than height LSH of each leg segment (e.g., LSD may be any suitable magnitude in a range between 3.93 millimeters and 4.33 millimeters or may be about 4.13 millimeters). Therefore, some fingers 662 (e.g., eight (8) fingers 662*b*, 662*c*, 662*e*, 662*f*, 662*h*, 662*i*, 662*k*, and 662*l*) may be angled or deflected or bent or otherwise configured to extend away from plane PLN differently than some other fingers 662 (e.g., four (4) fingers 662*a*, 662*d*, 662*g*, and 662*j*). As shown, fingers 662 that may not be bent (e.g., four (4) fingers 662*a*, 662*d*, 662*g*, and 662*j*) may be evenly dispersed amongst fingers 662 that may be bent (e.g., eight (8) fingers 662*b*, 662*c*, 662*e*, 662*f*, 662*h*, 662*i*, 662*k*, and 662*l*), such as every third finger 662 about mechanism 660 may not be bent. As shown, an outer cross-sectional width ASW of retention mechanism 660 that may be defined by anchor segments 668 (e.g., within plane PLN) may be any suitable magnitude, such as in a range between 11.41 millimeters and 11.61 millimeters or may be about 11.51 millimeters. An inner cross-sectional width ISW of retention mechanism 660 that may be defined between opposite fingers 662 that may not be bent (e.g., between fingers 662*a* and 662*g*) may be any suitable magnitude, such as in a range between 10.56 millimeters and 10.96 millimeters or may be about 10.76 millimeters. An inner cross-sectional width IBW of retention mechanism 660 that may be defined between opposite fingers 662 that may be bent (e.g., between fingers 662*b* and 662*h*) may be any suitable magnitude, such as in a range between 9.57 millimeters and 9.97 millimeters or may be about 9.77 millimeters. A thickness RMT of retention mechanism 660 may be substantially consistent throughout and may be any suitable magnitude, such as in a range between 0.20 millimeters and 0.40 millimeters or may be about 0.30 millimeters.

Retention mechanism 660 may be positioned at any suitable position with respect to receptacle space 630*s* that may enable mechanism 660 to retain cable connector subassembly 400 in a particular position with respect to receptacle space 630*s*. For example, as shown, retention mechanism 660 may be positioned within a pocket 650 that may be defined by any suitable portion of receptacle 630 (e.g., as a portion of receptacle space 630*s*) or by any other portion of device subsystem 600. Pocket 650 may be adjacent a back wall 632 of receptacle 630 that may have a receptacle opening 630*o* provided therethrough (e.g., for exposing receptacle space 630*s* to cable connector subassembly 400). As shown, pocket 650 may be positioned in the +X-direction from contacts 610 and 620 such that front wall 476 of cable connector subassembly 400 may pass through pocket 650 after passing through receptacle opening 630*o*, but potentially before contacts 610 and 620 may pass through front wall 476. Pocket 650 may be at least partially defined by a side wall 654 extending between a back wall 652 and a front wall 658, where back wall 652 may extend at least partially about receptacle opening 660*o* (e.g., about an X-axis) and may face towards (e.g., in the −X-direction) front wall 658 of pocket 650, where front wall 658 may similarly extend at least partially about receptacle opening 660*o* (e.g., about an X-axis) and may face towards (e.g., in the +X-direction) back wall 652, and where side wall 654 may similarly extend at least partially about receptacle opening 660*o* (e.g., about an X-axis) and face inwardly towards that X-axis. Retention mechanism 660 may be positioned within pocket 650 such that anchor segments 668 and at least certain lead segments 664 may be operative to interact with (e.g., to contact or to be close to contacting) opposite portions of pocket 650. For example, as shown, each anchor segment 668 (e.g., plane PLN) of retention mechanism 660 may be positioned adjacent or contacting back wall 652 of pocket 650, while at least certain lead segments 664 (e.g., the lead segment 664 of each non-bent finger 662 (e.g., lead segments 664 of four (4) fingers 662*a*, 662*d*, 662*g*, and 662*j*)) may be positioned adjacent or contacting front wall 658 of pocket 650, such that at least non-bent fingers 662*a*, 662*d*, 662*g*, and 662*j* may be operative to prevent significant movement of retention mechanism along an X-axis due to the constraints of pocket 650. Moreover, as shown, certain other lead segments 664 may be operative to interact with cable connector subassembly 400 for preventing at least certain movement of cable connector subassembly 400 along the X-axis. For example, the lead segment 664 of each one of bent fingers 662*b*, 662*c*, 662*e*, 662*f*, 662*h*, 662*i*, 662*k*, and 662*l* may be operative to press against an exterior surface of cable connector subassembly 400 as it may be inserted into receptacle space 630*s* via receptacle opening 630*o* and through the hollow of the annulus of retention mechanism 660 (e.g., in the −X-direction, which may be along axis R of retention mechanism 660). For example, during such insertion, the lead segment 664 of each one of bent fingers 662*b*, 662*c*, 662*e*, 662*f*, 662*h*, 662*i*, 662*k*, and

662*l* may be operative to press initially against an exterior surface of outer body 470 (e.g., a curved lead contact surface 479 of outer body 470 may facilitate easy and smooth initial introduction of interface between cable connector subassembly 400 and retention mechanism 660) and then later against an exterior surface of lip portion 464 of body component 460 and then eventually against an exterior surface of rear portion 469 of body component 460 (e.g., as shown in FIG. 27).

However, due to the geometry of cable connector subassembly 400 and retention mechanism 660 (e.g., due to a bias of such bent fingers 662 and due to width BRW of rear portion 469 being less than width BLW of lip portion 464), once such lead segments 664 press against an exterior surface of rear portion 469 of body component 460, surface 452*s* may be operative to interact with such lead segments for preventing removal of cable connector subassembly 400 from receptacle space 630*s* (e.g., when a user pulls on cable connector subassembly 400 in the +X-direction). Bent fingers 662*b*, 662*c*, 662*e*, 662*f*, 662*h*, 662*i*, 662*k*, and 662*l* may be operative to exert any suitable force on the exterior surface of cable connector subassembly 400 as it passes through the hollow of retention mechanism 660 (e.g., along axis R) and may snap against the exterior surface of rear portion 469 after being enabled to deflect inwards (e.g., towards axis R) once the larger cross-sectioned lip portion 464 has passed fully beyond retention mechanism 660. Attempts to even partially remove cable connector subassembly 400 from receptacle space 630*s* in the +X-direction once cable connector subassembly 400 has been inserted into the position of FIG. 27 may result in base body surface 452*s* pressing against lead segments 664 of bent fingers 662*b*, 662*c*, 662*e*, 662*f*, 662*h*, 662*i*, 662*k*, and 662*l*, whereby such pressing force may be distributed along legs 663 and 665 of those bent fingers 662 to their associated anchor segments 668 that may distribute such force against back wall 652 of pocket 650. In some embodiments, such interaction between cable connector subassembly 400, retention mechanism 660, and pocket 650 may be configured to occur amongst all metal components. For example, as mentioned, base body surface 452*s* may be provided by an exposed portion of base body 452, which may be any suitable rigid material (e.g., stainless steel (e.g., SUS304 ½H)), while retention mechanism 660 may also be any suitable rigid material (e.g., stainless steel (e.g., SUS304 ½H)). Similarly, at least a portion of pocket 650 (e.g., back wall 652 and/or front wall 658 and/or side wall 654) may be provided by any suitable rigid material (e.g., stainless steel (e.g., SUS304 ½H)). For example, while receptacle 660 may be made of any suitable material, such as plastic, rubber, or the like, a rigid (e.g., metal) C-channel component 640 may be provided within pocket 650 for providing rigidity to its walls for interaction with retention mechanism 660. It is to be understood that while contacts 410 and 420 of connector subassembly 400 may be shown as female-type contacts and contacts 610 and 620 of device subsystem 600 may be shown as male-type contacts, retention mechanism 660 may similarly work to retain connector subassembly 400 with male contacts for interacting with female contacts within receptacle 630.

While retention mechanism 660 and pocket 650 and/or component 640 may be operative to interact with cable connector subassembly 400 (e.g., with base body surface 452*s*) for locking cable connector subassembly 400 with respect to receptacle 660 once cable connector subassembly 400 is initially inserted into receptacle space 660*s*, a special tool 690 may be provided for enabling removal of cable connector subassembly 400 from receptacle space 660*s* if need be. For example, tool 690 may be configured to include a leading member 692 that may be operative to be inserted (e.g., in the −X-direction) into a space between the exterior surface of rear portion 469 of body component 460 and one, some, or each segment 663, 665, and/or 664 of retention mechanism 660 to push those segments away from the exterior surface of rear portion 469 of body component 460 and towards side wall 654 (e.g., into pocket 650), such that cable connector subassembly 400 may be removed from receptacle space 630*s* through tool 690 and mechanism 660 (e.g., in the +X-direction). Therefore, retention mechanism 660 may enable at least a semi-permanent connection between cable connector subassembly 400 and device subsystem 600, which may be configured so as not to be broken by an end user of system 1 (e.g., tool 690 may not be provided to an end user and may only be used in a factory or the like for easier serviceability or manufacture of system 1). In some embodiments, trim component 490 (e.g., a front exterior surface 498) may be operative to interface with (e.g., snap into or be glued to or be press-fitted against) an exterior surface 632 of receptacle 630 or of any external portion of device subsystem 600 (e.g., a cut out portion 633). Such an interface between trim component 490 and exterior surface 632 may be operative to block or otherwise make inaccessible (e.g., by an end user) the opening used to introduce tool 690 between the exterior surface of cable connector subassembly 400 and retention mechanism 660. That exterior surface 632 may be shown in FIG. 26 but not in FIG. 27 (e.g., for clarity of use of tool 690).

Figure 31:
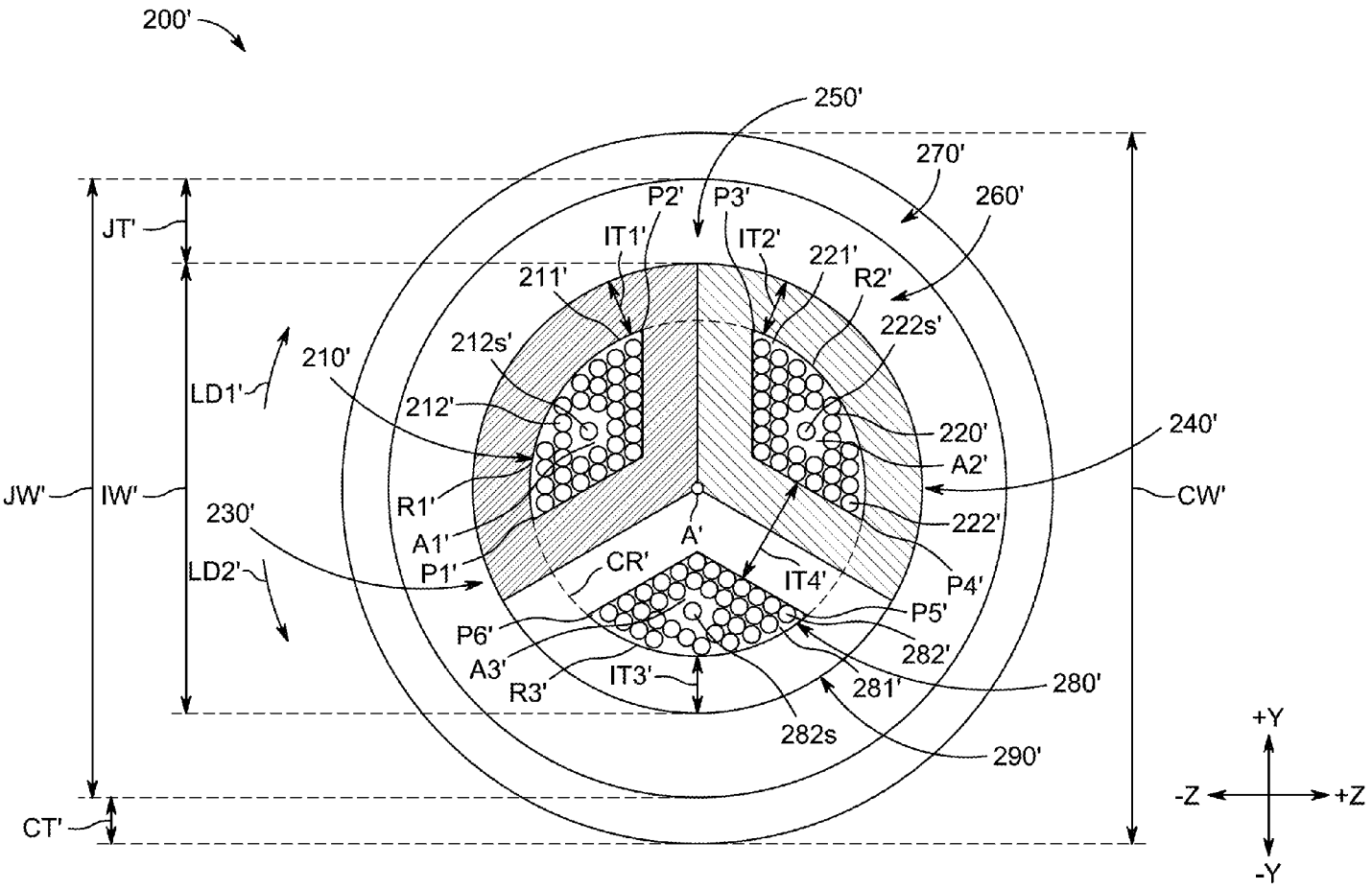
FIG. 31 is a first cross-sectional view of another cable subassembly.
Figure 31A:
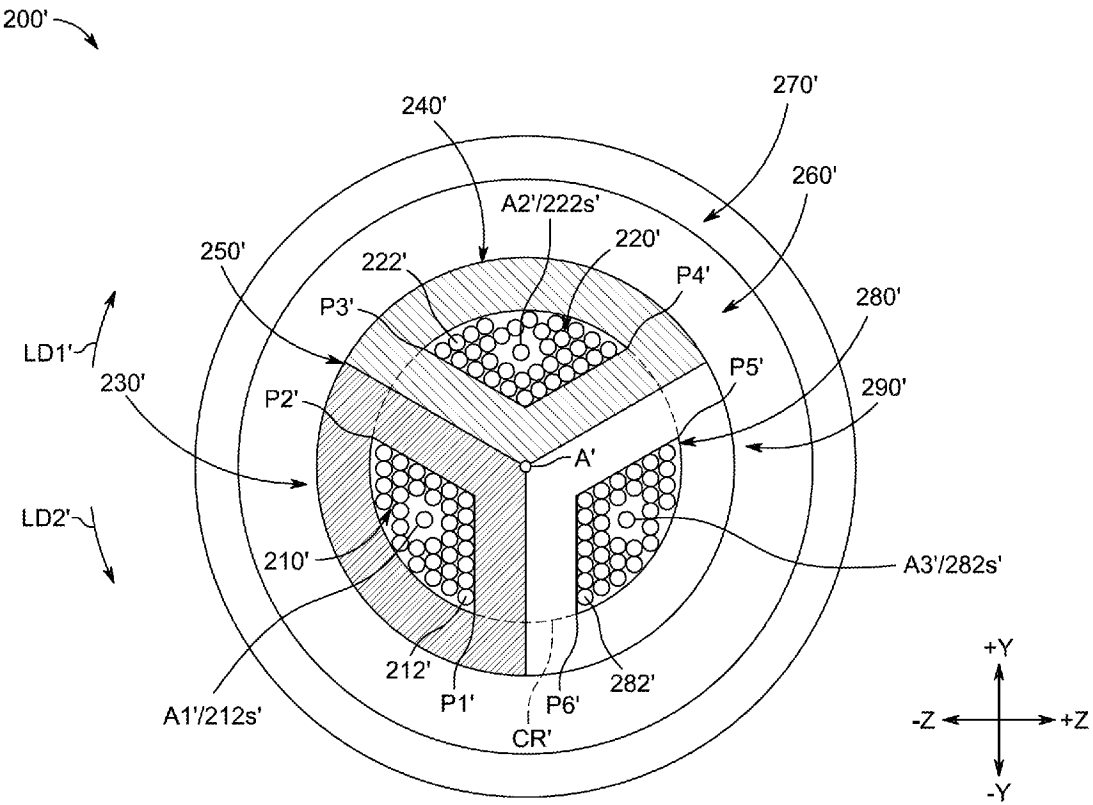
FIG. 31A is a second cross-sectional view of the cable subassembly of FIG. 31.
Figure 32:
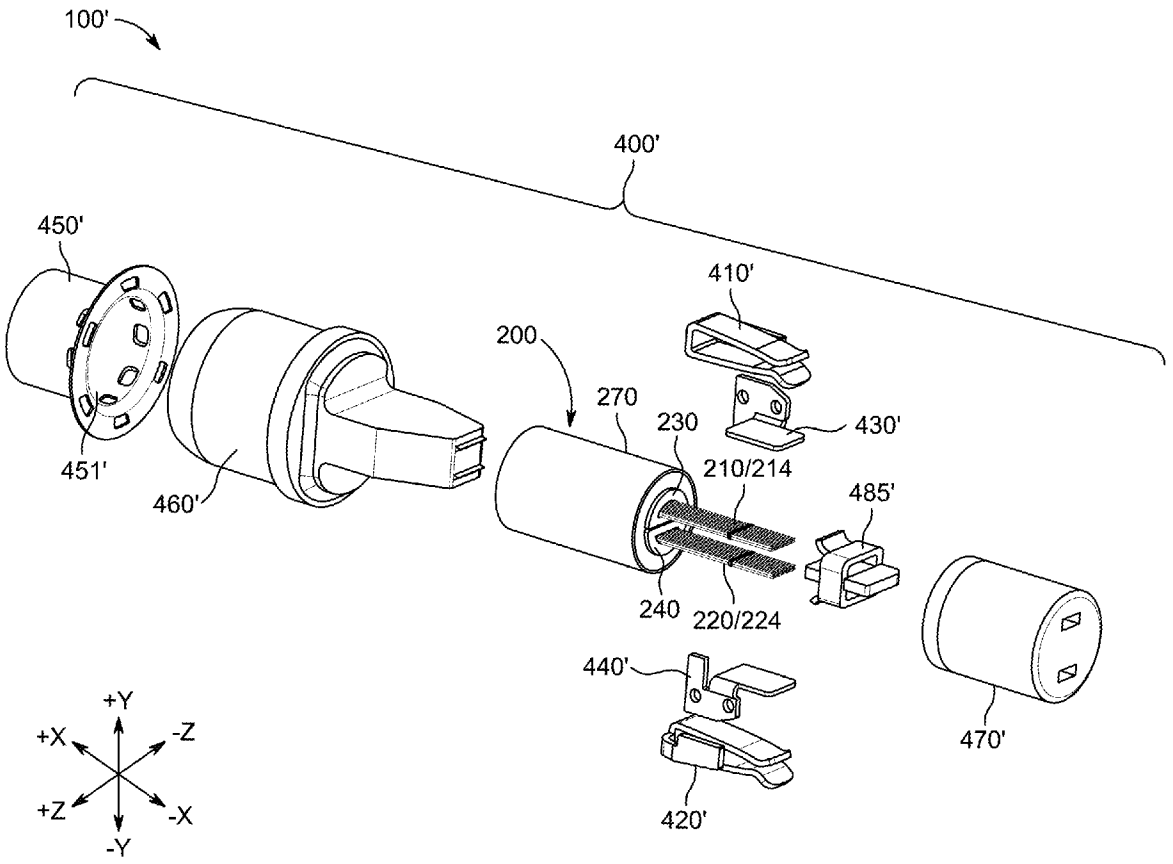
FIG. 32 is an exploded perspective view of another portion of the cable assembly of FIGS. 1-3 including another second cable connector subassembly.

As another example, when at least one or more of first cable connector subassembly 300, second cable connector subassembly 400, first device subsystem 500, and second device subsystem 600 may include at least three contacts (not shown), a cable subassembly may include at least three electrically isolated or insulated conductors or at least three electrically isolated or insulated groups of conductors, each of which may be operative to conduct any suitable data signals and/or any suitable power signals between a contact of first cable connector subassembly 300 and a respective contact of second cable connector subassembly 400. For example, as shown in FIGS. 31 and 31A, a cable subassembly 200' may be provided that may be similar to cable subassembly 200 but that may include not only a first group of conductors 210' (e.g., a first conductor subassembly or first conductor group) and a second group of conductors 220' (e.g., a second conductor subassembly or second conductor group), but also a third group of conductors 280' (e.g., a third conductor subassembly or third conductor group). Cable subassembly 200' may also include an insulation subassembly 250' that may be operative to electrically isolate or insulate each one of first conductor group 210', second conductor group 220', and third conductor group 280' from one another along at least a portion of the length of cable subassembly 200', a jacket 260', and/or a cover 270'. Insulation subassembly 250' may include a first insulation 230' that may be disposed about and along at least a portion of first conductor group 210' and/or a second insulation 240' that may be disposed about and along at least a portion of second conductor group 220' and/or a third insulation 290' that may be disposed about and along at least a portion of second conductor group 280'. Jacket 260' may be disposed about and along at least a portion of insulation subassembly 250', while cover 270' may be disposed about and along at least a portion of jacket 260'.

First conductor group 210' may extend along a length of cable subassembly 200' (e.g., along a first conductor group central axis A1' that may be adjacent to central longitudinal axis A' of cable subassembly 200') from a first end proximate a first cable end to an opposite second end proximate a second cable end. At a cross-section of cable subassembly 200' taken perpendicularly to axis A' (e.g., the cross-section of FIG. 31), central axis A1' of first conductor group 210' may be distanced from central longitudinal axis A' by a distance (e.g., similar to distance A1D of subassembly 200), which may be about 1.1 millimeters or may be in any suitable range, such as between about 0.9 millimeters and 1.5 millimeters. First conductor group 210' may include one or more conductors 212' that may be configured to electrically transmit signals between the ends of first conductor group 210'. Each conductor 212' may be any suitable electrically conductive conductor that may be composed of any suitable material including, but not limited to, copper (e.g., a soft copper (e.g., annealed soft bare copper wire), a tin-plated soft copper, a silver-plated copper alloy, etc.), aluminum, steel, and any combination thereof. Although FIG. 31 may only show forty-one (41) conductors 212' in first conductor group 210', it is to be understood that first conductor group 210' may include any suitable number of conductors 212', such as thirty-five (35) to forty-nine (49) conductors, or even just one (1) conductor, in some embodiments. Each conductor 212' may be of any suitable geometry and may have any suitable diameter (e.g., similar to diameter d1 of subassembly 200) or any other suitable cross-sectional width, which may be about 0.16 millimeters. Each conductor 212' may be any suitable American Wire Gauge (AWG), such as number 34 AWG, while first conductor group 210' may have an effective size with any suitable AWG, such as number 18 AWG, and while second conductor group 220' may have an effective size with any suitable AWG, such as number 18 AWG, and/or while third conductor group 280' may have an effective size with any suitable AWG, such as number 18 AWG.

First conductor group 210' (e.g., the collection of conductors 212') may be of any suitable shape (e.g., as may be defined by the geometry of a first interior region 211' within an interior surface of first insulation 230'), such as "pie-shaped" or a sector (e.g., circular sector) or a portion of a sector (e.g., a portion of a circular sector (e.g., a shape that may be defined by an arc of a disk and by two line segments or other suitably shaped arc joining segments that may be coupled together at respective first segment ends and that may each be coupled to a respective end of the arc at a respective second segment end, where the arc may be less than or greater than the circumference of the disk (e.g., the arc may be about $2/9^{th}$'s of the circumference of the disk (e.g., the central angle of the sector may be 80°)))) or the like in cross-section and, as shown in FIG. 31, may include an arc extending between points P1' and P2' along the circumference of a disk or circle CR'. Moreover, in some embodiments, as shown in FIG. 31, amidst the one or more conductors 212' of first conductor group 210' (e.g., within the space that may be defined by an interior surface of first insulation 230'), cable subassembly 200' may include at least one first support member 212s' (e.g., proximate central axis A1' of first conductor group 210') that may be provided to extend along at least a portion of the length of cable subassembly 200' for providing structural reinforcement or filler material, where each first support member may be composed of any suitable material, such as a para-aramid synthetic fiber (e.g., 1500 Denier Kevlar™ fiber). While first conductor group 210' may extend along second conductor group axis A1' (e.g., parallel to central longitudinal axis A' of cable subassembly 200'), one, some, or all conductors 212' of first conductor group 210' may be twisted in a lay direction about a twist axis of first conductor group 210' (e.g., first conductor group axis A1' or any other axis that may extend through first conductor group 210') along at least a portion of the length of first conductor group 210' (e.g., in a first lay direction of arrow LD1' about the twist axis of first conductor group 210' or in a second lay direction of arrow LD2' about the twist axis of first conductor group 210'). Regardless of the lay direction in which conductor(s) 212' of first conductor group 210' may be twisted about the twist axis of first conductor group 210', the lay length of each twisted conductor (i.e., the distance required for a single conductor 212' to be turned 360° about the twist axis of first conductor group 210') may be any suitable length, such as in a range between 30 millimeters and 60 millimeters, or a maximum length of 100 millimeters.

Second conductor group 220' may extend along a length of cable subassembly 200' (e.g., along a second conductor group central axis A2' that may adjacent to central longitudinal axis A') from a first end proximate the first cable end to an opposite second end proximate the second cable end. At a cross-section of cable subassembly 200' taken perpendicularly to axis A' (e.g., the cross-section of FIG. 31), central axis A2' of second conductor group 220' may be distanced from central longitudinal axis A' by a distance (e.g., similar to distance A2D of subassembly 200), which may be about 0.78 millimeters or may be in any suitable range, such as between about 0.73 millimeters and 0.83 millimeters. Second conductor group 220' may include one or more conductors 222' that may be configured to electrically transmit signals between the ends of second conductor group 220'. Each conductor 222' may be any suitable electrically conductive conductor that may be composed of any suitable material including, but not limited to, copper (e.g., a soft copper (e.g., annealed soft bare copper wire), a tin-plated soft copper, a silver-plated copper alloy, etc.), aluminum, steel, and any combination thereof. Although FIG. 31 may only show forty-one (41) conductors 222' in second conductor group 220', it is to be understood that second conductor group 220' may include any suitable number of conductors 222', such as thirty-five (35) to forty-nine (49) conductors, or even just one (1) conductor, in some embodiments. Each conductor 222' may be of any suitable geometry and may have any suitable diameter (e.g., similar to diameter d2 of subassembly 200) or any other suitable cross-sectional width, which may be about 0.16 millimeters. Each conductor 222' may be any suitable American Wire Gauge (AWG), such as number 34 AWG, while second conductor group 220' may have an effective size with any suitable AWG, such as number 18 AWG, and while first conductor group 210' may have an effective size with any suitable AWG, such as number 18 AWG, and/or while third conductor group 280' may have an effective size with any suitable AWG, such as number 18 AWG.

Second conductor group 220' (e.g., the collection of conductors 222') may be of any suitable shape (e.g., as may be defined by the geometry of a second interior region 221' within an interior surface of second insulation 240'), such as "pie-shaped" or a sector (e.g., circular sector) or a portion of a sector (e.g., a portion of a circular sector (e.g., a shape that may be defined by an arc of a disk and by two line segments or other suitably shaped arc joining segments that may be coupled together at respective first segment ends and that may each be coupled to a respective end of the arc at a respective second segment end, where the arc may be less than or greater than the circumference of the disk (e.g., the arc may be about $2/9^{th}$'s of the circumference of the disk (e.g., the central angle of the sector may be 80°)))) or the like in cross-section and, as shown in FIG. 31, may include an arc extending between points P3' and P4' along the circumference of disk or circle CR'. Moreover, in some embodiments, as shown in FIG. 31, amidst the one or more conductors 222' of second conductor group 220' (e.g., within the space that may be defined by an interior surface of second insulation 240'), cable subassembly 200' may include at least one second support member 222*s'* (e.g., proximate central axis A2' of second conductor group 220') that may be provided to extend along at least a portion of the length of cable subassembly 200' for providing structural reinforcement or filler material, where each second support member may be composed of any suitable material, such as a para-aramid synthetic fiber (e.g., 1500 Denier Kevlar™ fiber). While second conductor group 220' may extend along second conductor group axis A2' (e.g., parallel to central longitudinal axis A' of cable subassembly 200'), one, some, or all conductors 222' of second conductor group 220' may be twisted in a lay direction about a twist axis of second conductor group 220' (e.g., second conductor group axis A2' or any other axis that may extend through second conductor group 220') along at least a portion of the length of second conductor group 220' (e.g., in a first lay direction of arrow LD1' about the twist axis of second conductor group 220' or in a second lay direction of arrow LD2' about the twist axis of second conductor group 220'). Regardless of the lay direction in which conductor(s) 222' of second conductor group 220' may be twisted about the twist axis of second conductor group 220', the lay length of each twisted conductor (i.e., the distance required for a single conductor 222' to be turned 360° about the twist axis of second conductor group 220') may be any suitable length, such as in a range between 30 millimeters and 60 millimeters, or a maximum length of 100 millimeters.

Third conductor group 280' may extend along a length of cable subassembly 200' (e.g., along a third conductor group central axis A3' that may adjacent to central longitudinal axis A') from a first end proximate the first cable end to an opposite second end proximate the second cable end. At a cross-section of cable subassembly 200' taken perpendicularly to axis A' (e.g., the cross-section of FIG. 31), central axis A3' of third conductor group 280' may be distanced from central longitudinal axis A' by a distance, which may be about 0.78 millimeters or may be in any suitable range, such as between about 0.73 millimeters and 0.83 millimeters. Third conductor group 280' may include one or more conductors 282' that may be configured to electrically transmit signals between the ends of third conductor group 280'. Each conductor 282' may be any suitable electrically conductive conductor that may be composed of any suitable material including, but not limited to, copper (e.g., a soft copper (e.g., annealed soft bare copper wire), a tin-plated soft copper, a silver-plated copper alloy, etc.), aluminum, steel, and any combination thereof. Although FIG. 31 may only show forty-one (41) conductors 282' in third conductor group 280', it is to be understood that third conductor group 280' may include any suitable number of conductors 282', such as thirty-five (35) to forty-nine (49) conductors, or even just one (1) conductor, in some embodiments. Each conductor 282' may be of any suitable geometry and may have any suitable diameter or any other suitable cross-sectional width, which may be about 0.16 millimeters. Each conductor 282' may be any suitable American Wire Gauge (AWG), such as number 34 AWG, while third conductor group 280' may have an effective size with any suitable AWG, such as number 18 AWG, and while first conductor group 210' may have an effective size with any suitable AWG, such as number 18 AWG, and/or while second conductor group 220' may have an effective size with any suitable AWG, such as number 18 AWG.

Third conductor group 280' (e.g., the collection of conductors 282') may be of any suitable shape (e.g., as may be defined by the geometry of a third interior region 281' within an interior surface of third insulation 290'), such as "pie-shaped" or a sector (e.g., circular sector) or a portion of a sector (e.g., a portion of a circular sector (e.g., a shape that may be defined by an arc of a disk and by two line segments or other suitably shaped arc joining segments that may be coupled together at respective first segment ends and that may each be coupled to a respective end of the arc at a respective second segment end, where the arc may be less than or greater than the circumference of the disk (e.g., the arc may be about $2/9^{th}$'s of the circumference of the disk (e.g., the central angle of the sector may be 80°)))) or the like in cross-section and, as shown in FIG. 31, may include an arc extending between points P5' and P6' along the circumference of disk or circle CR'. Moreover, in some embodiments, as shown in FIG. 31, amidst the one or more conductors 282' of third conductor group 280' (e.g., within the space that may be defined by an interior surface of third insulation 290'), cable subassembly 200' may include at least one third support member 282*s'* (e.g., proximate central axis A3' of third conductor group 280') that may be provided to extend along at least a portion of the length of cable subassembly 200' for providing structural reinforcement or filler material, where each third support member may be composed of any suitable material, such as a para-aramid synthetic fiber (e.g., 1500 Denier Kevlar™ fiber). While third conductor group 280' may extend along third conductor group axis A3' (e.g., parallel to central longitudinal axis A' of cable subassembly 200'), one, some, or all conductors 282' of third conductor group 280' may be twisted in a lay direction about a twist axis of third conductor group 280' (e.g., third conductor group axis A3' or any other axis that may extend through third conductor group 280') along at least a portion of the length of third conductor group 280' (e.g., in a first lay direction of arrow LD1' about the twist axis of third conductor group 280' or in a second lay direction of arrow LD2' about the twist axis of third conductor group 280'). Regardless of the lay direction in which conductor(s) 282' of third conductor group 280' may be twisted about the twist axis of third conductor group 280', the lay length of each twisted conductor (i.e., the distance required for a single conductor 282' to be turned 360° about the twist axis of third conductor group 280') may be any suitable length, such as in a range between 30 millimeters and 60 millimeters, or a maximum length of 100 millimeters. While FIG. 31 may show interior region 211' of first conductor group 210', interior region 221' of second conductor group 220', and interior region 281' of third conductor group 280' to be shaped similarly to each other, and while FIG. 31 may show conductor 212', conductor 222', and conductor 282' to be shaped similarly to each other, it is to be understood that first conductor group 210', second conductor group 220', and third conductor group 280' may each be shaped differently and may each include different numbers of conductors of different sizes and/or shapes (e.g., first conductor group 210' may include an arc that may be about $2/9^{th}$'s of the circumference of the disk (e.g., the central angle of the sector may be 80°), second conductor group 220' may include an arc that may be about $1/9^{th}$'s of the circumference of the disk (e.g., the central angle of the sector may be 40°), and third conductor group 280' may include an arc that may be about 3/9th's of the circumference of the disk (e.g., the central angle of the sector may be 120°)).

Insulation subassembly 250' may include first insulation 230', which may be disposed about and along at least a portion of first conductor group 210', second insulation 240', which may be disposed about and along at least a portion of second conductor group 220', and/or third insulation 290', which may be disposed about and along at least a portion of third conductor group 280', such that insulation subassembly 250' may be operative to electrically isolate or insulate the conductor groups from one another along at least a portion of the length of cable subassembly 200'. Insulation 230' and/or insulation 240' and/or insulation 290' may be any suitable insulating material or materials of any suitable structure that may be formed by any suitable technique or techniques. For example, one, some, or each of insulation 230', insulation 240', and insulation 290' may be any suitable polymeric tape that may include a polymeric sheet that may optionally include an adhesive portion on one or both surfaces. Such a polymeric sheet may be constructed from any suitable plastic, such as polyethylene terephthalate (e.g., PET, such as Mylar™), Kapton™ tape, and the like. Such a sheet may be wrapped around a particular conductor group or both conductor groups in any suitable manner and may be wrapped in any suitable lay direction with respect to any suitable axis (e.g., axis A', A1D', A2D', A3D', etc.). Alternatively or additionally, one, some, or each of insulation 230', insulation 240', and insulation 290' may be extruded about a particular conductor group or two or more conductor groups in any suitable manner. One, some, or each of insulation 230', insulation 240', and insulation 290' may be any suitable material or combination of materials, including, but not limited to, plastics, rubbers, fluoropolymers, which may be foamed. The geometry of insulation 230', insulation 240', and insulation 290' may be formed as a single component or as two or three or more distinct components.

Insulation subassembly 250' may have any suitable geometry for providing appropriate insulation based on the materials of cable subassembly 200' and/or the intended use of cable subassembly 200'. In some embodiments, as shown, first insulation 230' may have a thickness IT1', which may be any suitable thickness, such as a thickness in a range between 0.33 millimeters and 0.43 millimeters, or an average thickness of about 0.38 millimeters. The magnitude of thickness IT1' may be substantially consistent about the entirety of first interior region 211' (e.g., in a cross-section, such as in the cross-section of FIG. 31 and/or in the cross-section of FIG. 31A, where those two cross-sections of subassembly 200' may have a similar relationship to the cross-sections of subassembly 200 of FIGS. 2 and 3), for example, such that the minimum magnitude of thickness IT1' may be 0.33 millimeters and/or such that the minimum average magnitude of thickness IT1' about first interior region 211' may be 0.38 millimeters. Additionally or alternatively, as shown, second insulation 240' may have a thickness IT2', which may be any suitable thickness, such as a thickness in a range between 0.33 millimeters and 0.43 millimeters, or an average thickness of about 0.38 millimeters. The magnitude of thickness IT2' may be substantially consistent about the entirety of second interior region 221' (e.g., in a cross-section, such as in the cross-section of FIG. 31 and/or in the cross-section of FIG. 31A), for example, such that the minimum magnitude of thickness IT2' may be 0.33 millimeters and/or such that the minimum average magnitude of thickness IT2' about second interior region 221' may be 0.38 millimeters. Additionally or alternatively, as shown, third insulation 290' may have a thickness IT3', which may be any suitable thickness, such as a thickness in a range between 0.33 millimeters and 0.43 millimeters, or an average thickness of about 0.38 millimeters. The magnitude of thickness IT3' may be substantially consistent about the entirety of third interior region 281' (e.g., in a cross-section, such as in the cross-section of FIG. 31 and/or in the cross-section of FIG. 31A), for example, such that the minimum magnitude of thickness IT3' may be 0.33 millimeters and/or such that the minimum average magnitude of thickness IT3' about third interior region 281' may be 0.38 millimeters. Therefore, in some embodiments, a particular portion of insulation subassembly 250' may provide a thickness IT4' between two of first interior region 211', second interior region 221', and third interior region 281' (e.g., between two of first conductor group 210', second conductor group 220', and third conductor group 280') for electrically isolating or insulating conductor(s) 212', conductor(s) 222', and conductor(s) 282' from each another, where thickness IT4' may be any suitable thickness, such as a thickness in a range between 0.50 millimeters and 0.65 millimeters, or a minimum average thickness of about 0.38 millimeters.

While first conductor group 210', second conductor group 220', and third conductor group 280' may, respectively, extend along first conductor group axis A1', second conductor group axis A2', and third conductor group axis A3' (e.g., parallel to central longitudinal axis A' of cable subassembly 200'), first conductor group 210', second conductor group 220', and third conductor group 280' may together be twisted (e.g., along with insulation subassembly 250') in a first lay direction about central longitudinal axis A' along the length of at least a portion of cable subassembly 200'. For example, as shown in the differences between FIG. 31 and FIG. 31A, first conductor group 210', second conductor group 220', and third conductor group 280' may be twisted in a lay direction about central longitudinal axis A' or any other suitable twist axis of subassembly 200' along at least a portion of the length of cable subassembly 200' (e.g., in a first lay direction of arrow LD1' about the twist axis of subassembly 200' or in a second lay direction of arrow LD2' about the twist axis of subassembly 200'). Regardless of the lay direction in which each one of conductor groups 210', 220', and 280' may be twisted about axis A' or any other suitable twist axis of subassembly 200', the lay length of one, some, or all conductors of first conductor group 210' and/or of second conductor group 220' and/or of third conductor group 280' (i.e., the distance required for a single conductor to be turned 360° about the twist axis of subassembly 200') may be any suitable length, such as in a range between 30 millimeters and 60 millimeters, or a maximum length of 100 millimeters. With respect to FIG. 31, for example, regardless of whether the lay direction in which first conductor group 210', second conductor group 220', and third conductor group 280' may together be twisted about axis A' or any other suitable twist axis of subassembly 200' is the direction of arrow LD1' or LD2', the lay direction in which conductors 212' of group 210' may be twisted about a twist axis of group 210' may be either the direction of arrow LD1' or LD2', and the lay direction in which conductors 222' of group 220' may be twisted about a twist axis of group 220' may be either the direction of arrow LD1' or LD2', and the lay direction in which conductors 282' of group 280' may be twisted about a twist axis of group 280' may be either the direction of arrow LD1' or LD2'. In some embodiments, as shown, first conductor group 210' and second conductor group 220' may extend parallel to one another along longitudinal axis A' (e.g., center axis A1' of first conductor group 210' and center axis A2' of second conductor group 220' may always be separated from one another by a distance, which may be substantially the same along at least a portion of the length of subassembly 200'), and/or first conductor group 210' and third conductor group 280' may extend parallel to one another along longitudinal axis A' (e.g., center axis A1' of first conductor group 210' and center axis A3' of third conductor group 280' may always be separated from one another by a distance, which may be substantially the same along at least a portion of the length of subassembly 200'), and/or second conductor group 220' and third conductor group 280' may extend parallel to one another along longitudinal axis A' (e.g., center axis A2' of second conductor group 220' and center axis A3' of third conductor group 280' may always be separated from one another by a distance, which may be substantially the same along at least a portion of the length of subassembly 200'). Therefore, a central axis of each one of first conductor group 210', second conductor group 220', and third conductor group 280' may be removed from longitudinal axis A' of cable subassembly 200' at any cross-section along the length of cable subassembly 200' (e.g., as shown in FIG. 31 and FIG. 31A). For example, the distance between central axis A1' and longitudinal axis A' in the cross-section of FIG. 31 may be the same or substantially the same as the distance between central axis A1' and longitudinal axis A' in the cross-section of FIG. 31A, where in each cross-section, central axis A1' of first conductor group 210' may extend through the centroid or geometric center of first conductor group 210' in that cross-section, and where central longitudinal axis A' of cable subassembly 200' may extend through the centroid or geometric center of cable subassembly 200' in that cross-section. Additionally or alternatively, the distance between central axis A2' and longitudinal axis A' in the cross-section of FIG. 31 may be the same or substantially the same as the distance between central axis A2' and longitudinal axis A' in the cross-section of FIG. 31A, where in each cross-section, central axis A2' of second conductor group 220' may extend through the centroid or geometric center of second conductor group 220' in that cross-section, and where central longitudinal axis A' of cable subassembly 200' may extend through the centroid or geometric center of cable subassembly 200' in that cross-section. Additionally or alternatively, the distance between central axis A3' and longitudinal axis A' in the cross-section of FIG. 31 may be the same or substantially the same as the distance between central axis A3' and longitudinal axis A' in the cross-section of FIG. 31A, where in each cross-section, central axis A3' of third conductor group 280' may extend through the centroid or geometric center of third conductor group 280' in that cross-section, and where central longitudinal axis A' of cable subassembly 200' may extend through the centroid or geometric center of cable subassembly 200' in that cross-section. Additionally or alternatively, the distance between central axis A1' and central axis A2' in the cross-section of FIG. 31 may be the same or substantially the same as the distance between central axis A1' and central axis A2' in the cross-section of FIG. 31A, where in each cross-section, central axis A1' of first conductor group 210' may extend through the centroid or geometric center of first conductor group 210' in that cross-section, and where in each cross-section, central axis A2' of second conductor group 220' may extend through the centroid or geometric center of second conductor group 220' in that cross-section. Additionally or alternatively, the distance between central axis A1' and central axis A3' in the cross-section of FIG. 31 may be the same or substantially the same as the distance between central axis A1' and central axis A3' in the cross-section of FIG. 31A, where in each cross-section, central axis A1' of first conductor group 210' may extend through the centroid or geometric center of first conductor group 210' in that cross-section, and where in each cross-section, central axis A3' of third conductor group 280' may extend through the centroid or geometric center of third conductor group 280' in that cross-section. Additionally or alternatively, the distance between central axis A3' and central axis A2' in the cross-section of FIG. 31 may be the same or substantially the same as the distance between central axis A3' and central axis A2' in the cross-section of FIG. 31A, where in each cross-section, central axis A3' of third conductor group 280' may extend through the centroid or geometric center of third conductor group 280' in that cross-section, and where in each cross-section, central axis A2' of second conductor group 220' may extend through the centroid or geometric center of second conductor group 220' in that cross-section. In some embodiments, the distance between longitudinal axis A' and central axis A1' may be the same or substantially the same as the distance between longitudinal axis A' and central axis A2' and/or may be the same or substantially the same as the distance between longitudinal axis A' and central axis A3', either in one cross-section, some cross-sections, or all cross-sections. In some embodiments, the distance between central axis A1' and central axis A2' may be the same or substantially the same as the distance between central axis A1' and central axis A3' and/or may be the same or substantially the same as the distance between central axis A2' and central axis A3', either in one cross-section, some cross-sections, or all cross-sections.

Cable subassembly 200' may be assembled using any suitable procedure(s). In some embodiments, any suitable number of conductors 212' may be twisted in a particular lay direction (e.g., about the twist axis of first conductor group 210') to form a twisted collection of conductors that may be in any suitable geometry (e.g., a circular cross-sectional geometry). Then that collection of conductors 212' may be formed into a desired shape (e.g., a pie-shape) by putting at least a portion of that twisted collection of conductors 212' through a die or roller(s) of the shape (e.g., in any suitable extrusion process). Then, that shaped and twisted collection may be provided as group 210' and may have insulation 230' provided about that group 210'. A similar process may be done to provide insulation 240' about group 220' and/or to provide insulation 290' about group 280'. Then, each one of insulated groups 210', 220', and 280' may be put through a respective aligning die (e.g., such that an arc of each shaped and twisted collection of conductors defines a particular part of a circumference of a circle (e.g., a circle CR' of FIG. 31 (e.g., a circle with a center that may be a point along the twist axis of subassembly 200'))) and then they may be twisted together about any suitable twist axis of subassembly 200', such as longitudinal axis A' or any other suitable axis that may extend through a space within which the aligning dies are twisted, where adhesive may or may not be provided between any two or more of insulated groups 210', 220', and 280' prior, during, or after the twisting of the insulated groups. Jacket 260' may then be provided to fix the twisted relationship of insulated groups 210', 220', and 280'.

Jacket 260' may be disposed around insulation subassembly 250' along a length of cable subassembly 200'. Jacket 260' may be any suitable insulating and/or conductive material that may be provided (e.g., extruded) about insulation subassembly 250' for protecting the internal structure of cable subassembly 200' from environmental threats (e.g., impact damage, debris, heat, fluids, and/or the like). For example, jacket 260' may be a thermoplastic copolyester ("TPC") (e.g., Arnitel™ XG5857) that can be extruded around the outer periphery of insulation subassembly 250'. Jacket 260' may be provided around the outer periphery of insulation subassembly 250' with any suitable thickness JT and may provide an overall jacket diameter (or any other suitable cross-sectional width) JW'. For example, in some embodiments, thickness JT of jacket 260' may have any suitable magnitude, such as a thickness in a range between 0.61 millimeters and 0.96 millimeters, or an average thickness of about 0.76 millimeters. The magnitude of thickness JT may be substantially consistent about the entirety of insulation subassembly 250' (e.g., in a cross-section, such as in the cross-section of FIG. 31 and/or in the cross-section of FIG. 31A), for example, such that the minimum magnitude of thickness JT may be 0.60 millimeters and/or such that the minimum average magnitude of thickness JT about insulation subassembly 250' may be 0.76 millimeters. Additionally or alternatively, maximum cross-sectional width JW' of jacket 260' may have any suitable magnitude, such as a width in a range between 5.7 millimeters and 6.5 millimeters, or about 6.0 millimeters. Jacket 260' may be operative to provide the outermost layer for at least a portion of cable subassembly 200' and may include any suitable surface finish (e.g., SPI Finish-D2).

Alternatively, in some embodiments, a cover 270' may be disposed around jacket 260' along a length of cable subassembly 200', such that cover 270' may be operative to provide the outer most layer for at least a portion of cable subassembly 200'. Cover 270' may be any suitable insulating and/or conductive material that may be provided (e.g., braided) about jacket 260' for protecting the internal structure of cable subassembly 200' from environmental threats (e.g., impact damage, debris, heat, fluids, and/or the like). For example, cover 270' may be a nylon and/or polyester that may be braided about the outer periphery of jacket 260'. Cover 270' may be provided around the outer periphery of jacket 260' with any suitable thickness CT and may provide an overall cover diameter or any other suitable cross-sectional width CW'. For example, in some embodiments, thickness CT of cover 270' may have any suitable magnitude, such as a thickness in a range between 0.1 millimeters and 0.5 millimeters, or an average thickness of about 0.2 millimeters. The magnitude of thickness CT may be substantially consistent about the entirety of jacket 260' (e.g., in a cross-section, such as in the cross-section of FIG. 31 and/or in the cross-section of FIG. 31A), for example, such that the average magnitude of thickness CT about jacket 260' may be 0.2 millimeters. Additionally or alternatively, maximum cross-sectional width CW' of cover 270' may have any suitable magnitude, such as a width in a range between 6.1 millimeters and 6.9 millimeters, or about 6.4 millimeters.

Insulation subassembly 250' may at least partially define and retain the cross-sectional shape of each one of first conductor group 210', second conductor group 220', and third conductor group 280' as similar shapes, complimentary shapes, or different shapes. In some embodiments, as shown in FIGS. 31 and 31A, for example, first interior region 211' of first insulation 230' about first conductor group 210' may have a cross-sectional area with a first pie-shape (e.g., an outer periphery of first conductor group 210' in the cross-section of FIG. 31A may define a shape of a portion of a circular sector with an arc R1' extending between points P1' and P2'), while second interior region 221' of second insulation 240' about second conductor group 220' may have a cross-sectional area with a second pie-shape (e.g., an outer periphery of second conductor group 220' in the cross-section of FIG. 31A may define a shape of a portion of a circular sector with an arc R2' extending between points P3' and P4'), while third interior region 281' of third insulation 290' about third conductor group 280' may have a cross-sectional area with a third pie-shape (e.g., an outer periphery of third conductor group 280' in the cross-section of FIG. 31A may define a shape of a portion of a circular sector with an arc R3' extending between points P5' and P6'). The shape of first interior region 211' about first conductor group 210' may be defined by at least a first portion of a surface of insulation subassembly 250' (e.g., insulation 230'), whereas the shape of first interior region 221' about second conductor group 220' may be defined by at least a second portion of a surface of insulation subassembly 250' (e.g., insulation 240'), and whereas the shape of third interior region 281' about third conductor group 280' may be defined by at least a third portion of a surface of insulation subassembly 250' (e.g., insulation 290'). In some embodiments, as shown, insulation subassembly 250' may be configured to position first interior region 211' with respect to second interior region 221' and third interior region 281' such that significant portions of the cross-sectional shapes of interior regions 211', 221', and 281' may combine to form a significant portion of a circular shape, thereby reducing the cross-sectional area inhabited by interior regions 211', 221', and 281'. For example, as shown in FIG. 31, each one of arc R1' of interior region 211' and arc R2' of interior region 221' and arc R3' of interior region 281' may define a particular portion of a circumference of circle CR' (e.g., the entirety or substantially the entirety of arc R1' may define a portion of a circle's circumference that may also be partially defined by the entirety or substantially the entirety of arc R2' and by the entirety or substantially the entirety of arc R3'). This may allow insulation subassembly 250' to have a circular cross-section with a reduced cross-sectional diameter IW' while also packing as many conductors (e.g., conductors 212', 222', and 282') as possible within the interior of insulation subassembly 250' (e.g., as compared to a cable subassembly in which each one of interior regions 211', 221', and 281' may be circular yet also separated from one another by a particular distance IT4', which results in a larger cross-sectional diameter IW'). Various other shapes and geometries may be provided to enable such reduction in the overall size of cable subassembly 200'. For example, rather than being defined by an arc and two straight arc joining segments, each interior region may be defined by a curve similar to an arc but, rather than also being defined by two straight arc joining segments that are coupled together and that extend from respective ends of the arc, one, some, or each interior region may be defined by one or more non-straight arc joining segments.

Therefore, cable subassembly 200' may be configured to provide a cable that may be safely used with cable assembly 100 as an AC power cordset that may have any suitable electrical rating, such as an electrical rating of 10 A, 125 VAC. In some embodiments, such a cable subassembly 200' may be operative to meet the requirements of UL Standard 62 (e.g., each one of IT1', IT2', and IT3' may include about 0.33 millimeter minimum thickness and 0.38 millimeter minimum average thickness with a 35 millimeter lay length max (right), JT may include about 0.61 millimeter minimum thickness and 0.76 millimeter minimum average thickness, group 210' may include about 41 conductors 212' with a diameter of about 0.16 millimeters and 20 millimeter lay length max (right) and filler 212*s*' of about 1500D aramid fiber, and/or group 220' may include about 41 conductors 222' with a diameter of about 0.16 millimeters and 20 millimeter lay length max (right) and filler 222*s*' of about 1500D aramid fiber, and/or group 280' may include about 41 conductors 282' with a diameter of about 0.16 millimeters and 20 millimeter lay length max (right) and filler 282*s*' of about 1500D aramid fiber, which may enable a JW' of about 4.85 millimeters+/−0.10 millimeters). Additionally or alternatively, in some embodiments, such a cable subassembly 200' may be operative to meet the requirements of any other suitable standard. For example, cable subassembly 200' may be operative to meet the requirements of EN50525/IEC62821 (e.g., each one of IT1', IT2', and IT3' may include about 0.35 millimeter minimum thickness and 0.50 millimeter minimum average thickness with a 70 millimeter lay length max (right), JT may include about 0.41 millimeter minimum thickness and 0.60 or 0.65 millimeter minimum average thickness, group 210' may include about 67 conductors 212' with a diameter of about 0.12 millimeters and 20 millimeter+/−5 millimeter lay length max (right) and filler 212*s*' of about 1000D aramid fiber, and/or group 220' may include about 67 conductors 222' with a diameter of about 0.12 millimeters and 20 millimeter+/−5 millimeter lay length max (right) and filler 222*s*' of about 1000D aramid fiber, and/or group 280' may include about 67 conductors 282' with a diameter of about 0.12 millimeters and 20 millimeter+/−5 millimeter lay length max (right) and filler 282*s*' of about 1000D aramid fiber, which may enable a JW' of about 4.91 millimeters+/−0.10 millimeters). As another example, cable subassembly 200' may be operative to meet the requirements of JCS 4509 (e.g., each one of IT1', IT2', and IT3' may include about 0.48 millimeter minimum thickness and 0.54 millimeter minimum average thickness with a 46 millimeter lay length max (right), JT may include about 0.70 millimeter minimum thickness and 0.90 millimeter minimum average thickness, group 210' may include about 67 conductors 212' with a diameter of about 0.12 millimeters and 20 millimeter lay length max (right) and filler 212*s*' of about 200D or 1000D aramid fiber, and/or group 220' may include about 67 conductors 222' with a diameter of about 0.12 millimeters and 20 millimeter lay length max (right) and filler 222*s*' of about 200D or 1000D aramid fiber, and/or group 280' may include about 67 conductors 282' with a diameter of about 0.12 millimeters and 20 millimeter lay length max (right) and filler 282*s*' of about 200D or 1000D aramid fiber, which may enable a JW' of about 5.32 millimeters+/−0.10 millimeters). As another example, cable subassembly 200' may be operative to meet the requirements of IS 694 (e.g., each one of IT1', IT2', and IT3' may include about 0.44 millimeter minimum thickness and 0.60 millimeter minimum average thickness with a 70 millimeter lay length max (right), JT may include about 0.52 millimeter minimum thickness and 0.90 millimeter minimum average thickness, group 210' may include about 24 conductors 212' with a diameter of about 0.20 millimeters and 20 millimeter lay length max (right) and filler 212*s*' of about 200D or 1000D aramid fiber, and/or group 220' may include about 24 conductors 222' with a diameter of about 0.20 millimeters and 20 millimeter lay length max (right) and filler 222*s*' of about 200D or 1000D aramid fiber, and/or group 280' may include about 24 conductors 282' with a diameter of about 0.20 millimeters and 20 millimeter lay length max (right) and filler 282*s*' of about 200D or 1000D aramid fiber, which may enable a JW' of about 5.82 millimeters+/−0.10 millimeters).

Figure 36:
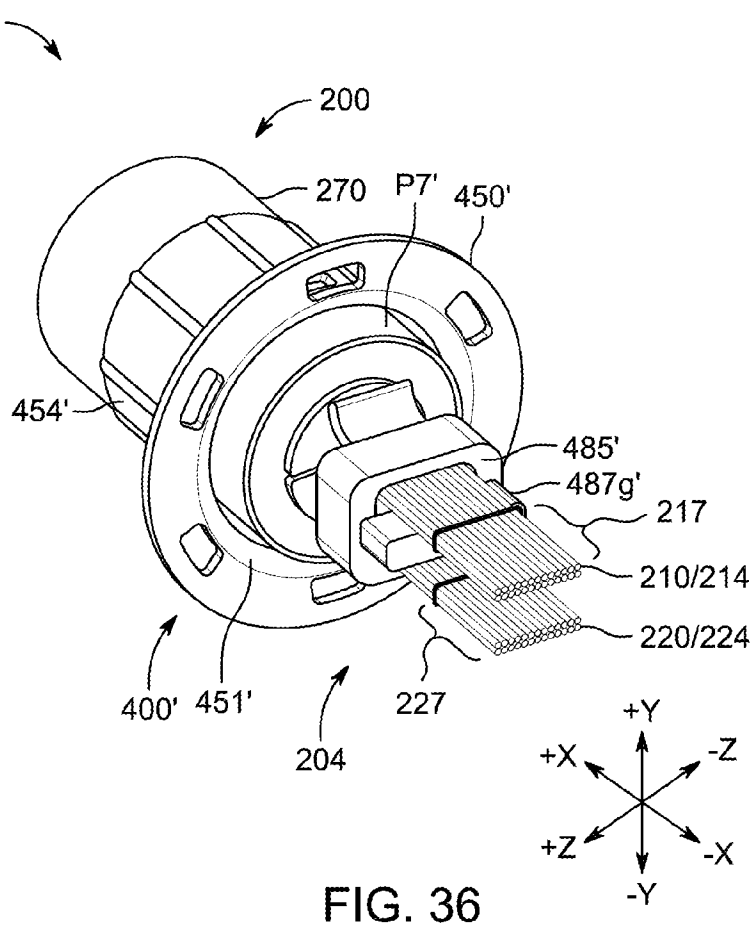
FIG. 36 is a perspective view of the portion of the cable assembly of FIGS. 32-35 in a fourth stage of assembly.
Figure 38:
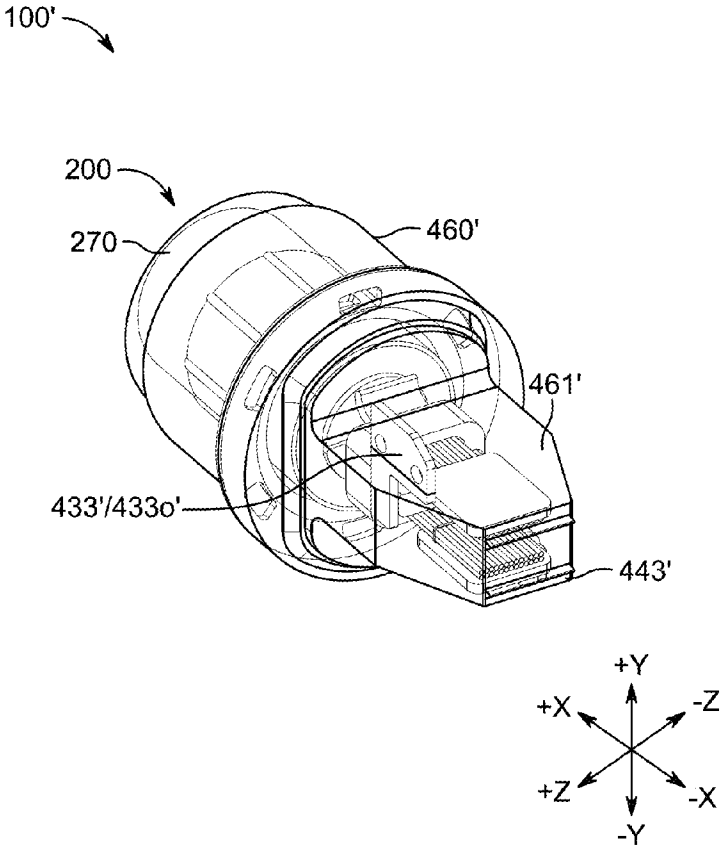
FIG. 38 is a perspective view of the portion of the cable assembly of FIGS. 32-37 in a sixth stage of assembly.
Figure 37:
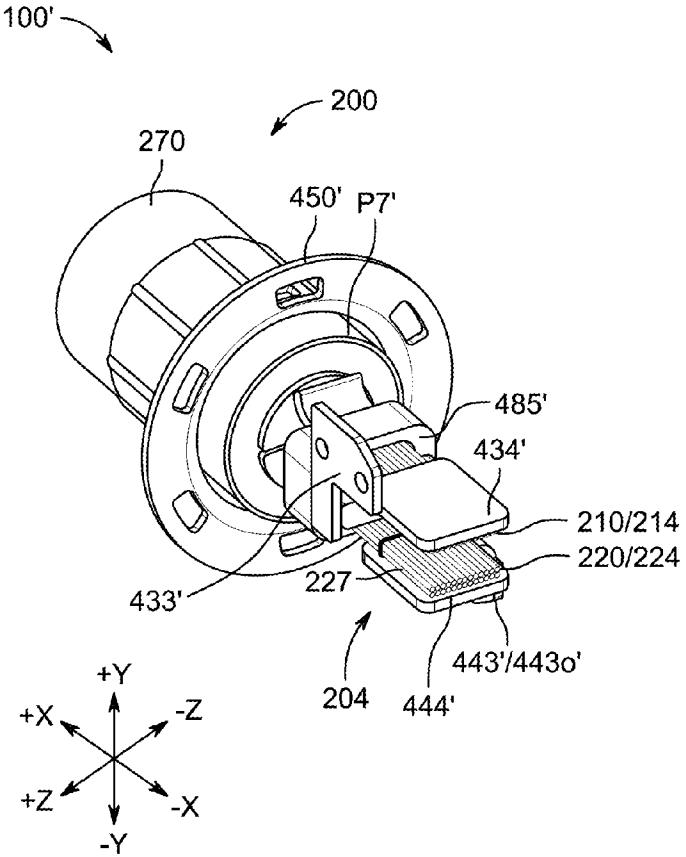
FIG. 37 is a perspective view of the portion of the cable assembly of FIGS. 32-36 in a fifth stage of assembly.
Figure 39:
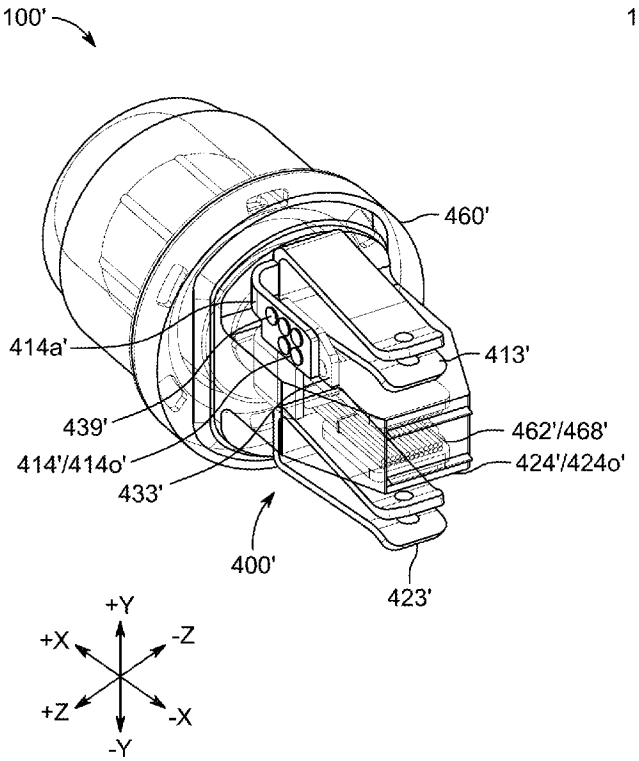
FIG. 39 is a perspective view of the portion of the cable assembly of FIGS. 32-38 in a seventh stage of assembly.

As shown in FIGS. 32-43, another second cable connector subassembly 400' may be provided that may be similar to second cable connector subassembly 400 but that may be electrically coupled to one or more conductor groups of a cable subassembly in a different manner (e.g., using different conductor contacts). For example, as shown, a cable assembly 100' may be similar to cable assembly 100 and may include cable subassembly 200 but may also include second cable connector subassembly 400' coupled to end 204 of cable subassembly 200 rather than second cable connector subassembly 400 coupled to end 204 of cable subassembly 200. Second cable connector subassembly 400' may include at least two device contacts, such as device contact 410' and device contact 420', and at least two conductor contacts, such as conductor contact 430' and conductor contact 440'. Device contact 410' may be electrically coupled to first conductor group 210 (e.g., to one, some, or each conductor 212 of first conductor group 210 at or adjacent first conductor group second end 214 at second cable end 204) via conductor contact 430' and may be operative to be electrically coupled to a remote subsystem (e.g., subsystem 600), while contact 420' may be electrically coupled to second conductor group 220 (e.g., to one, some, or each conductor 222 of second conductor group 220 at or adjacent second conductor group second end 224 at second cable end 204) via conductor contact 440' and may be operative to be electrically coupled to the remote subsystem (e.g., subsystem 600). In other embodiments, it is to be understood that second cable connector subassembly 400' may include at least three contacts, each of which may be electrically coupled to a respective one of conductor groups 210', 220', and 280' of subassembly 200'. Device contact 410' may include a female receptacle portion 413' (e.g., a device coupling portion) and a device contact extension portion 414', while conductor contact 430' may include a coupling portion 434' and a conductor contact extension portion 433'. Coupling portion 434' of conductor contact 430' may be operative to be electrically coupled to at least a portion of first conductor group 210 (e.g., through ultrasonic welding), as shown by FIG. 37, while conductor contact extension portion 433' of conductor contact 430' may be operative to extend from coupling portion 434' and to be electrically coupled to device contact 410' (e.g., to device contact extension portion 414' (e.g., via laser welding)), as shown by FIG. 39, while female receptacle portion 413' of device contact 410' may be operative to interact with a remote subsystem (e.g., female receptacle portion 413' may be operative to receive and at least partially hold a respective male-type contact 610 of second device subsystem 600) for electrically coupling female receptacle portion 413' with remote subsystem 600 and, thus, for electrically coupling remote subsystem 600 with first conductor group 210 via device contact 410' and conductor contact 430'. Similarly, device contact 420' may include a female receptacle portion 423' (e.g., a device coupling portion) and a device contact extension portion 424', while conductor contact 440' may include a coupling portion 444' and a conductor contact extension portion 443'. Coupling portion 444' of conductor contact 440' may be operative to be electrically coupled to at least a portion of second conductor group 220' (e.g., through ultrasonic welding), as shown by FIG. 37, while conductor contact extension portion 443' of conductor contact 440' may be operative to extend from coupling portion 444' and to be electrically coupled to device contact 420' (e.g., to device contact extension portion 424' (e.g., via laser welding)), as shown by FIG. 39, while female receptacle portion 423' of device contact 420' may be operative to interact with a remote subsystem (e.g., female receptacle portion 423' may be operative to receive and at least partially hold a respective male-type contact 620 of second device subsystem 600) for electrically coupling female receptacle portion 423' with remote subsystem 600 and, thus, for electrically coupling remote subsystem 600 with second conductor group 220 via device contact 420' and conductor contact 440'. Each one of device contacts 410' and 420' may be made of any suitable conductive material or combination of conductive materials (e.g., phosphor bronze (e.g., C5191-H) with or without nickel plating) for enabling communication of electrical signals between device subsystem 600 and cable connector subassembly 400'. Similarly, each one of conductor contacts 430' and 440' may be made of any suitable conductive material or combination of conductive materials (e.g., phosphor bronze (e.g., C5191-H) with or without nickel plating) for enabling communication of electrical signals between at least one conductor of cable subassembly 200 and a respective device contact. As shown, the geometry and size of conductor contact 430' may be the same or substantially the same as conductor contact 440', which may enable contacts 430' and 440' to be used interchangeably during assembly for ease of manufacture. Moreover, as shown, the geometry and size of device contact 410' may be the same or substantially the same as device contact 420', which may enable contacts 410' and 420' to be used interchangeably during assembly for ease of manufacture. The electrical coupling of each one of conductor contacts 430' and 440' to a respective one of conductor groups 210 and 220 (e.g., through metal ultrasonic welding) may provide a coupling force of 100 newtons or at least 89 newtons. It is to be understood that while device coupling portion 413' of device contact 410' and device coupling portion 423' of device contact 420' may be shown as female-type receptacles (e.g., for receiving and/or at least partially holding a respective male-type contact of second device subsystem 600), at least one of device coupling portion 413' of device contact 410' and device coupling portion 423' of device contact 420' may be a male-type contact (e.g., for being received by and/or at least partially held by a respective female-type contact of second device subsystem 600). As shown, device contact 410' and device contact 420' may be identical (e.g., geometrically and/or physically and/or otherwise) such that only a single type of component may be required in order to provide each device contact of subassembly 400'. Additionally or alternatively, as shown, conductor contact 430' and conductor contact 440' may be identical (e.g., geometrically and/or physically and/or otherwise) such that only a single type of component may be required in order to provide each conductor contact of subassembly 400'.

Figure 41:
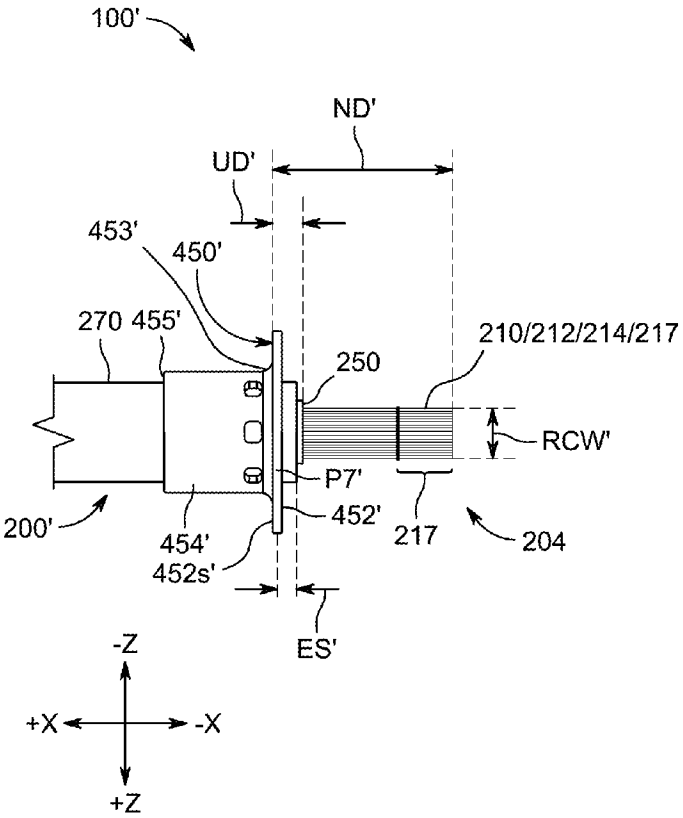
FIG. 41 is a side view of the portion of the cable assembly of FIGS. 32-40 in a stage of assembly between the third stage of assembly and the fourth stage of assembly.
Figure 43:
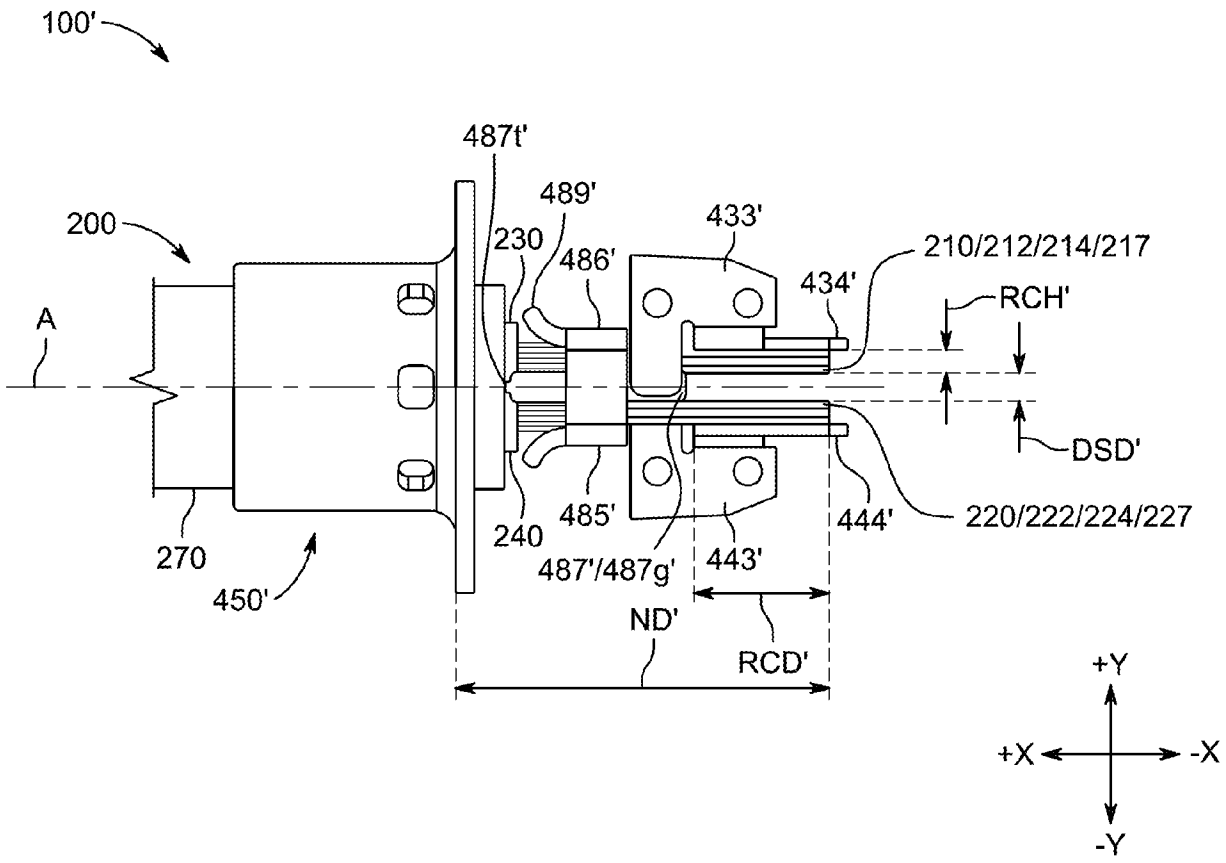
FIG. 43 is a side view of the portion of the cable assembly of FIGS. 32-42 in the fifth stage of assembly.

As shown, for example, by the differences between FIG. 35 and FIG. 36, prior to electrically coupling first conductor group 210 to conductor contact 430' and prior to electrically coupling second conductor group 220 to conductor contact 440', the shape of one or both of first conductor group 210 and second conductor group 220 may be reconfigured for more easily being electrically coupled to a respective conductor contact of cable connector subassembly 400'. For example, a portion of first conductor group 210 at or adjacent first conductor group second end 214 at second cable end 204 may be reconfigured from a first shape (e.g., a first shape with a cross-sectional D-shape of FIG. 35) to a second shape (e.g., a second shape with a rectangular cross-sectional shape of FIG. 36) for defining a conductor coupling portion 217 that may more easily be electrically coupled to a coupling surface or surfaces of coupling portion 434' of conductor contact 430' (e.g., for defining a larger surface area (e.g., width RCW' of a surface of conductor coupling portion 217 of conductor group 210 of FIG. 41 may be wider than the width of chord DC1 of conductor group 210 of FIG. 2)), and/or a portion of second conductor group 220 at or adjacent second conductor group second end 224 at second cable end 204 may be reconfigured from a first shape (e.g., a first shape with a cross-sectional D-shape of FIG. 35) to a second shape (e.g., a second shape with a rectangular cross-sectional shape of FIG. 36) for defining a conductor coupling portion 227 that may more easily be electrically coupled to a coupling surface or surfaces of coupling portion 444' of conductor contact 440'. Conductors 212 of the portion of conductor group 210 to be reconfigured may be held together in a new suitable shape through any suitable process, such as ultrasonic welding (e.g., metal ultrasonic welding) or any other suitable welding process or otherwise. For example, the portion of conductors 212 of the portion of conductor group 210 to be reconfigured may be positioned within an ultrasonic press and/or nest of a particular shape (e.g., a shape with a rectangular cross-section, where the conductors may be manually re-shaped from the initial D-shape to fit within such a press and/or nest through any manual or other suitable procedure) and then high-frequency ultrasonic acoustic vibrations may be applied thereto for holding that portion of conductors 212 together in that particular shape (e.g., for providing the rectangular cross-sectional shape of first conductor group 210 at or adjacent first conductor group second end 214 at second cable end 204 as shown in FIG. 36). Such reconfiguration may be operative to ensure that each conductor 212 of the reconfigured portion of conductors 212 of the portion of conductor group 210 at second cable end 204 may be electrically coupled to each other, such that when a coupling surface or surfaces of coupling portion 434' of conductor contact 430' may be electrically coupled to only a subset of conductors 212 at that reconfigured portion of conductor group 210, each conductor 212 may be electrically coupled to that coupling surface or surfaces of coupling portion 434' of conductor contact 430'. In some embodiments, conductor group 220 may be bent or otherwise moved away from conductor group 210 (e.g., in the −Y direction) such that conductor group 210 may be more easily interfaced with apparatus (e.g., ultrasonic welding apparatus) for reconfiguring the shape of conductor group 210, and/or conductor group 210 may be bent or otherwise moved away from conductor group 220 (e.g., in the +Y direction) such that conductor group 220 may be more easily interfaced with apparatus (e.g., ultrasonic welding apparatus) for reconfiguring the shape of conductor group 220. The geometry of the reconfigured portion of each conductor group may be any suitable geometry for promoting a reliable coupling with a conductor contact of subassembly 400'. For example, as shown in FIG. 41, a reconfigured shape of a portion of conductor group 210 at end 204 (e.g., conductor coupling portion 217) for coupling to conductor contact 430' may have any suitable width RCW' (e.g., width RCW' may be any suitable magnitude in a range between 2.20 millimeters and 2.30 millimeters or may be about 2.25 millimeters). As another example, as shown in FIG. 43, a reconfigured shape of a portion of conductor group 210 at end 204 (e.g., conductor coupling portion 217) for coupling to conductor contact 430' may have any suitable height RCH' (e.g., height RCH' may be any suitable magnitude in a range between 0.20 millimeters and 0.40 millimeters or may be about 0.30 millimeters). As shown, for example, in FIG. 43, three layers of conductors 212 may define this reconfigured shape, although conductors 212 may be rearranged in any suitable manner for providing the new shape. As another example, as shown in FIG. 43, a reconfigured shape of a portion of conductor group 210 at end 204 (e.g., conductor coupling portion 217) may provide any suitable dimension RCD' along the length of the reconfigured portion for coupling to conductor contact 430' (e.g., dimension RCD' may be any suitable magnitude in a range between 3.60 millimeters and 4.00 millimeters or may be about 3.80 millimeters). The portion of conductors 222 of the portion of conductor group 220 to be reconfigured (e.g., to provide conductor coupling portion 227) may be reconfigured in a similar manner as that of conductor group 210 and/or to a similar or different shape than that of conductor group 210.

Figure 36B:
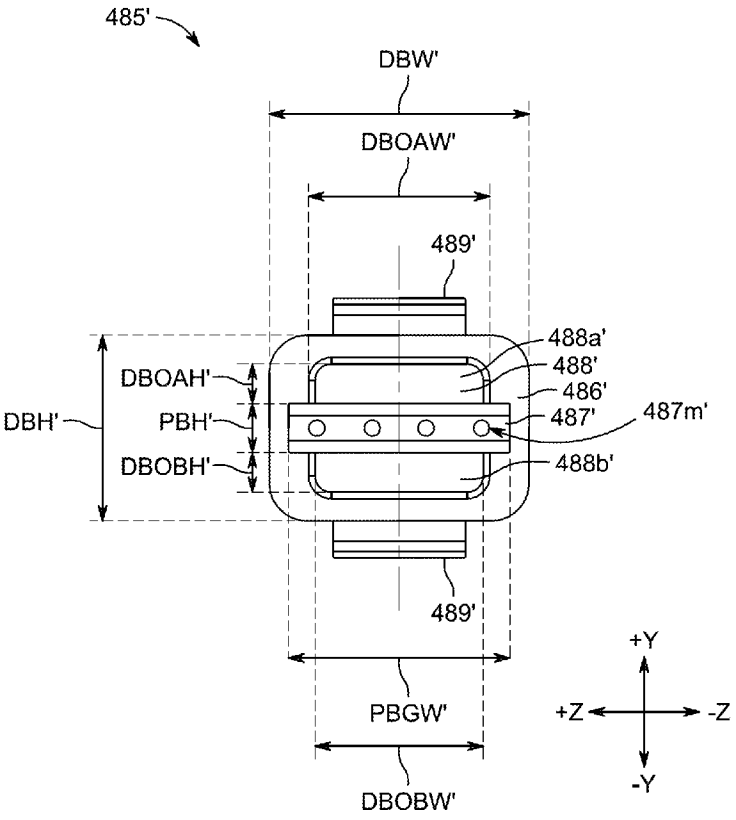
FIG. 36B is a front view of the component of the portion of the cable assembly of FIGS. 32-36.
Figure 36A:
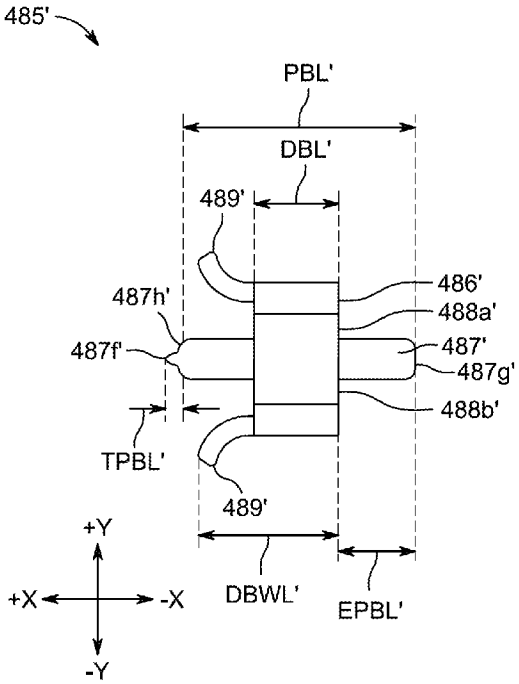
FIG. 36A is a side view of a component of the portion of the cable assembly of FIGS. 32-36.

As also shown in FIGS. 36, 36A, and 36B, either prior to or after any shape reconfiguration of conductor group 210 and/or conductor group 220, a divider component 485' may be inserted between conductor group 210 and conductor group 220 for promoting separation between conductor group 210 and conductor group 220 at end 204, which may prevent shorting between the two conductor groups and/or may better enable the coupling of conductor contacts 430' and 440' to respective conductor groups 210 and 220. Divider component 485' may include a divider body 486' defining a divider body opening 488', and a partition body 487' that may be coupled to or integrated with divider body 486' for defining a first opening 488*a*' (e.g., a portion of divider body opening 488') and a second opening 488*b*' (e.g., another portion of divider body opening 488'). Partition body 487' may extend between a first end 487*h*' that may include a tip 487*t*' and a second end 487*g*'. In some embodiments, first end 487*h*' may be inserted in the +X direction in between first conductor group second end 214 of first conductor group 210 at second cable end 204 and second conductor group second end 224 of second conductor group 220 at second cable end 204, such that a portion (e.g., a reconfigured portion) of first conductor group 210 may pass through first opening 488*a*' of divider component 485' and such that a portion (e.g., a reconfigured portion) of second conductor group 220 may pass through second opening 488*b*' of divider component 485'. As shown in FIG. 43, for example, first end 487*h*' may be inserted in the +X direction until a portion of divider component 485' physically interfaces with a non-conductor portion of cable subassembly 200 (e.g., until tip 487*t*' may be positioned against and/or in between insulation 230 and insulation 240, and/or until one or more wing tips 489' that may extend from divider body 486' may be positioned against a non-conductor portion of cable subassembly 200 (e.g., insulation 250 and/or jacket 260 and/or cover 270)), where wing tips 489' may be operative to help locate divider body 486' by acting as a stop against the insulators. At such an inserted position, partition body 487' may be positioned in between a portion of first conductor group 210 and a portion of second conductor group 220, which may be operative to promote or ensure any suitable spacing distance DSD' between conductor group 210 and conductor group 220 at end 204 (e.g., distance DSD' may be any suitable magnitude in a range between 0.80 millimeters and 0.86 millimeters or may be about 0.83 millimeters and preferably no less than 0.60 millimeters (e.g., to prevent shorting (e.g., to ensure a suitable amount of insulation may be provided (e.g., by body component 460') between conductor coupling portion 217 and conductor coupling portion 227 (e.g., for electrically isolating or insulating the electrical paths of conductor groups 210 and 220)))). Divider body 486' may have any suitable width DBW' (e.g., width DBW' may be any suitable magnitude in a range between 4.12 millimeters and 4.28 millimeters or may be about 4.20 millimeters), any suitable height DBH' (e.g., height DBH' may be any suitable magnitude in a range between 2.90 millimeters and 3.04 millimeters or may be about 2.97 millimeters), any suitable length DBL' not including any wing tips 489' (e.g., length DBL' may be any suitable magnitude in a range between 1.58 millimeters and 1.68 millimeters or may be about 1.63 millimeters), and any suitable length DBWL' including any wing tips 489' (e.g., length DBWL' may be any suitable magnitude in a range between 2.70 millimeters and 2.80 millimeters or may be about 2.75 millimeters). Divider body opening 488*a*' may have any suitable width DBOAW' (e.g., width DBOAW' may be any suitable magnitude in a range between 2.66 millimeters and 2.82 millimeters or may be about 2.74 millimeters), any suitable height DBOAH' (e.g., height DBOAH' may be any suitable magnitude in a range between 0.68 millimeters and 0.78 millimeters or may be about 0.73 millimeters), and any suitable length DBL'. Driver body opening 488*b*' may have any suitable width DBOBW' (e.g., width DBOBW' may be the same as or different than width DBOAW'), any suitable height DBOBH' (e.g., height DBOBH' may be the same as or different than height DBOAH'), and any suitable length DBL'. Partition body 487' may have any suitable height PBH' (e.g., height PBH' may be any suitable magnitude in a range between 0.73 millimeters and 0.83 millimeters or may be about 0.78 millimeters), any suitable length PBL' not including tip 487*t*' (e.g., length PBL' may be any suitable magnitude in a range between 3.05 millimeters and 3.15 millimeters or may be about 3.10 millimeters), any suitable length TPBL' for tip 487*t*' (e.g., length TPBL' may be any suitable magnitude in a range between 0.18 millimeters and 0.24 millimeters or may be about 0.21 millimeters), and any suitable length EPBL' extending beyond divider body 486' in the −X direction to second end 487*g*' (e.g., length EPBL' may be any suitable magnitude in a range between 1.43 millimeters and 1.57 millimeters or may be about 1.50 millimeters). A portion of partition body 487' at or proximate to second end 487*g*' may be wider than divider body opening 488' (e.g., width PBGW' of partition body 487' may be larger than width DBOAW' and/or width DBOBW' of body opening 488' (e.g., width PBGW' may be any suitable magnitude in a range between 3.52 millimeters and 3.62 millimeters or may be about 3.57 millimeters)). In some embodiments, as shown in FIG. 36B, for example, a portion of partition body 487' at or through second end 487*g*' may include one or more cavity markings 487*m*'. At least a portion or all of divider component 485' may be made of any suitable material or combination of materials, such as nylon (e.g., nylon PA4T) or any other suitable thermoplastic or any other suitable insulator that may not electrically couple conductor group 210 and conductor group 220, and may include any suitable surface finish (e.g., SPI Finish-B2).

As shown, second cable connector subassembly 400' may also include a cable support component 450', which may be similar to cable support component 450 of cable connector subassembly 400), that may be operative to be secured to cable subassembly 200 about a particular portion of cable subassembly 200 for providing a rigid surface against which a portion of a collet may exert any suitable force for retaining second cable connector subassembly 400' in a particular position with respect to remote subsystem 600 (e.g., retention mechanism 660 of FIGS. 26-30). For example, as shown in FIGS. 34-37, at any suitable moment during the formation of connector subassembly 400' (e.g., before or after or during the coupling of one or both of conductor contacts 430' and 440' to one or both of respective conductor groups 210 and 220, yet before a body component 460' may be provided as a portion of connector subassembly 400'), cable support component 450' may be positioned about a particular portion of cable subassembly 200 along its length, such as at a position P7' along cable subassembly 200 about an outer surface of cable subassembly 200 (e.g., cover 270 or jacket 260 if no cover 270 is provided). As shown in FIGS. 35 and 41, for example, position P7' may be spaced a distance ES' from an end of cover 270 at cable end 204 (e.g., distance ES' may be any suitable magnitude in a range between 0.90 millimeters and 1.10 millimeters or may be about 1.00 millimeters), and cable support component 450' may include a base body 452', which may be any suitable shape (e.g., disk shaped) with any suitable maximum cross-sectional outer width (e.g., a width similar to width SW of support component 450 of cable connector subassembly 400) and any suitable length (e.g., a length similar to length SL of support component 450 of cable connector subassembly 400) and any suitable thickness (e.g., a thickness similar to thickness ST of support component 450 of cable connector subassembly 400), and which may define a main opening 451' having any suitable maximum cross-sectional width (e.g., a cross-sectional width similar to cross-sectional width SO of support component 450 of cable connector subassembly 400) that may be operative to surround and contact an outer surface of cable subassembly 200 (e.g., cover 270). A base body surface 452*s*' of base body 452' about main opening 451' facing away from cable end 204 (e.g., facing the +X-direction and/or lying in an X-Y plane) may be operative to provide a rigid surface against which a portion of a collet may exert any suitable force for retaining second cable connector subassembly 400' in a particular position with respect to remote subsystem 600 (e.g., retention mechanism 660 of FIGS. 26-30).

As also shown in FIGS. 35 and 41, for example, cable support component 450' may also include an extension body 454' that may be coupled to base body 452' at one extension end 453' and that may extend away from base body 452' to another extension end 455' (e.g., generally in the +X-direction away from cable end 204 when component 450 is positioned about cable subassembly 200). Extension body 454' may be any suitable shape and may extend any suitable length away from base body 452' about cable subassembly 200 (e.g., a length similar to length XL of support component 450), and extension body 454' may also define a portion of main opening 451' having maximum cross-sectional width similar to that of base body 452'. However, as also shown (e.g., by the differences between FIGS. 34 and 35), at least a portion of extension body 454' may be mechanically deformed and/or compressed or crimped about cable subassembly 200 for fixing extension body 454' and, thus, base body 452' about cable subassembly 200 at a particular position (e.g., with respect to position P7'), where such crimping of extension body 454' may be operative to prevent cable support component 450' from sliding along the length of cable subassembly 200 (e.g., along the X-axis) and/or from rotating about cable subassembly 200 (e.g., about axis A or the X-axis) during future use of cable subassembly 200 and connector subassembly 400' (e.g., during retention of connector subassembly 400' in a particular position with respect to remote subsystem 600). Moreover, as shown in FIG. 41, for example, insulation 230 and insulation 240 may extend a distance UD' away from base body surface 452*s*' of base body 452' (e.g., distance UD' may be any suitable magnitude in a range between 1.30 millimeters and 1.90 millimeters or may be about 1.60 millimeters), and first conductor group second end 214 and second conductor group second end 224 may extend a distance ND' away from base body surface 452*s*' of base body 452' (e.g., distance ND' may be any suitable magnitude in a range between 9.20 millimeters and 10.30 millimeters or may be about 9.70 millimeters). Cable support component 450' may be made of any suitable material or combination of materials (e.g., stainless steel (e.g., SUS304 ½H or ¾H)) that may provide suitable rigidity (e.g., at base body surface 452*s*') against which a portion of a collet may exert any suitable force for retaining second cable connector subassembly 400' in a particular position with respect to remote subsystem 600.

Figure 42:
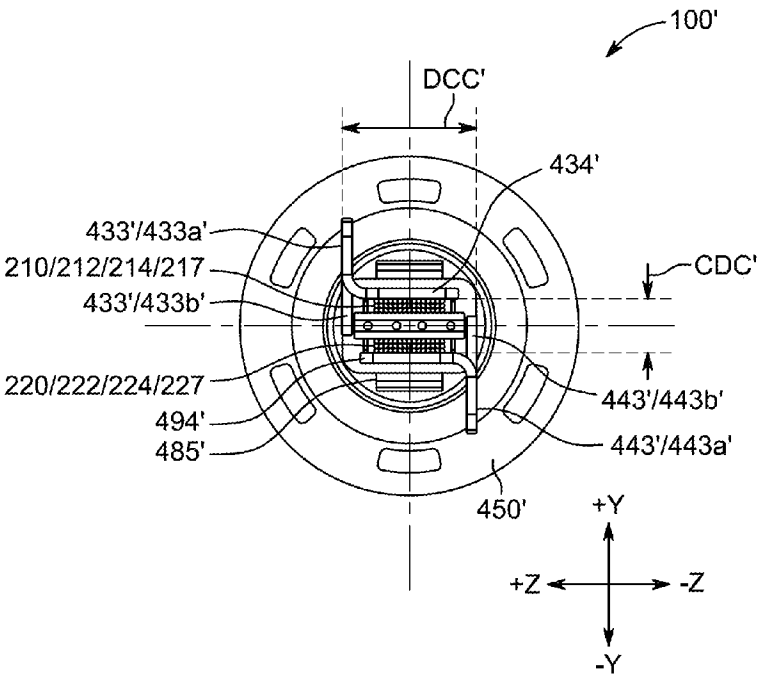
FIG. 42 is a front view of the portion of the cable assembly of FIGS. 32-41 in the fifth stage of assembly.

Once cable support component 450' has been fixed (e.g., crimped) to cable subassembly 200 and once divider component 485' has been positioned to promote division between first conductor group 210 and second conductor group 220 and once conductor contact 430' has been electrically coupled (e.g., metal ultrasonically welded) to first conductor group 210 (e.g., once a coupling surface (e.g., a flat and/or bottom surface) of coupling portion 434' of conductor contact 430' has been coupled to a surface (e.g., a flat and/or top surface) of conductor coupling portion 217 of first conductor group 210) and once conductor contact 440' has been electrically coupled (e.g., metal ultrasonically welded) to second conductor group 220 (e.g., once a coupling surface (e.g., a flat and/or top surface) of coupling portion 444' of conductor contact 440' has been coupled to a surface (e.g., a flat and/or bottom surface) of conductor coupling portion 227 of second conductor group 220) (e.g., as may be shown by FIGS. 33-37, 42, and 43, where the coupling surface of coupling portion 434' and the coupling surface of coupling portion 444' may lie in parallel or substantially parallel planes and/or may be separated from each other by the remainder of coupling portion 434' and the remainder of coupling portion 444'), a body component 460' of second cable connector subassembly 400', which may be similar to body component 460 of cable connector subassembly 400, may be provided for additional structure. For example, as shown in FIG. 38, body component 460' may be provided to encompass a portion of conductor contact 430' (e.g., coupling portion 434'), a portion of conductor contact 440' (e.g., coupling portion 444'), and a portion of cable subassembly 200 (e.g., any portion of first conductor group 210 and/or second conductor group 220 and/or insulation subassembly 250 that may not be surrounded by jacket 260 and/or cover 270 at second cable end 204). Such provisioning of body component 460' may be operative to protect and/or reinforce the electrical and mechanical coupling of conductor contact 430' and first conductor group 210 (e.g., at coupling portion 434) and to protect and/or reinforce the electrical and mechanical coupling of conductor contact 440' and second conductor group 220 (e.g., at coupling portion 444'), while still enabling at least a portion of conductor contact extension portion 433' of conductor contact 430' to be exposed for electrical coupling with device contact extension portion 414', and while still enabling at least a portion of conductor contact extension portion 443' of conductor contact 440' to be exposed for electrical coupling with device contact extension portion 424'. For example, as shown in FIG. 38, a portion of conductor contact extension portion 433' (e.g., conductor contact extension portion 433*a*') may extend out from body component 460' (e.g., in the +Y-direction) by any suitable distance (e.g., a distance similar to distance XD of cable connector subassembly 400) above a top shelf 461' of body component 460' for electrical coupling with device contact extension portion 414', and a portion of conductor contact extension portion 443' (e.g., conductor contact extension portion 443*a*') may extend out from body component 460 (e.g., in the −Y-direction) by a distance that may be similar to distance XD below a bottom shelf 463' of body component 460' for electrical coupling with device contact extension portion 424'. In some embodiments, as shown in FIG. 42, for example, another portion of conductor contact extension portion 433' (e.g., conductor contact extension portion 433*b*) may extend (e.g., in the −Y-direction) past first conductor group 210 and adjacent to divider component 485' (e.g., conductor contact extension portion 433*b*' may be configured to contact and/or abut and/or exert any suitable force on a surface portion of partition body 487' at or proximate to second end 487*g*') and/or another portion of conductor contact extension portion 443' (e.g., conductor contact extension portion 443*b*') may extend (e.g., in the +Y-direction) past second conductor group 220 and adjacent to divider component 485' (e.g., conductor contact extension portion 443*b*' may be configured to contact and/or abut and/or exert any suitable force on a surface portion of partition body 487' at or proximate to second end 487*g*'). As shown in FIG. 42, for example, a distance DCC' between a first plane that may be defined by or that may include at least a portion of conductor contact extension portion 433' (e.g., a first X-Y plane) and a second plane that may be defined by or that may include at least a portion of conductor contact extension portion 443' (e.g., a second X-Y plane) may be any suitable magnitude, such as in a range between 4.10 millimeters and 4.50 millimeters or may be about 4.30 millimeters. Additionally or alternatively, as shown in FIG. 42, for example, a minimum distance CDC' between conductor contact 430' and conductor contact 440' (e.g., between a surface of coupling portion 434' coupled to conductor group 210 and a surface of coupling portion 444' coupled to conductor group 220) may be any suitable magnitude (e.g., in a range between 1.60 millimeters and 2.00 millimeters or may be about 1.80 millimeters).

Moreover, as described with respect to body component 460 of cable connector subassembly 400, a portion of body component 460' of cable connector subassembly 400' may be operative to cover a portion of cable support component 450' about cable subassembly 200 (e.g., the entirety of extension body 454' and the majority of base body 452' except for at least a portion of base body surface 452*s*', which may be directly contacted by a collet for retaining a particular position of second cable connector subassembly 400' with respect to remote subsystem 600 (e.g., retention mechanism 660 of FIGS. 26-30)), as well as any other suitable portion of cable subassembly 200 that may not be engaged by cable support component 450' (e.g., a portion of cable subassembly 200 in the +X direction beyond another extension end 455' of extension body 454' of cable support component 450'). Such provisioning of body component 460' about one or more portions of cable subassembly 200 (e.g., an end portion of first conductor group 210 and/or of second conductor group 220 and/or of insulation subassembly 250 and/or of cover 270 and/or of jacket 260 at second cable end 204) may be operative to protect and/or further insulate conductors 212 and 222 of cable subassembly 200.

In some embodiments, as shown in FIGS. 39 and 43, once body component 460' has been provided, a portion of conductor contact extension portion 433' of conductor contact 430' that may be extending out from body component 460' may be electrically coupled to device contact 410' (e.g., to device contact extension portion 414' (e.g., via laser welding)) and a portion of conductor contact extension portion 443' of conductor contact 440' that may be extending out from body component 460' may be electrically coupled to device contact 420' (e.g., to device contact extension portion 424' (e.g., via laser welding)). Device contact 410' may include device contact extension portion 414' of any suitable geometry, such as a regular cuboid with an outer surface 414*o*' and an opposite inner surface that may interface with and be electrically coupled to an outer surface 433*o*' of conductor contact extension portion 433'. Alternatively, although not shown, outer surface 414*o*' of extension portion 414' may interface with and be electrically coupled to an inner surface of conductor contact extension portion 433'. Device contact 410' may also include female receptacle portion 413' of any suitable geometry, such as a U-shaped component (e.g., similar to receptacle portion 413 of second cable connector subassembly 400), where a female receptacle space may be defined (e.g., for receiving and/or holding contact 620 of subsystem 600). Moreover, device contact 410' may also include a curved or angled or bent arm 414*a*' that may extend from a first arm end at extension portion 414' to a second arm end at receptacle portion 413'. Device contact 420' may be the same or substantially the same as device contact 410', which may enable contacts 410' and 420' to be used interchangeably during assembly for ease of manufacture. For example, as shown, device contact 420' may include device contact extension portion 424' of any suitable geometry, such as a regular cuboid with an outer surface 424*o*' and an opposite inner surface that may interface with and be electrically coupled to an outer surface of conductor contact extension portion 443'. Alternatively, although not shown, outer surface 424*o*' of extension portion 414' may interface with and be electrically coupled to an inner surface of conductor contact extension portion 443'. Device contact 420' may also include female receptacle portion 423' of any suitable geometry, such as a U-shaped component (e.g., similar to receptacle portion 423 of second cable connector subassembly 400), where a female receptacle space may be defined (e.g., for receiving and/or holding contact 620 of subsystem 600). Moreover, device contact 420' may also include a curved or angled or bent arm that may extend from a first arm end at extension portion 424' to a second arm end at receptacle portion 423'.

As shown in FIGS. 37-39, for example, device contacts 410' and 420', in conjunction with body component 460' and conductor contacts 430' and 440', may provide a structure with geometry capable of communicating any suitable electrical signals according to various standards. Once body component 460' has been provided and device contact 410' has been electrically coupled to conductor contact 430' (e.g., via one or more laser weld instances 439' between conductor contact extension portion 433' and extension portion 414'), a spacing (e.g., a spacing similar to spacing QS of cable connector subassembly 400) may be maintained between extension portion 414' and body component 460' (e.g., between a bottom of extension portion 414' and top shelf 461' of body component 460'). Another spacing (e.g., a spacing similar to spacing LS of cable connector subassembly 400) may be maintained between female receptacle portion 413' and body component 460'. Body component 460' of cable connector subassembly 400' may provide a similar geometry and function to that of body component 460 of cable connector subassembly 400.

Figure 40:
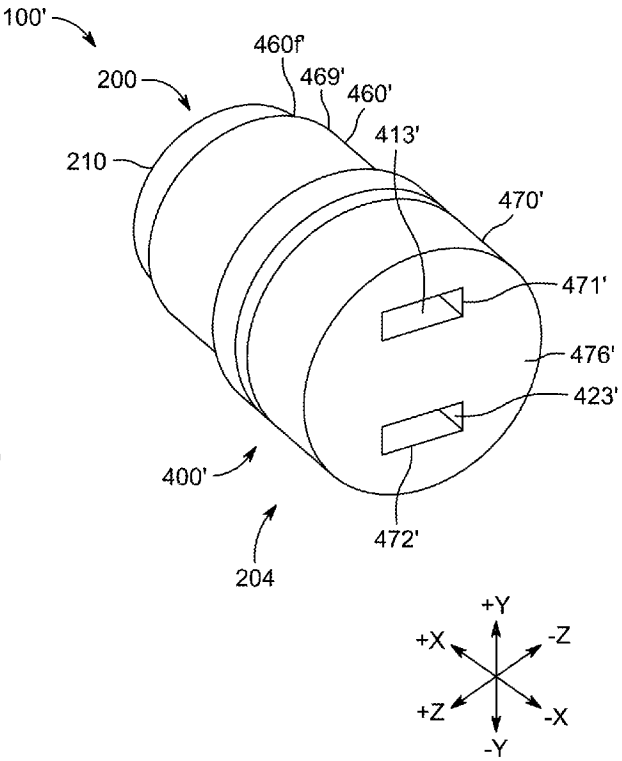
FIG. 40 is a perspective view of the portion of the cable assembly of FIGS. 32-39 in an eighth stage of assembly.

In some embodiments, as shown in FIG. 40, once body component 460' has been provided and once conductor contacts 430' and 440' have been electrically coupled to respective device contacts 410' and 420', an outer component 470' of second cable connector subassembly 400', which may be similar to outer component 470 of cable connector assembly 400, may be provided for additional structure. For example, as shown, outer component 470' may be operative to surround a portion of body component 460' and abut another portion of body component 460'. Additionally, as shown, outer component 470' may be operative to surround the entirety of device contacts 410' and 420' while still enabling device contacts 410' and 420' to be accessible for potential interaction with a remote subsystem. For example, outer component 470' may be provided to include one or more suitable passages, such as passages 471' and 472' provided through a front wall 476' of outer component 470', for enabling female receptacle portions 413' and 414' to be accessible by remote subsystem 600 for potential interaction with respective contacts 610 and 620 (e.g., introduction of contact 610 into a female receptacle space of female receptacle portion 413' via passage 471' for electrically coupling contact 610 and contact 410' and/or introduction of contact 620 into a female receptacle space of female receptacle portion 423' via passage 472' for electrically coupling contact 620 and contact 420'). Outer component 470' of cable connector subassembly 400' may provide a similar geometry and function to that of outer component 470 of cable connector subassembly 400.

In some embodiments, once body component 460' has been provided, a trim component (e.g., a trim component similar to trim component 490 of cable connector subassembly 400) may be provided for additional structure of cable connector subassembly 400'. For example, a trim component may be operative to extend along and about a portion of cable subassembly 200 and/or along and about a portion of body component 460' (e.g., a mechanical feature **460*f* of body component 460' (e.g., a nub or groove), as shown in FIG. 40, for example, may interact with a mechanical feature of the trim component (e.g., a groove or nub) for mechanically coupling the trim component to body component 460' about cable subassembly 200). For example, the trim component may be configured as a snap ring for engaging body component 460'. Such a trim component may be configured to be removed from body component 460' by an end user or by a manufacturer for any suitable purpose (e.g., to enable easier removal of cable connector subassembly 400' from remote subsystem 600**).

Body component 460' and/or outer component 470' of cable connector subassembly 400' may be formed using any suitable material(s) using any suitable techniques. For example, component 460' may be molded (e.g., injection molded) using any suitable material (e.g., a polycarbonate resin (e.g., Emerge™ PC 8600-10)), while component 470' may be molded (e.g., molded and then coupled (e.g., ultrasonically welded) to body component 460' or over molded onto body component 460') using any suitable material (e.g., a polycarbonate resin (e.g., Emerge™ PC 8600-10)). Component 460' may differ from component 470' with respect to any suitable characteristic, such as size, shape, color, flexibility, deformability, tactility, ability to repel certain fluids, and/or the like. Alternatively, component 460' and component 470' may be formed from the same material. Additionally or alternatively, the manner(s) in which component 460' may be formed may be the same as or different than the manner(s) in which component 470' may be formed. In some embodiments, body component 460' of cable connector subassembly 400' may be formed similarly to how body component 460 of cable connector subassembly 400 may be formed. Additionally or alternatively, in some embodiments, outer component 470' of cable connector subassembly 400' may be formed similarly to how outer component 470 of cable connector subassembly 400 may be formed.

Therefore, cable connector subassembly 400' may provide a cleanly defined subassembly for electrically coupling contacts 410' and 420' to respective conductor groups 210 and 220 while providing a reduced size connector for use with subsystem 600.

Figure 44:
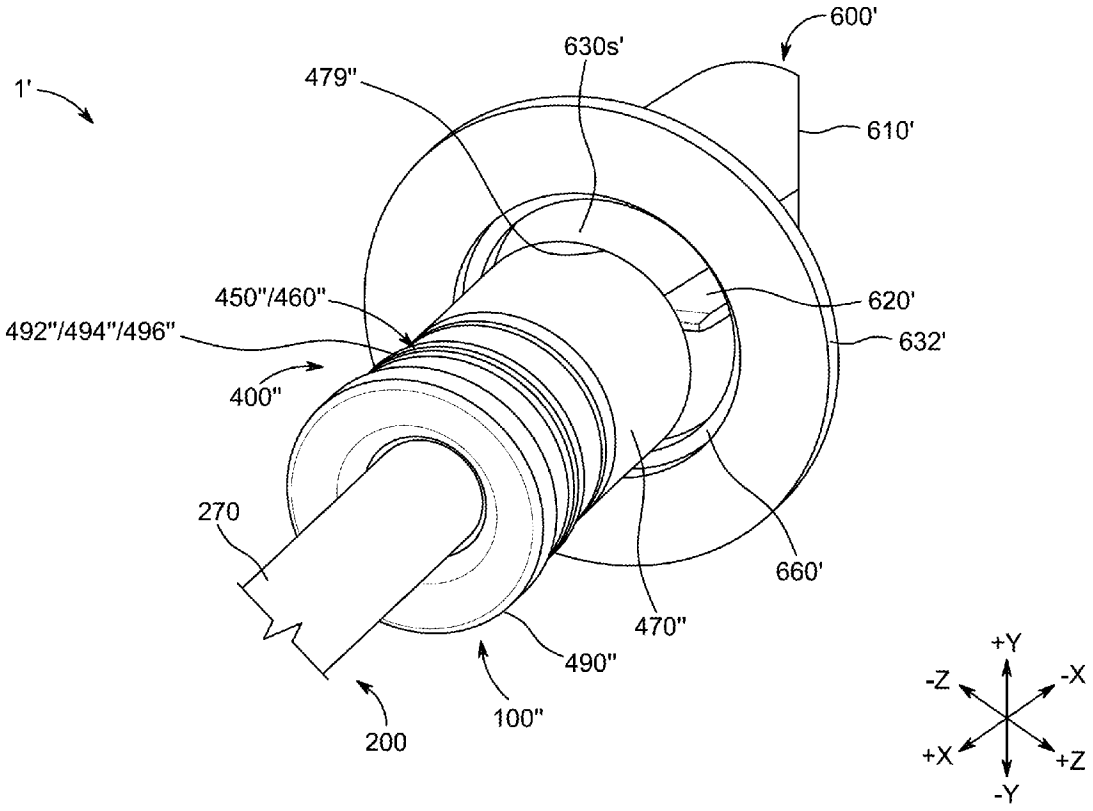
FIG. 44 is a perspective view of yet another portion of the cable assembly of FIG. 1 including yet another second cable connector subassembly prior to insertion into another device subsystem of FIG. 1.
Figure 45:
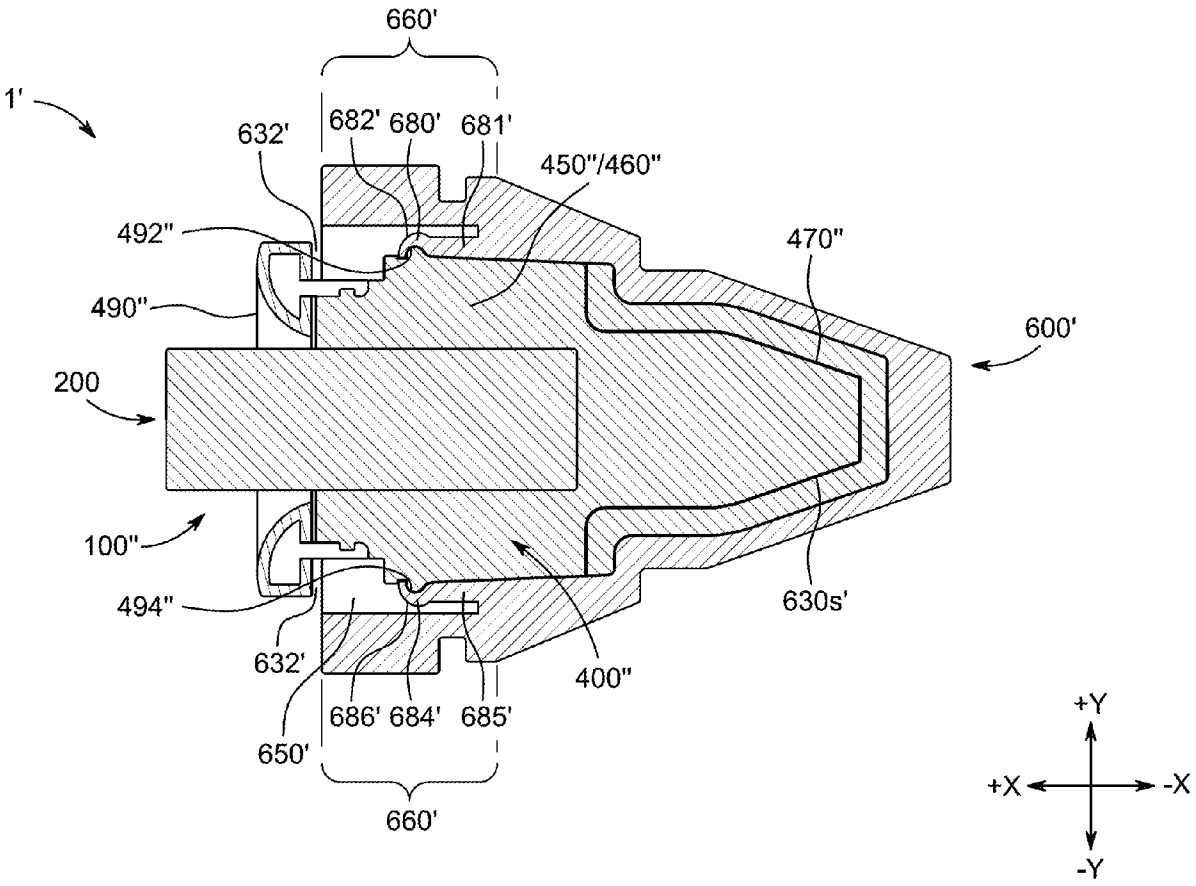
FIG. 45 is a cross-sectional view of the portion of the cable assembly of FIG. 44 after insertion into the device subsystem of FIGS. 1 and 44.

In some embodiments, as shown in FIGS. 44 and 45, a receptacle 630' of another device subsystem 600', which may be similar to device subsystem 600, may house at least a portion of a first contact (not shown) and at least a portion of a second contact 620' positioned within a receptacle space **630*s*' defined by receptacle 630'. Therefore, in such embodiments, a second cable connector subassembly 400", which may be similar to subassembly 400 and/or subassembly 400', and as may be coupled to cable subassembly 200 of a cable assembly 100", may be at least partially inserted into receptacle 630' (e.g., in the –X-direction from the position of FIG. 44 through an opening of device subsystem 600' and into receptacle space 630*s*' of receptacle 630' to the position of FIG. 45), such that female receptacle spaces of subassembly 400" (e.g., female receptacle spaces similar to female receptacle spaces 413*s* and 423*s* of subassembly 400 and/or to female receptacle spaces 413*s*' and 423*s*' of subassembly 400') may receive a respective contact, including contact 620', of subsystem 600' for electrically coupling female receptacle portions of subassembly 400" with contacts of subsystem 600' of a system 1'. In order to retain cable assembly 100" in the position of FIG. 45 (e.g., the position in which connector subassembly 400" may be electrically coupled to device subsystem 600' within receptacle space 630*s*'), a retention mechanism 660' may be provided by device subsystem 600' for interacting with subassembly 400" to retain cable assembly 100"** at that position.

Retention mechanism 660' may be any suitable mechanism that may be operative to prevent connector subassembly 400" from being withdrawn from receptacle space **630*s*' (e.g., in the +X-direction) despite forces of a certain magnitude attempting to pull connector subassembly 400" out from receptacle space 630*s*' (e.g., retention mechanism 660' may be operative to withstand any suitable forces (e.g., forces of 120 Newton or in the range of between 60 Newton and 800 Newton or up to or beyond 1075 Newton) that may be applied to connector subassembly 400' in the +X-direction for retaining subassembly 400" within receptacle space 630*s*'). Retention mechanism 660' may be physically distinct from and/or electrically insulated from each contact of device subsystem 600' (e.g., from contact 620'). In some embodiments, as shown in FIGS. 44 and 45, for example, retention mechanism 660' may be provided as a flexible retention arm or any other suitable device. Retention mechanism 660' may be described as a flexible retention arm mechanism with at least one retention arm that may extend from a first end that may be physically coupled to receptacle 630' or any other suitable portion of device subsystem 600' to a second free end that may be operative to interact with a feature of subassembly 400" for capturing and holding subassembly 400" in the position of FIG. 45. For example, as shown, retention mechanism 660' may include at least a first retention arm 680' that may extend from a first end 681' that may be coupled to receptacle 630' to a second free end 682' that may be operative to interact with a retainable feature 492" of subassembly 400" (e.g., within a pocket 650' that may be similar to pocket 650 of subsystem 600). Retainable feature 492" may be a bump or any other suitable feature that may be reciprocal to (e.g., operative to snap into) a feature of device retention mechanism 660', where retainable feature 492" may extend from or define any suitable exterior surface portion of subassembly 400" (e.g., a portion of a body component 460" that may be similar to body component 460 and/or body component 460' and/or a portion of a cable support component 450" that may be similar to cable support component 450 and/or cable support component 450' (e.g., retainable feature 492" may be similar to base body 452 (e.g., base body surface 452***s* may provide at least a portion of retainable feature 492")) and/or a portion of an outer component 470" that may be similar to outer component 470 and/or outer component 470'). Additionally, in some embodiments, as shown, retention mechanism 660' may include a second retention arm 684' that may extend from a first end 685' that may be coupled to receptacle 630' to a second free end 686' that may be operative to interact with a retainable feature 494" of subassembly 400" (e.g., within pocket 650' that may be similar to pocket 650 of subsystem 600). Retainable feature 494" may be a bump or any other suitable feature that may be reciprocal to (e.g., operative to snap into) a feature of device retention mechanism 660', where retainable feature 494" may extend from or define any suitable exterior surface portion of subassembly 400" (e.g., a portion of body component 460" that may be similar to body component 460 and/or body component 460' and/or a portion of cable support component 450" that may be similar to cable support component 450 and/or cable support component 450' (e.g., retainable feature 494" may be similar to base body 452 (e.g., base body surface 452*s* may provide at least a portion of retainable feature 494")) and/or a portion of outer component 470" that may be similar to outer component 470 and/or outer component 470'). In some embodiments, retention arm 682' and retention arm 684' may be distinct features for providing distinct free ends 682' and 686' (e.g., on opposite sides of receptacle space 630*s*'), where retention mechanism 660' may include any suitable number (e.g., 2, 3, 4, 6, 12, 20, 36, or the like) of such distinct retention arms at any suitable orientations about receptacle space 630*s*' that may interact with one or more distinct retainable features of subassembly 400". Alternatively, retention arm 682' and retention arm 684' may be different portions of a single integral feature for providing a single integral free end including free ends 682' and 686' that may interact with one or more distinct retainable features of subassembly 400". For example, retention arm 682' and retention arm 684' may be different portions of a single integral ring-shape (e.g., annular) feature extending about a portion or all of receptacle space 630*s*' and, thus, subassembly 400". Similarly, retainable feature 492" and retainable feature 494" may be distinct features for providing distinct elements that may interact with (e.g., snap into) be retained by one or more distinct free ends of retention mechanism 660'. Alternatively, retainable feature 492" and retainable feature 494" may be different portions of a single integral feature for providing a single integral retainable feature that may interact with (e.g., snap into) and be retained by one or more distinct free ends of one or more distinct retention arms of retention mechanism 660'. For example, retainable feature 492" and retainable feature 494" may be different portions of a single integral ring-shape (e.g., annular) feature extending about a portion or all of subassembly 400" (e.g., as shown in FIG. 44, retainable feature 492" and retainable feature 494" may be provided by a single ring-shape retainable feature 496" that may extend about at least a portion of body component 460" (e.g., about the longitudinal axis of assembly 100") and/or define a portion of the outer surface of body component 460"). Retainable feature 492" and/or retainable feature 494" and/or retainable feature 496" may be electrically isolated or insulated from each conductor group of cable subassembly 200 by insulation subassembly 250 and/or jacket 260 and/or cover 270 and/or body component 460" and/or outer component 470". One or more retainable features (e.g., retainable feature 492" and/or retainable feature 494') may be metal (e.g., a portion of cable support component 450") or may be a portion of body 460" or a bump or groove and separate metal spring that may shaped in the form of a ring in the groove to act as the bump or may be a portion of outer component 470". Therefore, retention mechanism 660' may enable at least a semi-permanent connection between cable connector subassembly 400" and device subsystem 600', which may be configured so as not to be broken by an end user of system 1'. In some embodiments, a trim component 490" of subassembly 400" may be operative to interface with (e.g., snap into or be glued to or be press-fitted against) an exterior surface 632' of receptacle 630' or of any external portion of device subsystem 600', where such an interface between trim component 490" and exterior surface 632' may be operative to block or otherwise make inaccessible (e.g., by an end user) receptacle space 630*s*' or any other opening that may be used by a manufacturer or other suitable entity to introduce a tool for manipulating retention mechanism 660' and/or subassembly 400" for releasing subassembly 400" from mechanism 660'. Alternatively, subassembly 400" may be pulled out from mechanism 660' with a force great enough to overcome a snap retention force.

While there have been described cable assemblies, systems, and methods for making the same, it is to be understood that many changes may be made therein without departing from the spirit and scope of the subject matter described herein in any way. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms, such as "up" and "down," "front" and "back," "exterior" and "interior," "top" and "bottom" and "side," "length" and "width" and "depth," "thickness" and "diameter" and "cross-section" and "longitudinal," "X-" and "Y-" and "Z-," and the like may be used herein only for convenience, and that no fixed or absolute directional or orientational limitations are intended by the use of these words.

Therefore, those skilled in the art will appreciate that the invention can be practiced by other than the described embodiments, which are presented for purposes of illustration rather than of limitation.

What is claimed is:

1. An assembly for being electrically coupled to an electronic device comprising a first electrical contact and a second electrical contact, the assembly comprising:

a cable subassembly comprising:

a first conductor subassembly; and a second conductor subassembly; and a cable connector subassembly comprising:

a first conductor contact comprising:

a first conductor coupling portion electrically coupled to the first conductor subassembly; and a first conductor contact extension portion extending from the first conductor coupling portion;

a second conductor contact comprising:

a second conductor coupling portion electrically coupled to the second conductor subassembly; and a second conductor contact extension portion extending from the second conductor coupling portion;

a body component encompassing the first conductor coupling portion and the second conductor coupling portion, wherein a portion of the first conductor contact extension portion extends out from the body component, and wherein a portion of the second conductor contact extension portion extends out from the body component;

a first device contact comprising:

a first device coupling portion operative to be electrically coupled to the first electrical contact of the electronic device; and a first device contact extension portion extending from the first device coupling portion and electrically coupled to the portion of the first conductor contact extension portion; and a second device contact comprising:

a second device coupling portion operative to be electrically coupled to the second electrical contact of the electronic device; and a second device contact extension portion extending from the second device coupling portion and electrically coupled to the portion of the second conductor contact extension portion.

2. The assembly of claim 1, wherein a portion of the body component electrically insulates the first conductor coupling portion from the second conductor coupling portion.

3. The assembly of claim 1, wherein a portion of the body component electrically insulates a portion of the first conductor subassembly from a portion of the second conductor subassembly.

4. The assembly of claim 1, wherein:

the portion of the first conductor contact extension portion extends out from the body component through a top surface of the body component; and the portion of the second conductor contact extension portion extends out from the body component through a bottom surface of the body component that is opposite the top surface of the body component.

5. The assembly of claim 1, wherein the first conductor contact is identical to the second conductor contact.

6. The assembly of claim 1, wherein the first device contact is identical to the second device contact.

7. The assembly of claim 1, wherein:

the first conductor coupling portion is ultrasonically welded to a coupling surface of the first conductor subassembly; and the second conductor coupling portion is ultrasonically welded to a coupling surface of the second conductor subassembly that is parallel to the coupling surface of the first conductor subassembly.

8. The assembly of claim 7, wherein at least one of the coupling surface of the first conductor subassembly and the coupling surface of the second conductor subassembly is positioned between the first device coupling portion and the second device coupling portion.

9. The assembly of claim 1, wherein:

the first device coupling portion is operative to be electrically coupled to the first electrical contact of the electronic device for electrically coupling the first electrical contact of the electronic device to the first conductor subassembly via the first conductor contact;

the second device coupling portion is operative to be electrically coupled to the second electrical contact of the electronic device for electrically coupling the second electrical contact of the electronic device to the second conductor subassembly via the second conductor contact; and when both the first electrical contact is electrically coupled to the first conductor subassembly and the second electrical contact is electrically coupled to the second conductor subassembly, the assembly is operative to communicate alternating current power with the electronic device.

10. The assembly of claim 1, wherein the first conductor coupling portion is crimped to the first conductor subassembly.

11. An assembly for being electrically coupled to an electronic device comprising a retention mechanism and an electrical contact that is at least partially positioned within a device receptacle space defined by the electronic device, the assembly comprising:

a conductor subassembly comprising a conductor; and a cable connector subassembly comprising:

a retainable feature that is operative to interact with the retention mechanism for retaining a portion of the cable connector subassembly within the device receptacle space when the retainable feature is inserted into the device receptacle space beyond a portion of the retention mechanism; and a device coupling portion electrically coupled to the conductor and operative to be electrically coupled to the electrical contact when the portion of the cable connector subassembly is retained within the device receptacle space, wherein:

the conductor subassembly further comprises an insulation subassembly extending about the conductor along a length of the conductor subassembly;

the cable connector subassembly further comprises a cable support component comprising:

an extension body positioned about the insulation subassembly along a portion of the length of the conductor subassembly; and a base body coupled to the extension body and extending away from an outer surface of the conductor subassembly; and a surface of the base body provides at least a portion of the retainable feature.

12. The assembly of claim 11, wherein:

the cable connector subassembly further comprises an outer component that encompasses at least a portion of the device coupling portion; and the outer component comprises a passage that is operative to pass therethrough at least a portion of the electrical contact when the portion of the cable connector subassembly is retained within the device receptacle space.

13. The assembly of claim 11, wherein:

the retainable feature is operative to interact with the retention mechanism for retaining the portion of the cable connector subassembly within the device receptacle space when the retainable feature is inserted in an insertion direction into the device receptacle space; and the surface of the base body faces a second direction that is opposite to the insertion direction when the portion of the cable connector subassembly is retained within the device receptacle space.

14. The assembly of claim 11, wherein the surface of the base body is metal.

15. The assembly of claim 11, wherein the cable connector subassembly further comprises a body component that encompasses a portion of the device coupling portion and a portion of the cable support component.

16. The assembly of claim 11, wherein the extension body is crimped to the outer surface of the conductor subassembly.

17. The assembly of claim 11, wherein:

the cable connector subassembly further comprises a body component that encompasses a portion of the device coupling portion; and a portion of the body component provides at least the portion of the retainable feature.

18. The assembly of claim 17, wherein the portion of the body component extends about and outwardly away from the conductor at a position along a length of the conductor.

19. The assembly of claim 11, wherein the retainable feature is operative to snap into the retention mechanism for retaining the portion of the cable connector subassembly within the device receptacle space when the retainable feature is inserted into the device receptacle space beyond the portion of the retention mechanism.

20. The assembly of claim 11, wherein, when the portion of the cable connector subassembly is retained within the device receptacle space, the retainable feature is operative to interact with the retention mechanism for preventing the portion of the cable connector subassembly from being removed from the device receptacle space without a removal tool being introduced into the device receptacle space.

21. The assembly of claim 12, wherein a portion of the outer component provides at least the portion of the retainable feature.

22. The assembly of claim 21, wherein the retainable feature is operative to snap into the retention mechanism for retaining the portion of the cable connector subassembly within the device receptacle space when the retainable feature is inserted into the device receptacle space beyond the portion of the retention mechanism.

* * * * *